US006479199B2

(12) United States Patent
Fukawa

(10) Patent No.: US 6,479,199 B2
(45) Date of Patent: Nov. 12, 2002

(54) PROCESSING METHOD OF SILVER HALIDE PHOTOGRAPHIC LIGHT SENSITIVE MATERIAL

(75) Inventor: Junichi Fukawa, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/772,253

(22) Filed: Jan. 29, 2001

(65) Prior Publication Data

US 2002/0009665 A1 Jan. 24, 2002

(30) Foreign Application Priority Data

Feb. 1, 2000 (JP) ..... 2000/023903

(51) Int. Cl.[7] ..... G03C 1/22; G03C 1/16; G03C 5/31; G03C 5/30; G03C 5/395

(52) U.S. Cl. ..... 430/30; 430/265; 430/398; 430/399; 430/440; 430/441; 430/442; 430/435; 430/485; 430/578; 430/592

(58) Field of Search ..... 430/399, 440, 430/485, 435, 265, 398, 441, 442, 579, 578, 592, 30

(56) References Cited

U.S. PATENT DOCUMENTS 3,730,727 A * 5/1973 Olivares et al. ..... 430/483
5,196,298 A * 3/1993 Meeus et al. ..... 430/464
5,264,323 A * 11/1993 Porol et al. ..... 430/264
5,503,965 A * 4/1996 Okutsu ..... 430/440
5,571,660 A * 11/1996 Ito et al. ..... 430/399
5,721,094 A * 2/1998 Komatsu et al. ..... 430/440
5,766,830 A * 6/1998 Shimizu et al. ..... 430/440
5,962,182 A * 10/1999 Katoh et al. ..... 430/440
5,972,580 A * 10/1999 Fukui et al. ..... 430/440

* cited by examiner

*Primary Examiner*—Richard L. Schilling
(74) *Attorney, Agent, or Firm*—Bierman, Muserlian and Lucas

(57) ABSTRACT

A method of processing a silver halide photographic material is disclosed, comprising on a support a light sensitive silver halide emulsion layer, wherein the light-sensitive layer contains a spectral-sensitizing dye represented by formula (1-a); a developer solution contains a developing agent represented by formula (A); and the replenishing rate of a processing solution is determined based on the proportion of an exposed area per unit area of the photographic material to perform replenishment.

formula (1-a)

formula (A)

7 Claims, No Drawings

PROCESSING METHOD OF SILVER HALIDE PHOTOGRAPHIC LIGHT SENSITIVE MATERIAL

FIELD OF THE INVENTION

The present invention relates to a method for processing silver halide photographic light sensitive materials and in particular to a method for processing a silver halide photographic light sensitive material exhibiting higher sensitivity in the red to near infrared region for use in an image setter or facsimile plotter, resulting in little residual color stain when processed in a developer containing an ascorbic acid type developing agent, and exhibiting superior process stability.

BACKGROUND OF THE INVENTION

Photographic materials having photographic characteristics such as ultra-high contrast are broadly employed as a photographic material used in the field of printing plate making. To obtain such high contrast images, there are known an image forming method of processing photographic materials containing hydrazine derivatives with a so-called MQ developer solution (i.e., developer solution by the combined use of hydroquinone and p-amiophenols) or a PQ developer solution (i.e., developer solution by the combined use of hydroquinone and 1-phenyl-3-pyrazolodones) to form an ultra-high contrast image, as described in U.S. Pat. No. 4,269,929 and JP-A Nos. 60-258537 and 5-232616 (hereinafter, the term, JP-A refers to a unexamined, published Japanese Patent Application). In such an image forming method, however, hydroquinone is used as a developing agent, and it is a concern that hydroquinone is not suitable from the ecological or toxicological point of view. It is therefore an aim to achieve a method of forming ultra-high contrast images with a developer solution containing no hydroquinone.

U.S. Pat. Nos. 5,236,816 and 5,264,323 describe a system in which ascorbic acids are employed as a developing agent. However, problems arise with the use of ascorbic acids as a developing agent in that the pH of a developer is easily lowered through processing and aerial oxidation and process variation is quite marked. There is a problem that the use of ascorbic acid developing agents increases residual color-staining caused by sensitizing dyes, and consequently an improvement thereof is desired. Further, the use of ascorbic acid developing agents produces silver precipitates in the fixer bath, which adheres to photographic materials as silver sludge, and reduction of such sludge is also desired.

SUMMARY OF THE INVENTION

In view of the foregoing problems, it is an object of the present invention to provide a method for processing a silver halide photographic light sensitive material for use in graphic arts, achieving a decrease in residual dye staining after processing, leading to enhanced sensitivity and contrast, and also superior halftone dot quality and practical density within the red to infrared wavelength region, and producing little sludge.

The object of the present invention can be accomplished by the following constitution:

1. a method of processing a silver halide photographic light sensitive material comprising the steps of:
   developing the silver halide photographic material with a developer solution,
   fixing the developed silver halide photographic material with a fixer solution, and
   washing the fixed silver halide photographic material with a washing water,
   wherein the silver halide photographic material comprises a support and a light sensitive silver halide emulsion layer containing a spectral-sensitizing dye represented by the following formula (1-a), (1-b), (2), (3-a), (3-b), (4) or (5),
   and wherein the developer solution contains a developing agent represented by formula (A), and at least one of the developer and fixer solutions is replenished at a replenishing rate which has been determined in accordance with the proportion of an exposed area per unit area of the photographic material:

formula (1-a)

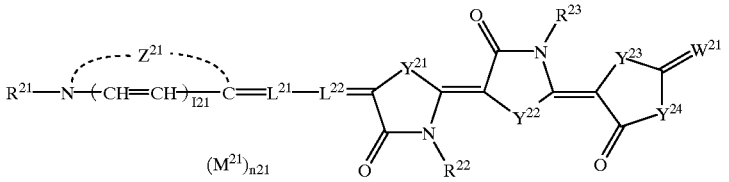

wherein $Y^{21}$, $Y^{22}$, $Y^{23}$ and $Y^{24}$ each represent —N($R^{24}$)—, —O—, —S—, —Se— or —Te—, provided that one of $Y^{23}$ and $Y^{24}$ is —N($R^{24}$)—, and all of $Y^{21}$, $Y^{22}$ and $Y^{23}$ or all of $Y^{21}$, $Y^{22}$ and $Y^{24}$ are not —S—; $R^{21}$ represents an aliphatic group having 8 or less carbon atoms and containing an aqueous solubility promoting group; $R^{22}$, $R^{23}$ and $R^{24}$ each represent a substituted or unsubstituted aliphatic group, a substituted or unsubstituted aryl group or a substituted or unsubstituted heterocyclic group, provided that at least two of $R^{22}$, $R^{23}$ and $R^{24}$ are substituted with an aqueous solubility promoting group; $Z^{21}$ represent a non-metallic atom group necessary to form a 5- or 6-membered nitrogen-containing heterocyclic ring, which may be condensed; $W^{21}$ represents an oxygen atom, sulfur atom, =N(Ar) or =C<($E^{21}$) ($E^{22}$), in which Ar represents an aromatic ring group or a heterocyclic group, $E^{21}$ and $E^{22}$ represent an electron-withdrawing group or combine with each other to form a heterocyclic ring containing an oxo group or an acidic heterocyclic ring; $L^{21}$ and $L^{22}$ represent a substituted or unsubstituted methine group; 121 is 0 or 1; $M^{21}$ represent an ion necessary to counterbalance a total intramolecular charge; and n21 represents a number of ion necessary to counterbalance a total intramolecular charge;

formula (1-b)

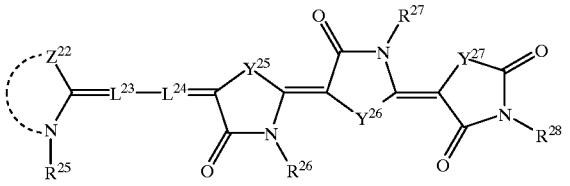

$(M^{22})_{n22}$ wherein $Y^{25}$, $Y^{26}$ and $Y^{27}$ each represent —N($R^{29}$)—, —O—, —S—, or —Se—; $R^{25}$ represents an aliphatic group having 8 or less carbon atoms and containing an aqueous solubility promoting group; $R^{26}$, $R^{27}$, $R^{28}$ and $R^{29}$ represent a substituted or unsubstituted aliphatic group, a substituted or unsubstituted aryl group or a substituted or unsubstituted heterocyclic group, provided that at least three of $R^{26}$, $R^{27}$, $R^{28}$ and $R^{29}$ are substituted with an aqueous solubility promoting group; $Z^{22}$ represent a non-metallic atom group necessary to form a 5- or 6-membered nitrogen-containing heterocyclic ring, which may be condensed; $L^{23}$ and $L^{24}$ represent a substituted or unsubstituted methine group; $M^{22}$ represent an ion necessary to counterbalance a total intramolecular charge; and n22 represents a number of ion necessary to counterbalance a total intramolecular charge;

formula (2)

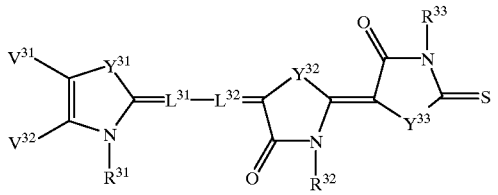

$(M^{31})_{n31}$ wherein $Y^{31}$, $Y^{32}$ and $Y^{33}$ each represent —N($R^{34}$)—, —O—, —S—, or —Se—; $R^{31}$ represents an aliphatic group having 10 or less carbon atoms and substituted with an aqueous solubility promoting group; $R^{32}$, $R^{33}$ and $R^{34}$ represent a substituted or unsubstituted aliphatic group, a substituted or unsubstituted aryl group or a substituted or unsubstituted heterocyclic group, provided that at least two of $R^{32}$, $R^{33}$ and $R^{34}$ are substituted an aqueous solubility promoting group; $V^{31}$ and $V^{32}$ each represent a hydrogen atom, a substituted or unsubstituted alkyl group, a substituted or unsubstituted alkoxy group, or a substituted or unsubstituted aryl group, or $V^{31}$ and $V^{32}$ combine with each other to form a ring condensed with an azole ring; $L^{31}$ and $L^{32}$ represent a substituted or unsubstituted methine group; $M^{31}$ represent an ion necessary to compensate a total intramolecular charge; and n31 represents a number of ion necessary to counterbalance a total intramolecular charge;

formula (3-a)

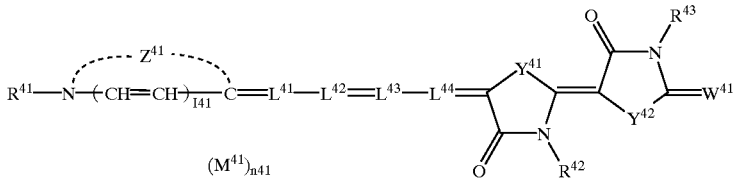

$(M^{41})_{n41}$ wherein $Y^{41}$ and $Y^{42}$ each represent —N($R^{44}$)—, —O—, —S—, —Se— or —Te—; $R^{41}$ represents an aliphatic group having 8 or less carbon atoms and substituted with an aqueous solubility promoting group; $R^{42}$, $R^{43}$ and $R^{44}$ represent a substituted or unsubstituted aliphatic group, a substituted or unsubstituted aryl group or a substituted or unsubstituted heterocyclic group, provided that at least two of $R^{42}$, $R^{43}$ and $R^{44}$ are substituted with an aqueous solubility promoting group; $Z^{41}$ represent a non-metallic atom group necessary to form a 5- or 6-membered nitrogen-containing heterocyclic ring, which may be condensed; $W^{41}$ represents an oxygen atom, sulfur atom, =N(Ar) or =C<($E^{21}$)($E^{22}$), in which Ar represents an aromatic ring group or a heterocyclic group, $E^{41}$ and $E^{42}$ represent an electron-withdrawing group or $E^{41}$ and $E^{42}$ combine with each other to form a heterocyclic; $L^{41}$, $L^{42}$, $L^{43}$ and $L^{44}$ represent a substituted or unsubstituted methine group; 141 is 0 or 1; $M^{41}$ represent an ion necessary to counterbalance a total intramolecular charge; and n41 represents a number of ion necessary to counterbalance a total intramolecular charge;

formula (3-b)

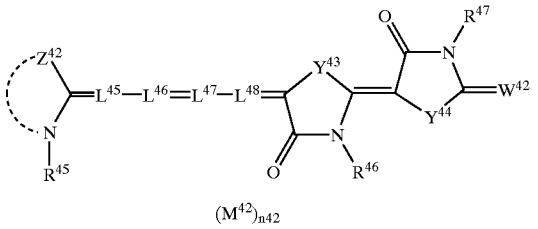

wherein $Z^{42}$ represent a non-metallic atom group necessary to form a 5- or 6-membered nitrogen-containing heterocyclic ring, which may be condensed; $Y^{43}$ and $Y^{44}$ each represent —N ($R^{48}$)—, —O—, —S—, —Se— or —Te—; $R^{45}$ represents an aliphatic group having 8 or less carbon atoms and substituted with an aqueous solubility promoting group; $R^{46}$, $R^{47}$ and $R^{48}$ represent a substituted or unsubstituted aliphatic group, a substituted or unsubstituted aryl group, or a substituted or unsubstituted heterocyclic group, provided that at least two of $R^{46}$, $R^{47}$ and $R^{48}$ are substituted with an aqueous solubility promoting group; $Z^{42}$ represent a non-metallic atom group necessary to form a 5- or 6-membered nitrogen-containing heterocyclic ring, which may be condensed; $W^{42}$ represents an oxygen atom or sulfur atom; $L^{45}$, $L^{46}$, $L^{47}$ and $L^{48}$ represent a substituted or unsubstituted methine group, provided that at least one of $L^{45}$, $L^{46}$, $L^{47}$ and $L^{48}$ is a substituted methine group; $M^{42}$ represent an ion necessary to counterbalance a total intramolecular charge; and n42 represents a number of ion necessary to counterbalance a total intramolecular charge;

formula (4)

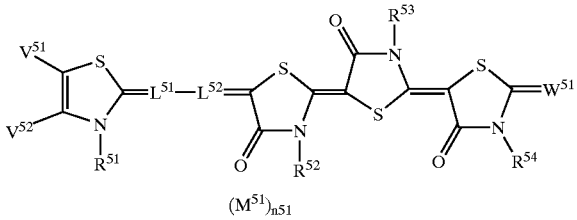

wherein $R^{51}$ represents an aliphatic group having 10 or less carbon atoms and substituted with an aqueous solubility promoting group; $R^{52}$, $R^{53}$ and $R^{54}$ represent a substituted or unsubstituted aliphatic group, a substituted or unsubstituted aryl group or a substituted or unsubstituted heterocyclic group, provided that at least two of $R^{52}$, $R^{53}$ and $R^{54}$ are substituted with an aqueous solubility promoting group; $V^{51}$ and $V^{52}$ represent a hydrogen atom, a substituted or unsubstituted alkyl group, a substituted or unsubstituted alkoxy group, or a substituted or unsubstituted aryl group, or $V^{51}$ and $V^{52}$ combine with each other to form a ring condensed with an azole ring; $W^{51}$ represents an oxygen atom, sulfur atom, =N(Ar) or =C<($E^{21}$)($E^{22}$), in which Ar represents an aromatic ring group or a heterocyclic group, $E^{21}$ and $E^{22}$ represent an electron-withdrawing group or $E^{21}$ and $E^{22}$ combine with each other to form a heterocyclic ring containing an oxo group or an acidic heterocyclic ring; $L^{51}$ and $L^{52}$ represent a substituted or unsubstituted methine group; $M^{51}$ represent an ion necessary to counterbalance a total intramolecular charge; and n51 represents a number of ion necessary to counterbalance a total intramolecular charge;

formula (5)

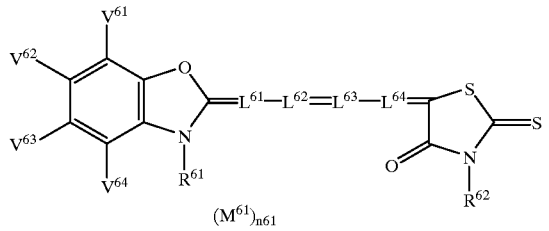

wherein $R^{61}$ and $R^{62}$ represent a substituted or unsubstituted alkyl group, provided that at least one of $R^{61}$ and $R^{62}$ is substituted with an aqueous solubility promoting group; $V^{61}$, $V^{62}$, $V^{63}$ and $V^{64}$ represent a hydrogen atom or a univalent substituent group, provided that any two of $V^{61}$, $V^{62}$, $V^{63}$ and $V^{64}$ do not combine with each other to form a ring and the sum of molecular weights of $V^{61}$, $V^{62}$, $V^{63}$ and $V^{64}$ is 4 to 50; $L^{61}$, $L^{62}$, $L^{63}$ and $L^{64}$ represent a methine group; $M^{61}$ represents an ion necessary to counterbalance a total intramolecular charge; and n61 represents a number of ion necessary to counterbalance a total intramolecular charge; and formula (A)

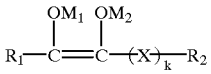

wherein $R_1$ and $R_2$ represent a substituted or unsubstituted alkyl group, a substituted or unsubstituted amino group, a substituted or unsubstituted alkoxy group or a substituted or unsubstituted alkylthio group, or $R_1$ and $R_2$ combine with each other to form a ring; k is 0 or 1; when k is 1, X represents —CO— or —CS—; $M_1$ and $M_2$ represent a hydrogen atom or an alkali metal atom;

2. The processing method of a silver halide photographic material described above, wherein a swelling percentage of the light sensitive silver halide emulsion layer side is 10 to 100%;
3. The processing method of a silver halide photographic material described in 1, wherein the silver halide emulsion layer contains a hydrazine derivative;
4. The processing method of a silver halide photographic material described in 1, wherein the silver halide photographic material comprises a hydrophilic colloidal layer which is adjacent to the silver halide emulsion layer, the hydrophilic colloidal layer containing a hydrazine derivative;
5. The processing method of a silver halide photographic material described in 1, wherein the developer solution is replenished at a replenishing rate which is determined based on an exposed area rate per unit area of the photographic material, the replenishing rate of the developer solution being 30 to 250 ml per $m^2$ of the photographic material;
6. The processing method of a silver halide photographic material described in 1, wherein the developer solution is replenished at a replenishing rate which is determined based on an exposed area rate per unit area of the photographic material, a developer replenishing solution exhibiting a pH higher by 0 to 0.5 than that of the developer solution at the start of development;

7. The processing method of a silver halide photographic material described in 1, wherein the fixer solution is replenished at a replenishing rate which is determined based on an exposed area rate per unit area of the photographic material, the replenishing rate of the fixer solution being 30 to 300 ml per $m^2$ of the photographic material;

8. a method of processing a silver halide photographic light sensitive material comprising on one side of a support a light sensitive silver halide emulsion layer and on the other side a backing layer, wherein the light-sensitive layer contains a spectral-sensitizing dye represented by the following formula (1-a) or (1-b); a developer solution contains a developing agent represented by formula (A); and the replenishing rate of a processing solution is determined based on the proportion of an exposed area per unit area of the photographic material to perform replenishment:

formula (1-a)

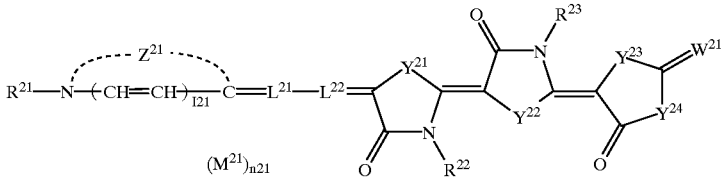

wherein $Y^{21}$, $Y^{22}$, $Y^{23}$ and $Y^{24}$ each represent —N($R^{24}$)—, —O—, —S—, —Se— or —Te—, provided that one of $Y^{23}$ and $Y^{24}$ is —N($R^{24}$)—, and $Y^{21}$, $Y^{22}$ and $Y^{23}$, or $Y^{21}$, $Y^{22}$ and $Y^{24}$ are not —S— at the same time; $R^{21}$ represents an aliphatic group having 8 or less carbon atoms and containing an aqueous solubility promoting group; $R^{22}$, $R^{23}$ and $R^{24}$ represent an aliphatic group, an aryl group or a heterocyclic group, provided that at least two of $R^{22}$, $R^{23}$ and $R^{24}$ contain an aqueous solubility promoting group; $Z^{21}$ represent a non-metallic atom group necessary to form a 5- or 6-membered nitrogen-containing heterocyclic ring, which may be condensed; $W^{21}$ represents an oxygen atom, sulfur atom, =N(Ar) or =C<($E^{21}$)($E^{22}$), in which Ar represents an aromatic ring group or a heterocyclic group, $E^{21}$ and $E^{22}$ represent an electron-withdrawing group or combine with each other to form a heterocyclic ring containing an oxo group or an acidic heterocyclic ring ; $L^{21}$ and $L^{22}$ represent a substituted or unsubstituted methine group; 121 is 0 or 1; $M^{21}$ represent an ion necessary to counterbalance a total intramolecular charge; and n21 represents a number of ion necessary to counterbalance a total intramolecular charge;

formula (1-b)

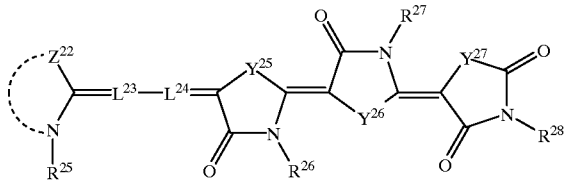

wherein $Y^{25}$, $Y^{26}$ and $Y^{27}$ each represent —N($R^{29}$)—, —O—, —S—, or —Se—; $R^{25}$ represents an aliphatic group having 8 or less carbon atoms and containing an aqueous solubility promoting group; $R^{26}$, $R^{27}$, $R^{28}$ and $R^{29}$ represent an aliphatic group, an aryl group or a heterocyclic group, provided that at least three of $R^{26}$, $R^{27}$, $R^{28}$ and $R^{29}$ contain an aqueous solubility promoting group; $Z^{22}$ represent a non-metallic atom group necessary to form a 5- or 6-membered nitrogen-containing heterocyclic ring, which may be condensed; $L^{23}$ and $L^{24}$ represent a substituted or unsubstituted methine group; $M^{22}$ represent an ion necessary to counterbalance a total intramolecular charge; and n22 represents a number of ion necessary to counterbalance a total intramolecular charge;

formula (A)

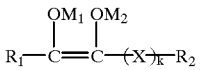

wherein $R_1$ and $R_2$ represent a substituted or unsubstituted alkyl group, a substituted or unsubstituted amino group, a substituted or unsubstituted alkoxy group or a substituted or unsubstituted alkylthio group, or $R_1$ and $R_2$ may combine with each other to form a ring; k is 0 or 1; when k is 1, X represent —CO— or —CS—; $M_1$ and $M_2$ represent a hydrogen atom or an alkali metal atom;

9. a method of processing a silver halide photographic light sensitive material comprising on one side of a support a light sensitive silver halide emulsion layer and on the other side a backing layer, the light-sensitive layer contains a spectral-sensitizing dye represented by the following formula (2); a developer solution contains a developing agent represented by formula (A) described above; and the replenishing rate of a processing solution is determined based on the proportion of an exposed area per unit area of the photographic material to perform replenishment:

formula (2)

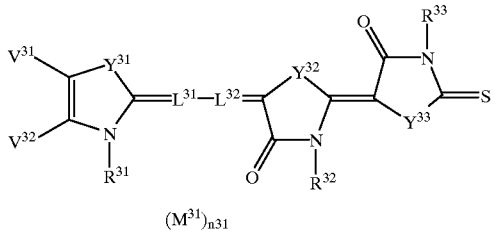

$(M^{31})_{n31}$ wherein $Y^{31}$, $Y^{32}$ and $Y^{33}$ each represent —N($R^{34}$)—, —O—, —S—, or —Se—; $R^{31}$ represents an aliphatic group having 10 or less carbon atoms and containing an aqueous solubility promoting group; $R^{32}$, $R^{33}$ and $R^{34}$ represent an aliphatic group, an aryl group or a heterocyclic group, provided that at least two of $R^{32}$, $R^{33}$ and $R^{34}$ contain an aqueous solubility promoting group; $V^{31}$ and $V^{32}$ each represent a hydrogen atom, an alkyl group, an alkoxy group, or an aryl group, or $V^{31}$ and $V^{32}$ combine with each other to form a ring condensed with an azole ring; $L^{31}$ and $L^{32}$ represent a substituted or unsubstituted methine group; $M^{31}$ represent an ion necessary to compensate a total intramolecular charge; and n31 represents a number of ion necessary to counterbalance a total intramolecular charge;

10. a method of processing a silver halide photographic light sensitive material comprising on one side of a support a light sensitive silver halide emulsion layer and on the other side a backing layer, the light-sensitive layer contains a spectral-sensitizing dye represented by the following formula (3-a) or (3-b); a developer solution contains a developing agent represented by formula (A) described above; and the replenishing rate of a processing solution is determined based on the proportion of an exposed area per unit area of the photographic material to perform replenishment:

formula (3-a)

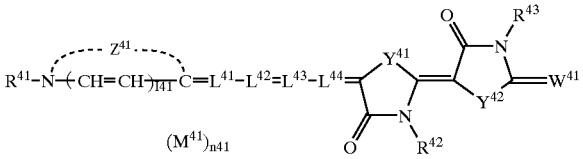

$(M^{41})_{n41}$ wherein $Z^{41}$ represent a non-metallic atom group necessary to form a 5- or 6-membered nitrogen-containing heterocyclic ring, which may be condensed; $Y^{41}$ and $Y^{42}$ each represent —N($R^{44}$)—, —O—, —S—, —Se— or —Te—; $R^{41}$ represents an aliphatic group having 8 or less carbon atoms and containing an aqueous solubility promoting group; $R^{42}$, $R^{43}$ and $R^{44}$ represent an aliphatic group, an aryl group or a heterocyclic group, provided that at least two of $R^{42}$, $R^{43}$ and $R^{44}$ contain an aqueous solubility promoting group; $W^{41}$ represents an oxygen atom, sulfur atom, =N(Ar) or =C<($E^{21}$) ($E^{22}$), in which Ar represents an aromatic ring group or a heterocyclic group, $E^{41}$ and $E^{42}$ represent an electron-withdrawing group or $E^{41}$ and $E^{42}$ each represent non-metallic atom group and combine with each other to form a heterocyclic; $L^{41}$, $L^{42}$, $L^{43}$ and $L^{44}$ represent a substituted or unsubstituted methine group; 141 is 0 or 1; $M^{41}$ represent an ion necessary to counterbalance a total intramolecular charge; and n41 represents a number of ion necessary to counterbalance a total intramolecular charge;

formula (3-b)

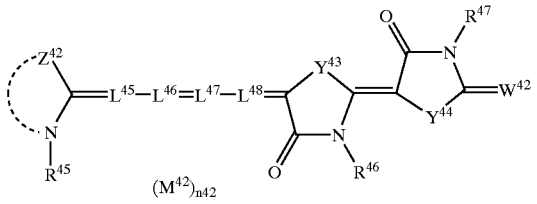

$(M^{42})_{n42}$ wherein $Z^{42}$ represent a non-metallic atom group necessary to form a 5- or 6-membered nitrogen-containing heterocyclic ring; $Y^{43}$ and $Y^{44}$ each represent —N($R^{48}$)—, —O—, —S—, —Se— or —Te—; $R^{45}$ represents an aliphatic group having 8 or less carbon atoms and containing an aqueous solubility promoting group; $R^{46}$, $R^{47}$ and $R^{48}$ represent an aliphatic group, an aryl group or a heterocyclic group, provided that at least two of $R^{46}$, $R^{47}$ and $R^{48}$ contain an aqueous solubility promoting group; $W^{42}$ represents an oxygen atom or sulfur atom; $L^{45}$, $L^{46}$, $L^{47}$ and $L^{48}$ represent a substituted or unsubstituted methine group, provided that at least one of $L^{45}$, $L^{46}$, $L^{47}$ and $L^{48}$ is a substituted methine group; $M^{42}$ represent an ion necessary to counterbalance a total intramolecular charge; and n42 represents a number of ion necessary to counterbalance a total intramolecular charge;

11. a method of processing a silver halide photographic light sensitive material comprising on one side of a support a light sensitive silver halide emulsion layer and on the other side a backing layer, the light-sensitive layer contains a spectral-sensitizing dye represented by the following formula (4); a developer solution contains a developing agent represented by formula (A) described above; and the replenishing rate of a processing solution is determined based on the proportion of an exposed area per unit area of the photographic material to perform replenishment:

formula (4)

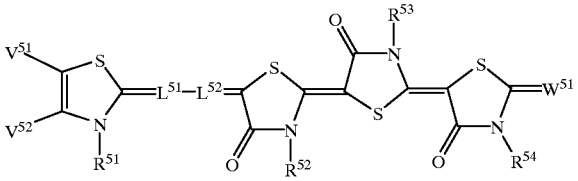

$(M^{51})_{n51}$ wherein $R^{51}$ represents an aliphatic group having 10 or less carbon atoms and containing an aqueous solubility promoting group; $R^{52}$, $R^{53}$ and $R^{54}$ represent an aliphatic group, an aryl group or a heterocyclic group, provided that at least two of $R^{52}$, $R^{53}$ and $R^{54}$ contain an aqueous solubility promoting group; $V^{51}$ and $V^{52}$ represent a hydrogen atom, an alkyl group, an alkoxy group, or an aryl group, or $V^{51}$ and $V^{52}$ combine with each other to form a ring condensed with an azole ring; $W^{51}$ represents an oxygen atom, sulfur atom, =N(Ar) or $=C<(E^{21})(E^{22})$, in which Ar represents an aromatic ring group or a heterocyclic group, $E^{21}$ and $E^{22}$ represent an electron-withdrawing group or combine with each other to form a heterocyclic ring containing an oxo group or an acidic heterocyclic ring; $L^{51}$ and $L^{52}$ represent a substituted or unsubstituted methine group; $M^{51}$ represent an ion necessary to counterbalance a total intramolecular charge; and n51 represents a number of ion necessary to counterbalance a total intramolecular charge;

12. a method of processing a silver halide photographic light sensitive material comprising on one side of a support a light sensitive silver halide emulsion layer and on the other side a backing layer, the light-sensitive layer contains a spectral-sensitizing dye represented by the following formula (5); a developer solution contains a developing agent represented by formula (A) described above; and the replenishing rate of a processing solution is determined based on the proportion of an exposed area per unit area of the photographic material to perform replenishment:

formula (5)

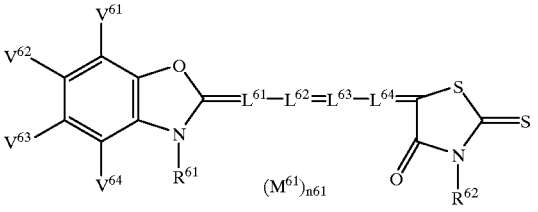

wherein $R^{61}$ and $R^{62}$ represent an alkyl group containing an aqueous solubility promoting group, which may be in a free form or a salt form; $V^{61}$, $V^{62}$, $V^{63}$ and $V^{64}$ represent a hydrogen atom or a univalent substituent group, provided that these substituent groups do not form a ring and the sum of molecular weights of $V^{61}$, $V^{62}$, $V^{63}$ and $V^{64}$ is 4 to 50; $L^{61}$, $L^{62}$, $L^{63}$ and $L^{64}$ represent a methine group; $M^{61}$ represents an ion necessary to counterbalance a total intramolecular charge; and n61 represents a number of ion necessary to counterbalance a total intramolecular charge;

13. The processing method of a silver halide photographic material described in any one of 8 through 12, wherein the swelling percentage of the light sensitive silver halide emulsion layer side is 10 to 100%;

14. The processing method of a silver halide photographic material described in any one of 8 through 13, wherein the silver halide emulsion layer or a hydrophilic colloid layer adjacent thereto contains a hydrazine derivative;

15. The processing method of a silver halide photographic material described in any one of 8 through 14, wherein the processing solution which is replenished at a rate proportional to the exposed area is a developer solution and the developer replenishing rate is 30 to 250 ml per $m^2$ of the photographic material;

16. The processing method of a silver halide photographic material described in any one of 8 through 15, wherein a developer replenishing solution exhibits a pH higher by 0 to 0.5 than that of a developer solution at the start of development;

17. The processing method of a silver halide photographic material described in any one of 8 through 16, wherein the processing solution which is replenished at a rate porportional to the exposed area is a fixer solution and the fixer replenishing rate is 30 to 300 ml per $m^2$ of the photographic material.

DETAILED DESCRIPTION OF PREFERRED EMBODIMENTS OF THE INVENTION

The spectral sensitizing dyes represented by formula (1-a) or (1-b) will be described.

In formula (1-a) or (1-b), $Y^{21}$, $Y^{22}$, $Y^{23}$, $Y^{24}$, $Y^{25}$, $Y^{26}$ and $Y^{27}$ each represent —$NR^{24}$ or —$NR^{29}$, —O—, —S—, or —Se—. The aqueous solubility promoting group contained in $R^{21}$, $R^{22}$, $R^{23}$, $R^{24}$, $R^{25}$, $R^{26}$, $R^{27}$, $R^{28}$ or $R^{29}$ include, for example, a sulfo group, a carboxy group, a phosphono group, a sulfate group and a sulfino group. The aliphatic group represented by $R^{21}$, $R^{22}$, $R^{23}$, $R^{24}$, $R^{25}$, $R^{26}$, $R^{27}$, $R^{28}$ or $R^{29}$ include, for example, a straight or branched alkyl group having 1 to 8 carbon atoms (such as methyl, ethyl, n-propyl, n-pentyl, isobutyl), an alkenyl group having 3 to 8 carbon atoms (such as 3-butenyl, 2-propenyl), and an aralkyl group having 7 to 10 carbon atoms (such as benzyl, phenethyl). The aryl group represented by $R^{21}$, $R^{22}$, $R^{23}$, $R^{24}$, $R^{25}$, $R^{26}$, $R^{27}$, $R^{28}$ or $R^{29}$ include, for example, a phenyl group and the heterocyclic group include, for example, pyridyl group (e.g., 2- or 4-pyridyl), pyrazyl group, furyl group (e.g., 2-furyl), thienyl group (e.g., 2-thienyl), sulforanyl group, tetrahydrofuryl group, piperidyl group, pyrrolyl group, and imidazolyl group. $R^{21}$, $R^{22}$, $R^{23}$, $R^{24}$, $R^{25}$, $R^{26}$, $R^{27}$, $R^{28}$ or $R^{29}$ each may be substituted and examples of the substituent group include a halogen atom (e.g., fluorine atom, chlorine atom, bromine atom, iodine atom), an alkoxy group (e.g., methoxy, ethoxy), an aryloxy group (e.g., phenoxy, p-tolyoxy), cyano group, a carbamoyl group (e.g., carbamoyl, N-methylcarbamoyl, N,N-tetramethylenecarbamoyl), a sulfamoyl group (e.g., sulfamoyl, N,N-3-oxapentamethyleneaminosulfonyl), a methanesulfonyl group, an alkoxycarbonyl group (e.g., ethoxycarbonyl, butoxycarbonyl), an aryl group (e.g., phenyl, carboxyphenyl), and an acyl group (e.g., acetyl, benzoyl). Exemplary examples of the aliphatic group containing an aqueous solubility promoting group include carboxymethyl, sulfoethyl, sulfopropyl, sulfobutyl, sulfopentyl, 3-sulfobutyl, 6-sulfo-3-oxahexyl, ω-sulfopropoxycarbonylmethyl, ω-sulfopropylaminocarbonyl-methyl, N-ethyl-N-sulfopropyl, 3-sulfinobutyl, 3-phosphonopropyl, 4-sulfo-3-butenyl, 2-carboxy-2propenyl, o-sulfobenzyl, p-sulfophenethyl, and p-carboxybenzyl. Examples of the aryl group containing an aqueous solubility promoting group include p-sulfophenyl and p-carboxyphenyl; and examples of the heterocyclic group containing an aqueous solubility promoting group include 4-sulfothienyl and 3-carboxypyridyl. Of these, it is preferred that $R^{21}$ and $R^{25}$ are a sulfo group containing alkyl group, and at least two of $R^{22}$, $R^{23}$, $R^{24}$, $R^{25}$, $R^{26}$, $R^{27}$, $R^{28}$ or $R^{29}$ are carboxymethyl.

$Z^{21}$ and $Z^{22}$ each represent a 5- or 6-membered nitrogen-containing heterocyclic group. The nitrogen-containing heterocyclic rings include basic nitrogen-containing heterocyclic rings forming a cyanine dye, such as an oxazole ring (e.g., oxazole, benzoxazole, naphthoxazole), a thiazole ring (e.g., thiazolidine, thiazole, benzthiazole, naphthothiazole), an imidazole ring (e.g., imidazole, benzimidazole, naphthoimidazole), a selenazole ring (e.g., selenazole, benzoselenazole, naphthoselenazole), a tetrazole ring (e.g., tetrazole, benztetrazole, naphthotetrazole), a pyrydine ring (e.g., pyridine quinoline), and pyrrole ring (e.g., pyrrole, indole, indolenine). The nitrogen-containing heterocyclic group represented by $Z^{21}$ or $Z^{22}$ may be substituted at any position on the heterocyclic ring.

Examples of the substituent group include a halogen atom (e.g., fluorine atom, chlorine atom, bromine atom, iodine atom9, trifluoromethyl, an alkoxy group (e.g., unsubstituted alkoxy such as methoxy, ethoxy and butoxy, and substituted alkoxy such as 2-methoxyethoxy and benzoyloxy), hydroxy, cyano, an aryloxy group (e.g., phenoxy, tolyloxy), an aryl group (e.g., phenyl, p-chlorophenyl, p-tolyl, p-methoxyphenyl), styryl group, a heterocyclic group (e.g., furyl, thienyl9, a carbamoyl group (e.g., carbamoyl, N-ethylcarbamoyl), a sulfamoyl group (e.g., sulfamoyl, N,N-dimethylsulfamoyl), an acylamino group (e.g., acetylamino, propionylamino, benzoylamino), an acyl group (e.g., acetyl, benzoyl), an alkoxycarbonyl group (e.g., ethoxycarbonyl), a sulfonamido group (e.g., methanesulfonamido, p-toluenesulfonamido), carboxy group, and an alkyl group (e.g., methyl, ethyl, isopropyl).

$L^{21}$, $L^{22}$, $L^{23}$ and $L^{24}$ represent an unsubstituted or substituted methine group. The substituent group thereof include, for example, an alky group (e.g., methyl, ethyl), a pahenyl group (e.g., phenyl, carboxyphenyl), an alkoxy group (e.g., methoxy, ethoxy), an aryloxy group (e.g., phenoxy, carboxyphenoxy), an aralkyl group (e.g., benzyl) and a fluorine atom. The sensitizing dye of the invention, in which either $L^{21}$ or $L^{22}$ is a substituted methine group achieves higher spectral sensitivity and exhibits characteristics such that a dye is easily bleached in a processing solution, advantageously leading to reduced dye staining.

The electron-withdrawing group represented by $E^{21}$ and $E^{22}$ is selected from the groups exhibiting a Hammett $\sigma_p$ value of 0.3 or more, and examples thereof include cyano group, a carbamoyl group (e.g., carbamoyl, morpholinocarbamoyl, N-methylcarbamoyl), an alkoxycarbonyl group (e.g., methoxycarbonyl, ethoxycarbonyl), a sulfamoyl group (e.g., sulfamoyl, morpholinosulfonyl, N,N-dimethylsulfamoyl), an acyl group (e.g., acetyl, benzoyl), and a sulfonyl group (e.g., methanesulfonyl, ethanesulfonyl, benzenesulfonyl, toluenesulfonyl). The Hammett $\sigma_p$ value is a substituent constant which is determined from electromeric effect of a substituent affecting hydrolysis of a benzoic acid ester, as detailed in J. Org. Chem. 23, 420–427 (1958); "Zikken-Kagaku Koza" vol. 14 (published by Maruzen); Physical Organic Chemistry (McGraw Hill Book Co., 1940); Drag Design vol. VII (Academic Press, New York, 1976) and "Yakubutsu -no Kozokassei" (Nankodo, 1979). Examples an oxo-group containing heterocyclic ring and an acidic heterocyclic group include the following:

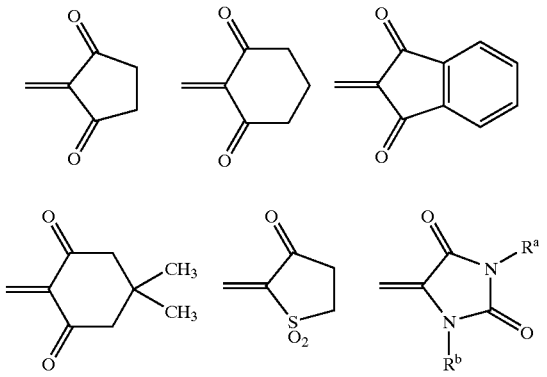

-continued

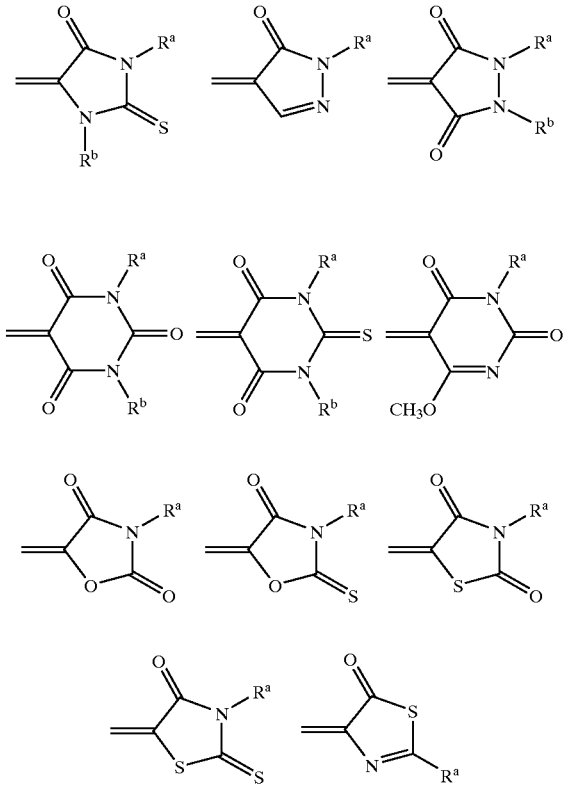

wherein $R^a$ and $R^b$ each represent a lower alkyl group, an aryl group or a heterocyclic group. The lower alkyl group include substituted and unsubstituted ones, for example, methyl, ethyl, propyl, 2-hydroxyethyl, 2-methoxyethyl, trifluoromethyl, carboxymethyl, carboxymethyl, 2-sulfoethyl and benzyl. The aryl group and heterocyclic group represented by $R^a$ and $R^b$ include the same as defined in $R^{21}$, $R^{22}$, $R^{23}$, $R^{24}$, $R^{25}$, $R^{26}$, $R^{27}$, $R^{28}$ or $R^{29}$.

$M^{21}$ and $M^{22}$ represent a cation or an acid anion. Examples of the cation include proton, organic ammonium ion (e.g., triethylammonium, triethanolammonium), inorganic cations (e.g., lithium, sodium or calcium ion). Examples of the acid anion include a halide ion (e.g., chloride ion, bromide ion, iodide ion), p-toluenesulfonate ion, perchlorate ion, and 4-fluoroborate ion. n21 and n22 represent the number of ion(s) forming an intramolecular salt and counterbalancing the total intramolecular charge.

Examples of the spectral sensitizing dyes represented by formula (1-a) or (1-b) are shown below but are by no means limited to these compounds.

1-1
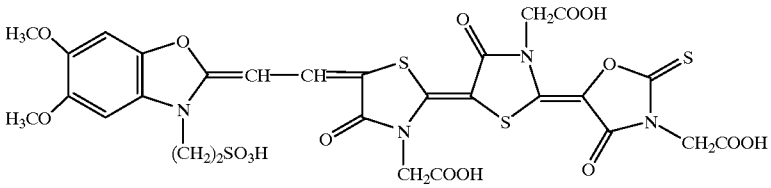
1-2
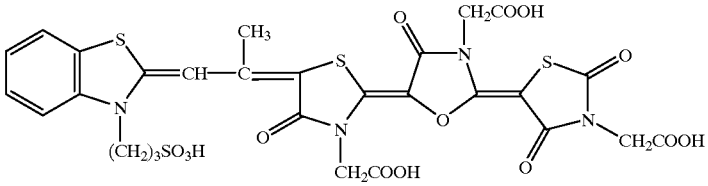
$N(C_2H_5)_3$
1-3
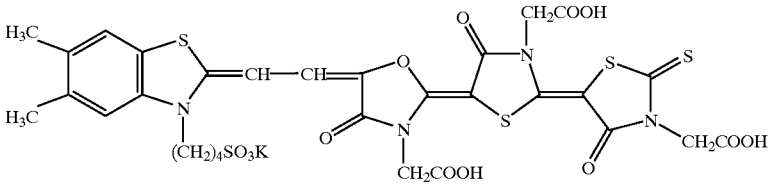
1-4
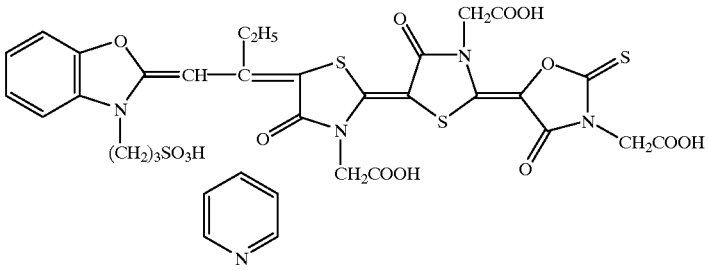
1-5
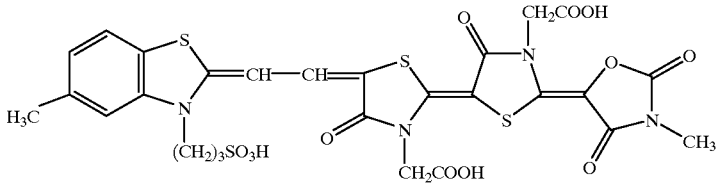
$N(C_2H_5)_3$
1-6
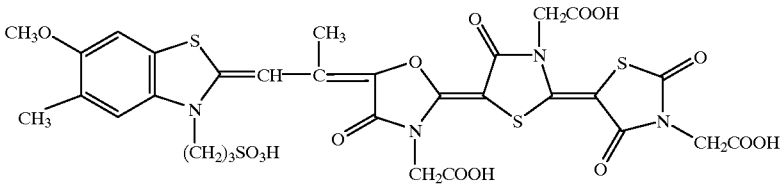
$N(C_2H_5)_3$ -continued
1-7
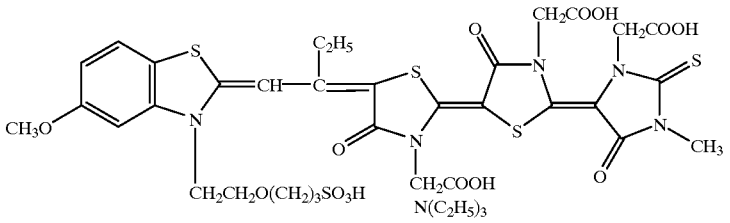
1-8
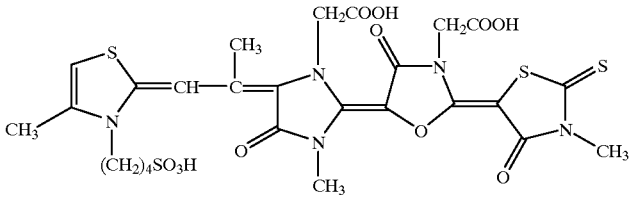
1-9
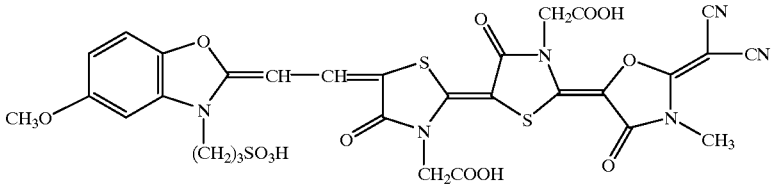
1-10
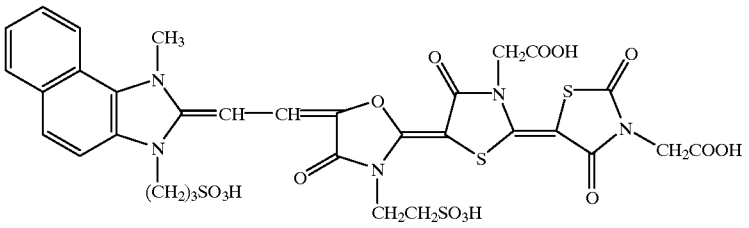
1-11
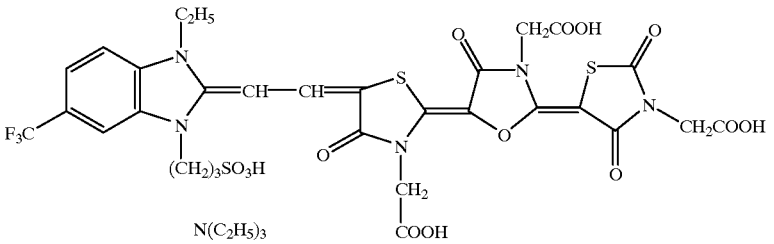
1-12
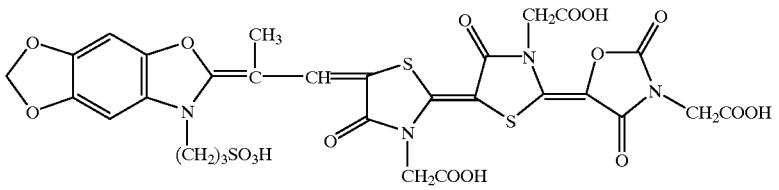

-continued
1-13
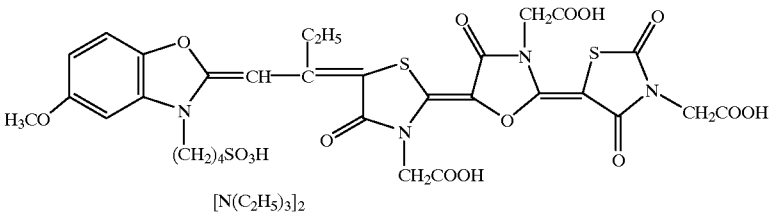
1-14
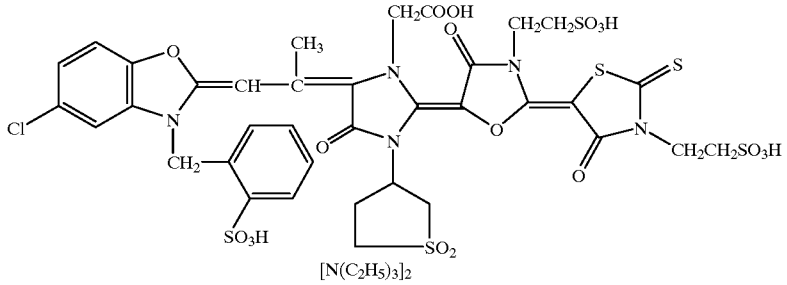
1-15
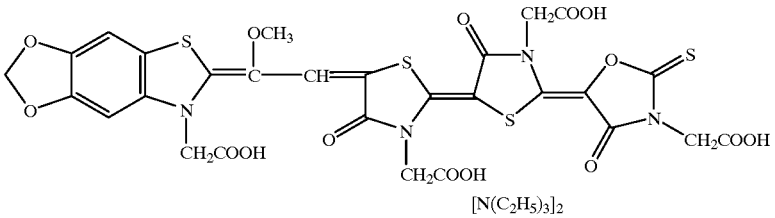
1-16
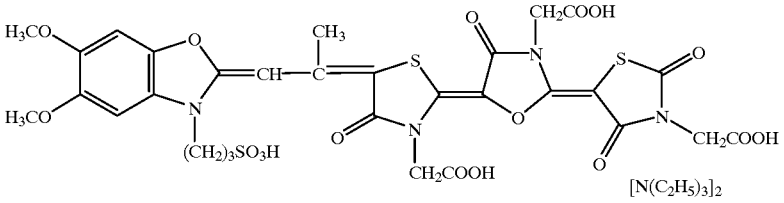
1-17
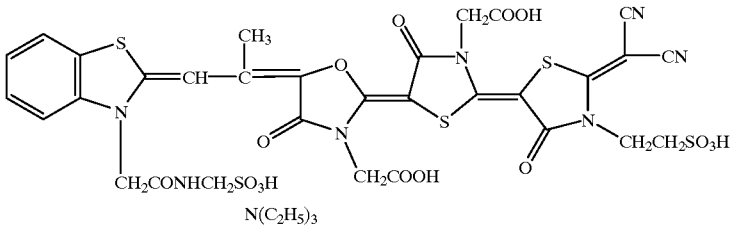
1-18
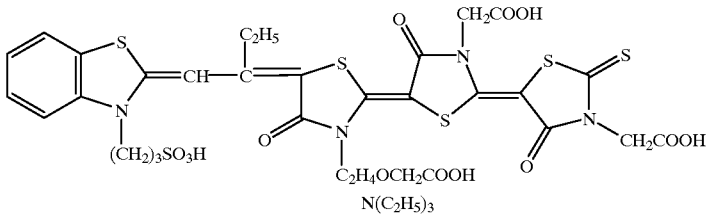

-continued
1-19
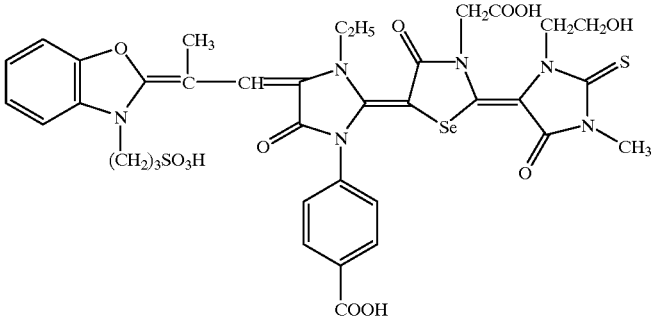
1-20
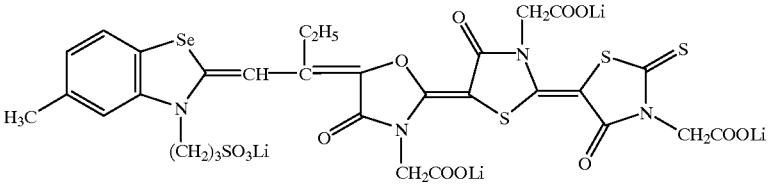
1-21
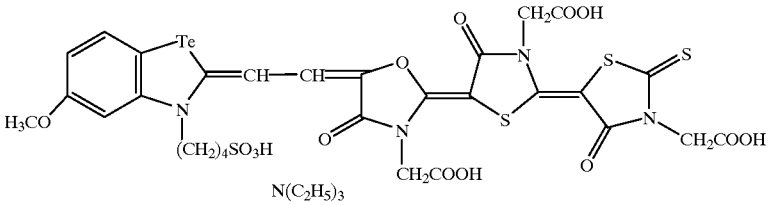
1-22
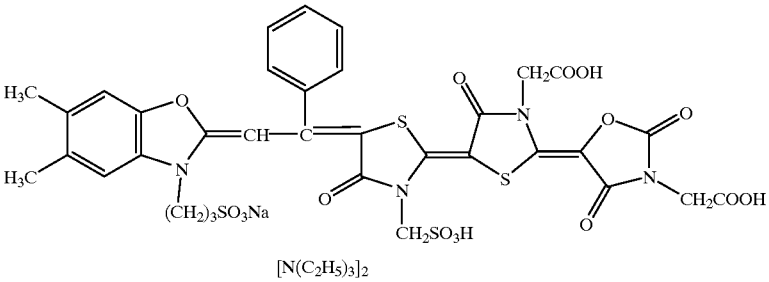
1-23
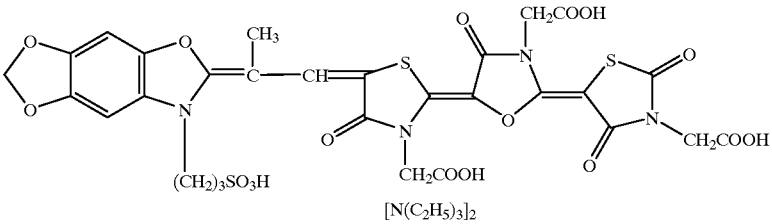
1-24
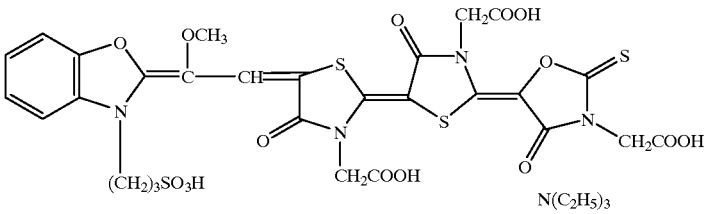

-continued 1-25

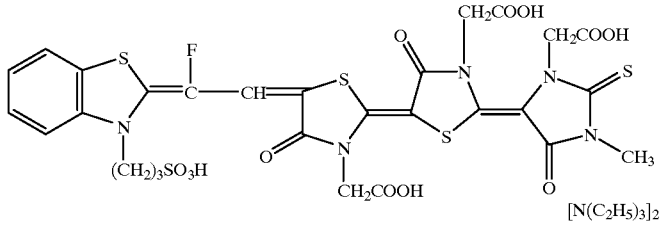

1-26

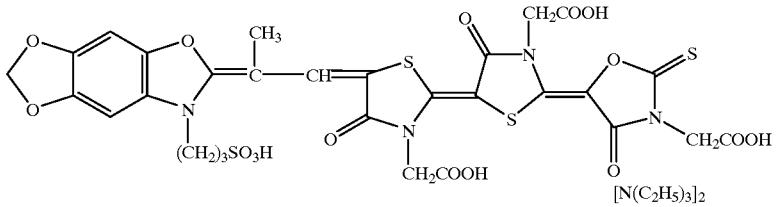

1-27

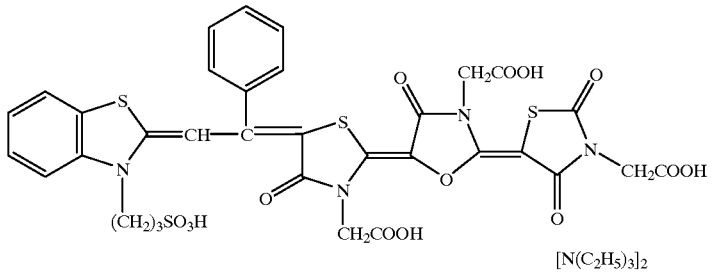

1-28

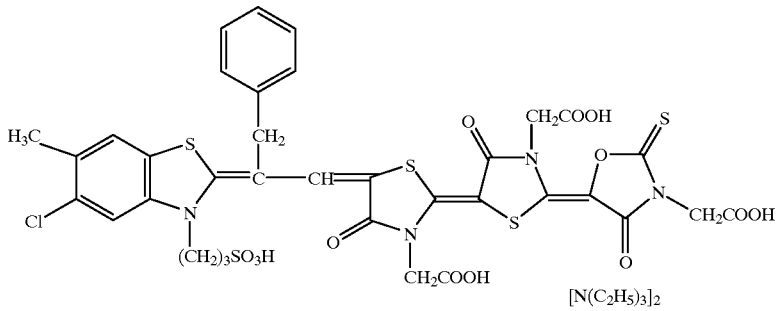

The foregoing compounds can be readily synthesized according the commonly known methods, as described in F. M. Hamer "Cyanine Dyes and Related Compounds" (Interscience Publishers, 1964), U.S. Pat. Nos. 2,454,629 and 2,493,748; British Patent No. 489,335 and European Patent No. 730,008.

The sensitizing dyes represented by formula (2) will be described. In formula (2), $Y^{31}$, $Y^{32}$ and $Y^{33}$ represent —N($R^{34}$)—, —O—. —S— or —Se—. The aqueous solubility promoting group contained in $R^{31}$, $R^{32}$ and $R^{33}$ include, for example, a sulfo group, carboxy group, phosphono group, sulfate group and sulfino group. The aliphatic group represented by $R^{31}$, $R^{32}$ and $R^{33}$ include, for example, a straight or branched alkyl group having 1 to 10 carbon atoms (such as methyl, ethyl, n-propyl, n-pentyl, isobutyl), an alkenyl group having 3 to 10 carbon atoms (such as 3-butenyl, 2-propenyl), and an aralkyl group having 7 to 10 carbon atoms (such as benzyl, phenethyl). The aryl group represented by $R^{31}$, $R^{32}$ and $R^{33}$ include, for example, a phenyl group and the heterocyclic group include, for example, pyridyl group (e.g., 2- or 4-pyridyl), pyrazyl group, furyl group (e.g., 2-furyl), thienyl group (e.g., 2-thienyl), sulforanyl group, tetrahydrofuryl group, piperidyl group, pyrrolyl group, and imidazolyl group.

$R^{31}$, $R^{32}$ and $R^{3}$ each may be substituted and examples of the substituent group include a halogen atom (e.g., fluorine atom, chlorine atom, bromine atom, iodine atom), an alkoxy group (e.g., methoxy, ethoxy), an aryloxy group (e.g., phenoxy, p-tolyoxy), cyano group, a carbamoyl group (e.g., carbamoyl, N-methylcarbamoyl, N,N-tetramethylenecarbamoyl), a sulfamoyl group (e.g., sulfamoyl, N,N-3-oxapentamethyleneaminosulfonyl), a methanesulfonyl group, an alkoxycarbonyl group (e.g., ethoxycarbonyl, butoxycarbonyl), an aryl group (e.g., phenyl, carboxyphenyl), and an acyl group (e.g., acetyl, benzoyl). Exemplary examples of the aliphatic group containing an aqueous solubility promoting group include carboxymethyl, sulfoethyl, sulfopropyl, sulfobutyl, sulfopentyl, 3-sulfobutyl, 6-sulfo-3-oxahexyl, ω-sulfopropoxycarbonylmethyl, ω-sulfopropylaminocarbonyl-methyl, N-ethyl-N-sulfopropyl, 3-sulfinobutyl, 3-phosphonopropyl, 4-sulfo-3-butenyl, 2-carboxy-2propenyl, o-sulfobenzyl, p-sulfophenethyl, and p-carboxybenzyl. Examples of the aryl group containing an aqueous solubility promoting group include p-sulfophenyl and p-carboxyphenyl; and examples of the heterocyclic group containing an aqueous solubility promoting group include 4-sulfothienyl and 3-carboxypyridyl.

The alkyl group represented by $V^{31}$ and $V^{32}$ include straight or branched alkyl groups, such as methyl, ethyl, isopropyl, t-butyl, iso-butyl, t-pentyl and hexyl. The alkoxy group represented by $V^{31}$ and $V^{32}$ include, for example, methoxy, ethoxy, and propoxy. The aryl group represented by $V^{31}$ and $V^{32}$, which may be substituted at any position include, for example, phenyl, p-tolyl, p-hydroxyphenyl, and p-methoxyphenyl. The condensed azole ring formed by the combination of $V^{31}$ and $V^{32}$ include, for example, 4,5,6,7-tetrahydrobenzoxazole, naphtha[1,2-d]oxazole, naphtha[2,3-d]oxazole, benzothiazole, 4,5,6,7-tetrahydrobenzothiazole, naphtha[1,2-d]thiazole, naphtha[2,3-d]thiazole, benzoselenazole and naphtha[1,2-d]selenazole. The group represented by $V^{31}$ and $V^{32}$ or the condensed ring formed by $V^{31}$ and $V^{32}$ may be substituted by a substituent group at any position thereof.

Examples of the substituent group include a halogen atom (e.g., fluorine atom, chlorine atom, bromine atom, iodine atom9, trifluoromethyl, an alkoxy group (e.g., unsubstituted alkoxy such as methoxy, ethoxy and butoxy, and substituted alkoxy such as 2-methoxyethoxy and benzoyloxy), hydroxy, cyano, an aryloxy group (e.g., phenoxy, tolyloxy), an aryl group (e.g., phenyl, p-chlorophenyl, p-tolyl, p-methoxyphenyl), styryl group, a heterocyclic group (e.g., furyl, thienyl9, a carbamoyl group (e.g., carbamoyl, N-ethylcarbamoyl), a sulfamoyl group (e.g., sulfamoyl, N,N-dimethylsulfamoyl), an acylamino group (e.g., acetylamino, propionylamino, benzoylamino), an acyl group (e.g., acetyl, benzoyl), an alkoxycarbonyl group (e.g., ethoxycarbonyl), a sulfonamido group (e.g., methanesulfonamido, p-toluenesulfonamido), carboxy group, and an alkyl group (e.g., methyl, ethyl, isopropyl).

$L^{31}$ and $L^{32}$ represent an unsubstituted or substituted methine group. The substituent group thereof include, for example, an alky group (e.g., methyl, ethyl), a pahenyl group (e.g., phenyl, carboxyphenyl), an alkoxy group (e.g., methoxy, ethoxy), an aryloxy group (e.g., phenoxy, carboxyphenoxy), and an aralkyl group (e.g., benzyl).

$M^{31}$ represent a cation or an acid anion. Examples of the cation include proton, organic ammonium ion (e.g., triethylammonium, triethanolammonium), inorganic cations (e.g., lithium, sodium or calcium ion). Examples of the acid anion include a halide ion (e.g., chloride ion, bromide ion, iodide ion), p-toluenesulfonate ion, perchlorate ion, and 4-fluoroborate ion. n31represents the number of ion(s) forming an intramolecular salt and counterbalancing the total intramolecular charge.

In formula (2), $R^{31}$ is preferably a sulfo-substituted alkyl group and at least two of $R^{32}$, $R^{33}$ and $R^{34}$ is preferably substituted by a carboxymethyl group.

Examples of the spectral sensitizing dyes represented by formula (2) are shown below but are by no means limited to these compounds.

2-1

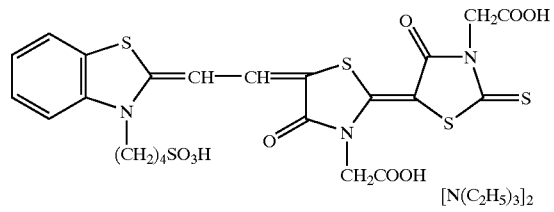

2-2

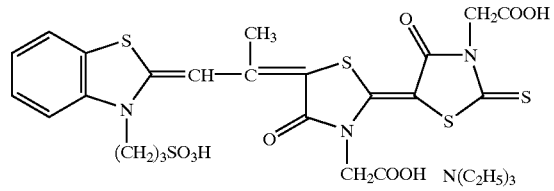

2-3

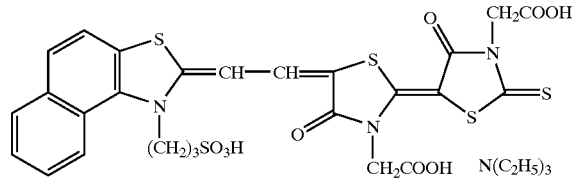

2-4

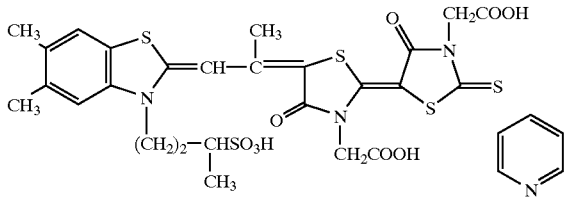

2-5

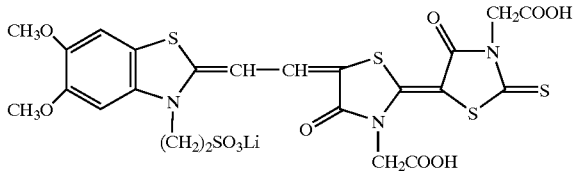

2-6

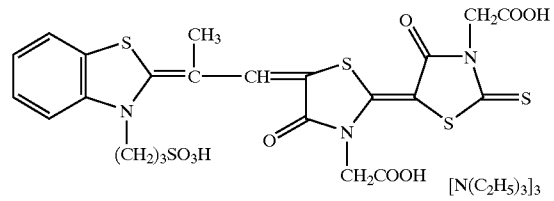

2-7

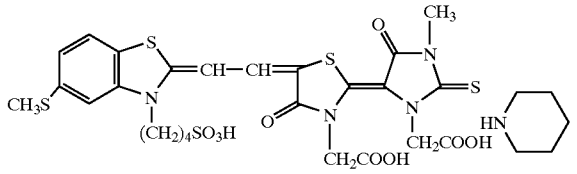

-continued
2-8
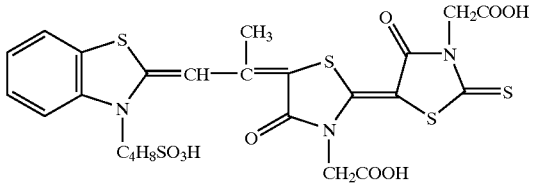
2-9
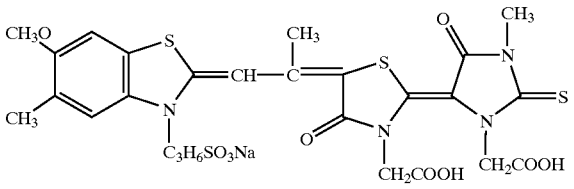
2-10
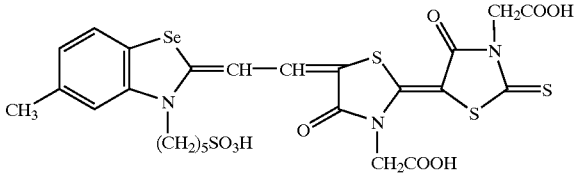
2-11
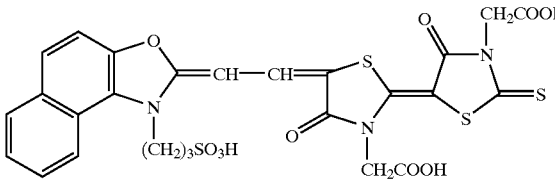
$N(C_2H_5)_3$
2-12
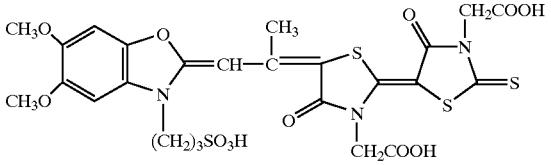
$N(C_2H_5)_3$
2-13
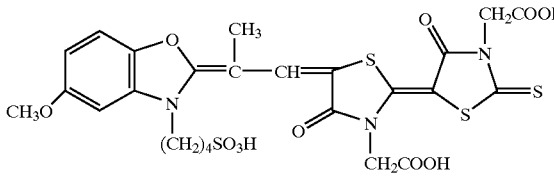
2-14
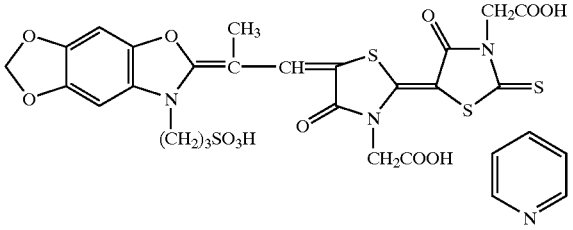
-continued
2-15
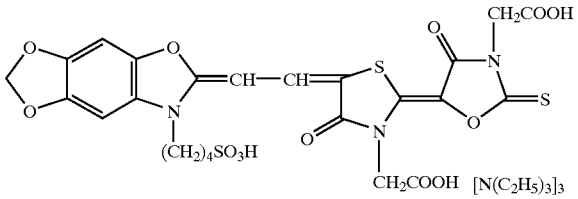
$[N(C_2H_5)_3]_3$
2-16
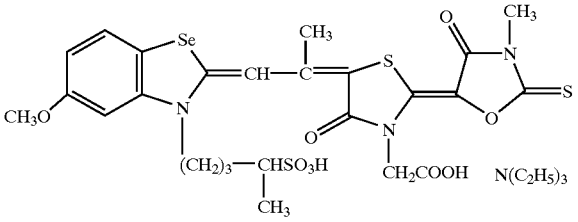
$N(C_2H_5)_3$
2-17
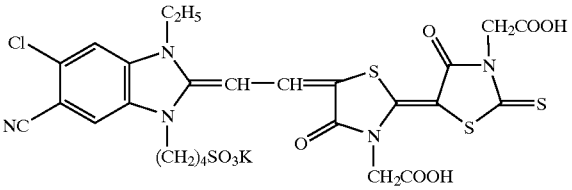
2-18
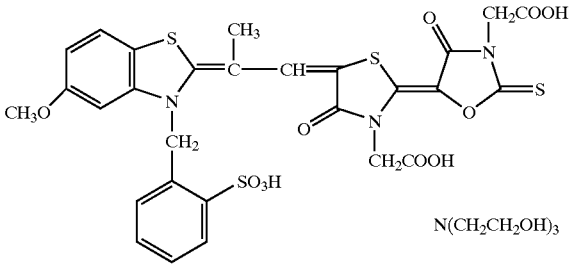
$N(CH_2CH_2OH)_3$
2-19
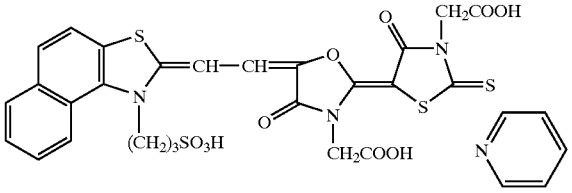
2-20
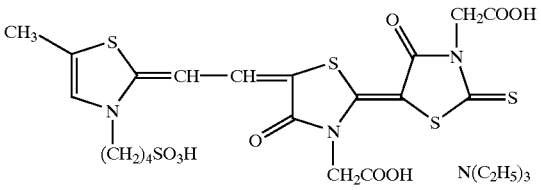
$N(C_2H_5)_3$ -continued 2-21

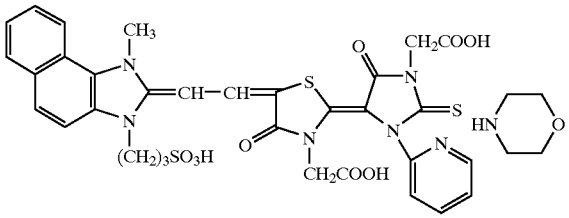

The foregoing compounds can be readily synthesized according the commonly known methods, as described in F. M. Hamer "Cyanine Dyes and Related Compounds" (Interscience Publishers, 1964), and U.S. Pat. Nos. 2,454,629 and 2,493,748.

The spectral sensitizing dyes represented by formula (3-a) or (3-b) will be described.

In formula (3-a) or (3-b), the aliphatic group represented by $R^{41}$, $R^{42}$, $R^{43}$, $R^{44}$, $R^{45}$, $R^{46}$, $R^{47}$ or $R^{48}$ include, for example, a straight or branched alkyl group having 1 to 8 carbon atoms (such as methyl, ethyl, n-propyl, n-pentyl, isobutyl), an alkenyl group having 3 to 8 carbon atoms (such as 3-butenyl, 2-propenyl), and an aralkyl group having 7 to 10 carbon atoms (such as benzyl, phenethyl). The aryl group represented by $R^{41}$, $R^{42}$ , $R^{43}$, $R^{44}$, $R^{45}$, $R^{46}$, $R^{47}$, or $R^{48}$ include, for example, a phenyl group and the heterocyclic group include, for example, pyridyl group (e.g., 2- or 4-pyridyl), pyrazyl group, furyl group (e.g., 2-furyl), thienyl group (e.g., 2-thienyl), sulforanyl group, tetrahydrofuryl group, piperidyl group, pyrrolyl group, and imidazolyl group. $R^{41}$, $R^{42}$, $R^{43}$, $R^{44}$, $R^{45}$, $R^{46}$, $R^{47}$, or $R^{48}$ each may be substituted and examples of the substituent group include a halogen atom (e.g., fluorine atom, chlorine atom, bromine atom, iodine atom), an alkoxy group (e.g., methoxy, ethoxy), an aryloxy group (e.g., phenoxy, p-tolyoxy), cyano group, a carbamoyl group (e.g., carbamoyl, N-methylcarbamoyl, N,N-tetramethylenecarbamoyl), a sulfamoyl group (e.g., sulfamoyl, N,N-3-oxapentamethyleneaminosulfonyl), a methanesulfonyl group, an alkoxycarbonyl group (e.g., ethoxycarbonyl, butoxycarbonyl), an aryl group (e.g., phenyl, carboxyphenyl), and an acyl group (e.g., acetyl, benzoyl). Exemplary examples of the aliphatic group containing an aqueous solubility promoting group include carboxymethyl, sulfoethyl, sulfopropyl, sulfobutyl, sulfopentyl, 3-sulfobutyl, 6-sulfo-3-oxahexyl, ω-sulfopropoxycarbonylmethyl, ω-sulfopropylaminocarbonyl-methyl, N-ethyl-N-sulfopropyl, 3-sulfinobutyl, 3-phosphonopropyl, 4-sulfo-3-butenyl, 2-carboxy-2propenyl, o-sulfobenzyl, p-sulfophenethyl, and p-carboxybenzyl. Examples of the aryl group containing an aqueous solubility promoting group include p-sulfophenyl and p-carboxyphenyl; and examples of the heterocyclic group containing an aqueous solubility promoting group include 4-sulfothienyl and 3-carboxypyridyl. Of these, it is preferred that $R^{41}$ and $R^{45}$ are a sulfo-substituted alkyl group, and at least two of $R^{42}$, $R^{43}$, $R^{44}$, $R^{46}$, $R^{47}$ and $R^{28}$ are carboxymethyl.

$Z^{41}$ and $Z^{42}$ each represent a 5- or 6-membered nitrogen-containing heterocyclic group. The nitrogen-containing heterocyclic rings include basic nitrogen-containing heterocyclic rings forming a cyanine dye, such as an oxazole ring (e.g., oxazole, benzoxazole, naphthoxazole), a thiazole ring (e.g., thiazolidine, thiazole, benzthiazole, naphthothiazole), an imidazole ring (e.g., imidazole, benzimidazole, naphthoimidazole), a selenazole ring (e.g., selenazole, benzoselenazole, naphthoselenazole), a tetrazole ring (e.g., tetrazole, benztetrazole, naphthotetrazole), a pyrydine ring (e.g., pyridine quinoline), and pyrrole ring (e.g., pyrrole, indole, indolenine). The nitrogen-containing heterocyclic group represented by $Z^{21}$ or $Z^{22}$ may be substituted at any position on the heterocyclic ring.

Examples of the substituent group include a halogen atom (e.g., fluorine atom, chlorine atom, bromine atom, iodine atom9, trifluoromethyl, an alkoxy group (e.g., unsubstituted alkoxy such as methoxy, ethoxy and butoxy, and substituted alkoxy such as 2-methoxyethoxy and benzoyloxy), hydroxy, cyano, an aryloxy group (e.g., phenoxy, tolyloxy), an aryl group (e.g., phenyl, p-chlorophenyl, p-tolyl, p-methoxyphenyl), styryl group, a heterocyclic group (e.g., furyl, thienyl9, a carbamoyl group (e.g., carbamoyl, N-ethylcarbamoyl), a sulfamoyl group (e.g., sulfamoyl, N,N-dimethylsulfamoyl), an acylamino group (e.g., acetylamino, propionylamino, benzoylamino), an acyl group (e.g., acetyl, benzoyl), an alkoxycarbonyl group (e.g., ethoxycarbonyl), a sulfonamido group (e.g., methanesulfonamido, p-toluenesulfonamido), carboxy group, and an alkyl group (e.g., methyl, ethyl, isopropyl).

$L^{41}$, $L^{42}$, $L^{43}$, $L^{44}$, $L^{45}$, $L^{46}$, $L^{47}$ and $L^{48}$ represent an unsubstituted or substituted methine group. The substituent group thereof include, for example, an alky group (e.g., methyl, ethyl), a pahenyl group (e.g., phenyl, carboxyphenyl), an alkoxy group (e.g., methoxy, ethoxy), an aryloxy group (e.g., phenoxy, carboxyphenoxy), an aralkyl group (e.g., benzyl) and a fluorine atom. The sensitizing dye of the invention, in which either one of $L^{41}$, $L^{42}$, $L^{43}$, $L^{44}$, $L^{45}$, $L^{46}$, $L^{47}$ and $L^{48}$ is a substituted methine group achieves higher spectral sensitivity and exhibits characteristics such that a dye is easily bleached in a processing solution, advantageously leading to reduced dye staining.

$W^{41}$ and $W^{42}$ represent a oxygen atom, sulfur atom, $=C<(E^{41})(E^{42})$ or $=C<<(E^{43})(E^{44})$, in which $E^{41}$, $E^{42}$, $E^{43}$ and $E^{44}$ each represent an electron-withdrawing group, which may combine with each other to form an oxo-group containing heterocyclic ring or an acidic heterocyclic ring.

141 represents 0 or 1; $M^{21}$ and $M^{22}$ represent a cation or an acid anion. Examples of the cation include proton, organic ammonium ion (e.g., triethylammonium, triethanolammonium), inorganic cations (e.g., lithium, sodium or calcium ion). Examples of the acid anion include a halide ion (e.g., chloride ion, bromide ion, iodide ion), p-toluenesulfonate ion, perchlorate ion, and 4-fluoroborate ion. n41 and n42 represent the number of ion(s) forming an intramolecular salt and counterbalancing the total intramolecular charge.

The electron-withdrawing group represented by $E^{41}$, $E^{42}$, $E^{43}$ and $E^{44}$ is selected from the groups exhibiting a Hammett $\sigma_p$ value of 0.3 or more, and examples thereof include cyano group, a carbamoyl group (e.g., carbamoyl, morpholinocarbamoyl, N-methylcarbamoyl), an alkoxycarbonyl group (e.g., methoxycarbonyl, ethoxycarbonyl), a sulfamoyl group (e.g., sulfamoyl, morpholinosulfonyl, N,N-dimethylsulfamoyl), an acyl group (e.g., acetyl, benzoyl), and a sulfonyl group (e.g., methanesulfonyl, ethanesulfonyl, benzenesulfonyl, toluenesulfonyl). The oxo-group containing heterocyclic ring and an acidic heterocyclic ring formed by $E^{41}$, $E^{42}$, $E^{43}$ and $E^{44}$ are the same as defined in $E^{21}$ and $E^{22}$.

$R^a$ and $R^b$ each represent a lower alkyl group, an aryl group or a heterocyclic group. The lower alkyl group include substituted and unsubstituted ones, for example, methyl, ethyl, propyl, 2-hydroxyethyl, 2-methoxyethyl, trifluoromethyl, carboxymethyl, carboxymethyl, 2-sulfoethyl and benzyl. The aryl group and heterocyclic group represented by $R^a$ and $R^b$ include the same as defined in $R^{42}$, $R^{43}$, $R^{44}$, $R^{46}$, $R^{47}$ and $R^{48}$.
Examples of the spectral sensitizing dyes represented by formula (3-a) or (3-b) are shown below but are by no means limited to these compounds.
3-1
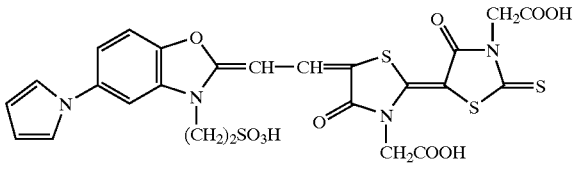
3-2
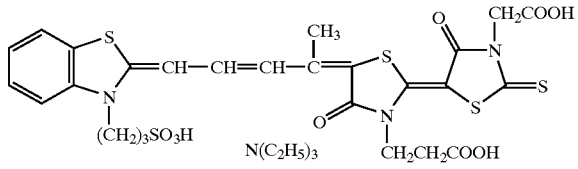
3-3
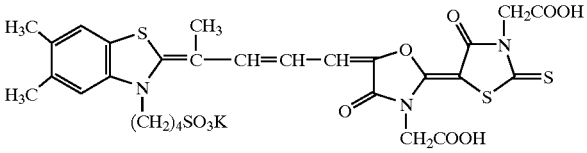
3-4
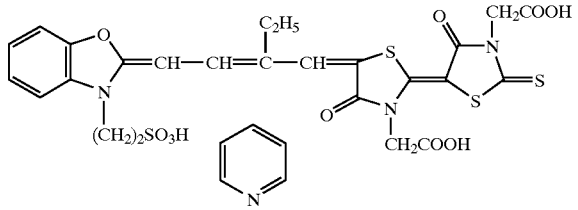
3-5
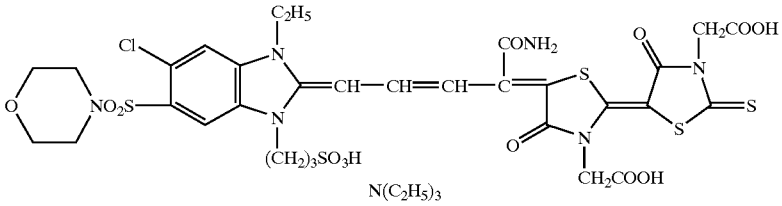
3-6
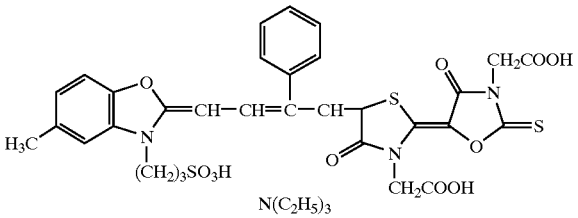
3-7
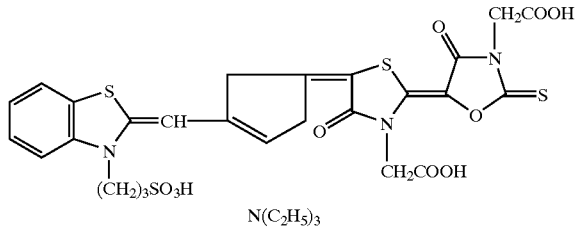
3-8
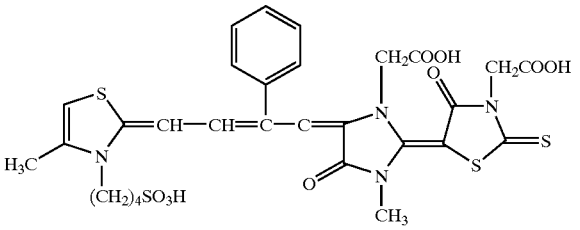
3-9
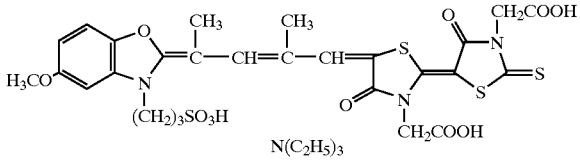
3-10
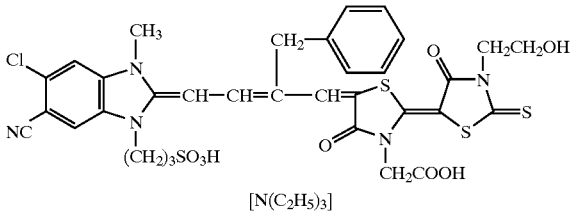
3-11
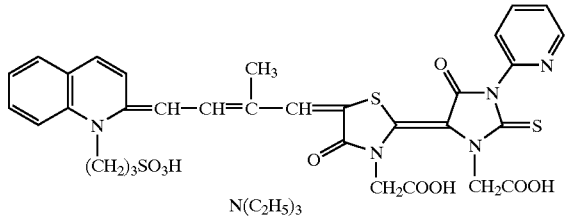

-continued
3-12
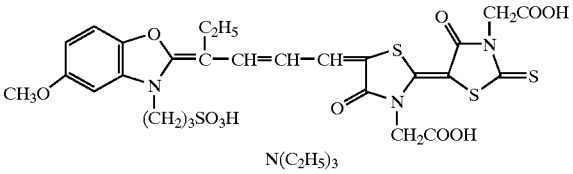
3-13
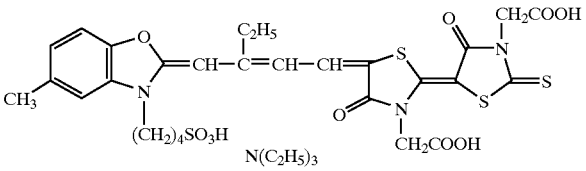
3-14
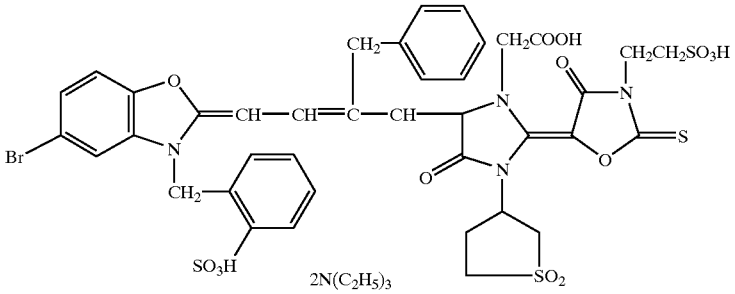
3-15
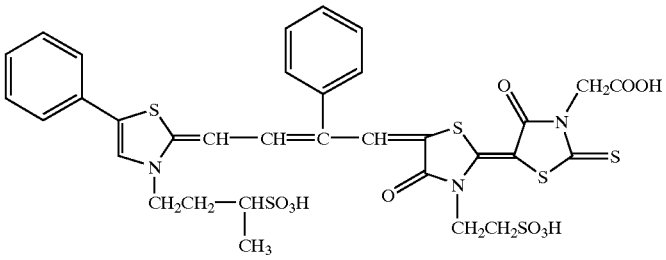
3-16
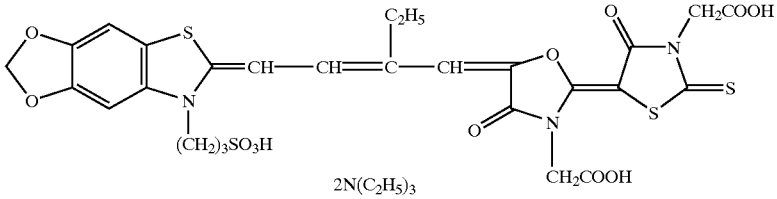
3-17
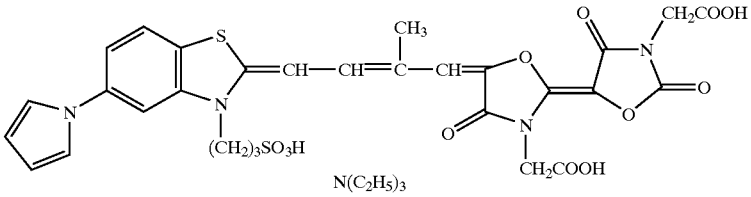
3-18
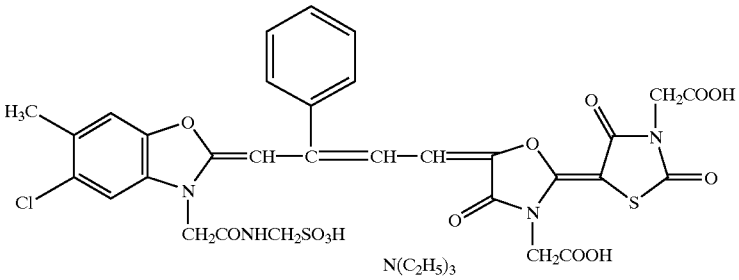

-continued
3-19
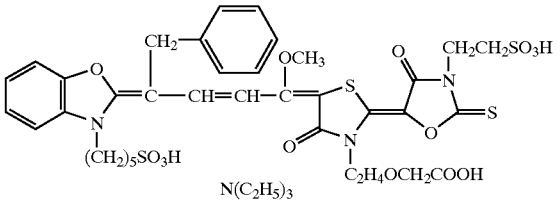
3-20
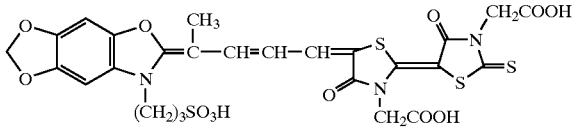
3-21
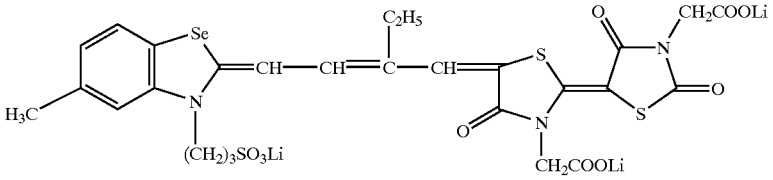
3-16
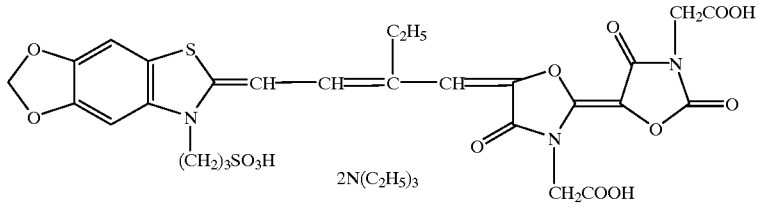
3-22
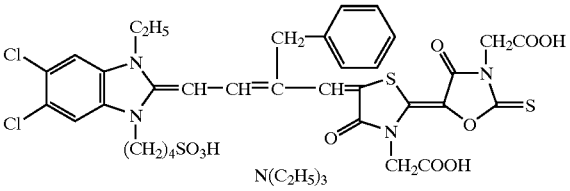
3-23
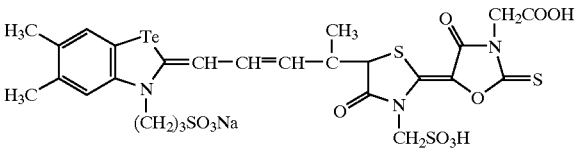
3-24
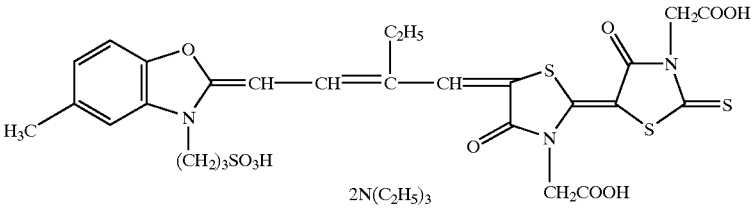
3-25
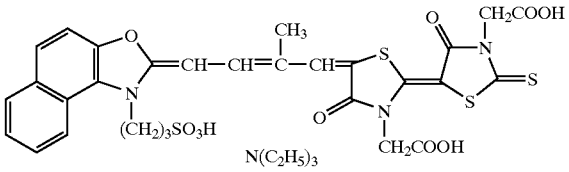
3-26
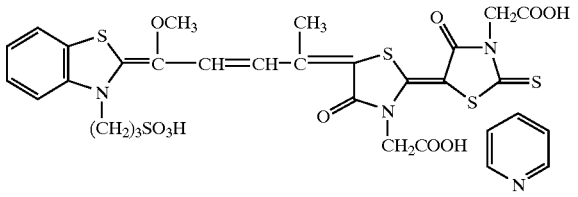
3-27
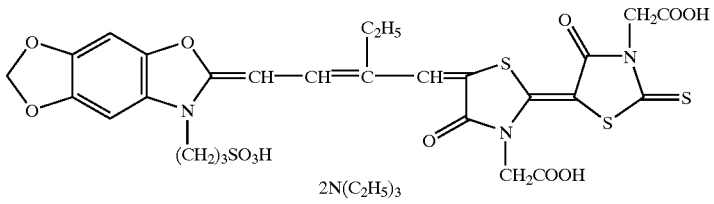

-continued 3-28

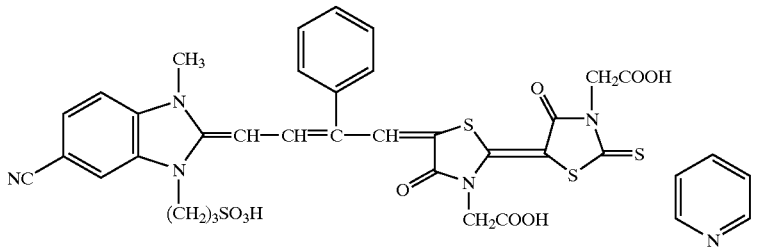

3-29

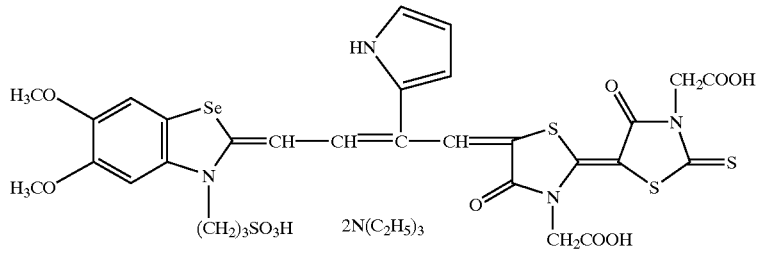

The spectral sensitizing dyes represented by formula (4) will be described.

In formula (4), the aqueous solubility promoting group contained in $R^{51}$, $R^{52}$, $R^{53}$ or $R^{54}$ include, for example, a sulfo group, a carboxy group, a phosphono group, a sulfate group and a sulfino group. The aliphatic group represented by $R^{51}$, $R^{52}$, $R^{53}$ or $R^{54}$ include, for example, a straight or branched alkyl group having 1 to 8 carbon atoms (such as methyl, ethyl, n-propyl, n-pentyl, isobutyl), an alkenyl group having 3 to 8 carbon atoms (such as 3-butenyl, 2-propenyl), and an aralkyl group having 7 to 10 carbon atoms (such as benzyl, phenethyl). The aryl group represented by $R^{51}$, $R^{52}$, $R^{53}$ or $R^{54}$ include, for example, a phenyl group and the heterocyclic group include, for example, pyridyl group (e.g., 2- or 4-pyridyl), pyrazyl group, furyl group (e.g., 2-furyl), thienyl group (e.g., 2-thienyl), sulforanyl group, tetrahydrofuryl group, piperidyl group, pyrrolyl group, and imidazolyl group. $R^{51}$, $R^{52}$, $R^{53}$ or $R^{54}$ each may be substituted and examples of the substituent group include a halogen atom (e.g., fluorine atom, chlorine atom, bromine atom, iodine atom), an alkoxy group (e.g., methoxy, ethoxy), an aryloxy group (e.g., phenoxy, p-tolyoxy), cyano group, a carbamoyl group (e.g., carbamoyl, N-methylcarbamoyl, N,N-tetramethylenecarbamoyl), a sulfamoyl group (e.g., sulfamoyl, N,N-3-oxapentamethyleneaminosulfonyl), a methanesulfonyl group, an alkoxycarbonyl group (e.g., ethoxycarbonyl, butoxycarbonyl), an aryl group (e.g., phenyl, carboxyphenyl), and an acyl group (e.g., acetyl, benzoyl). Exemplary examples of the aliphatic group containing an aqueous solubility promoting group include carboxymethyl, sulfoethyl, sulfopropyl, sulfobutyl, sulfopentyl, 3-sulfobutyl, 6-sulfo-3-oxahexyl, ω-sulfopropoxycarbonylmethyl, ω-sulfopropylaminocarbonyl-methyl, N-ethyl-N-sulfopropyl, 3-sulfinobutyl, 3-phosphonopropyl, 4-sulfo-3-butenyl, 2-carboxy-2propenyl, o-sulfobenzyl, p-sulfophenethyl, and p-carboxybenzyl. Examples of the aryl group containing an aqueous solubility promoting group include p-sulfophenyl and p-carboxyphenyl; and examples of the heterocyclic group containing an aqueous solubility promoting group include 4-sulfothienyl and 3-carboxypyridyl. Of these, it is preferred that $R^{21}$ and $R^{25}$ are a sulfo group containing alkyl group, and at least two of $R^{51}$, $R^{52}$, $R^{53}$ or $R^{54}$ are carboxymethyl.

The alkyl group represented by $V^{51}$ and $V^{52}$ include straight or branched alkyl groups, such as methyl, ethyl, isopropyl, t-butyl, iso-butyl, t-pentyl and hexyl. The alkoxy group represented by $V^{51}$ and $V^{52}$ include, for example, methoxy, ethoxy, and propoxy. The aryl group represented by $V^{51}$ and $V^{52}$, which may be substituted at any position include, for example, phenyl, p-tolyl, p-hydroxyphenyl, and p-methoxyphenyl. The condensed azole ring formed by the combination of $V^{31}$ and $V^{32}$ include, for example, 4,5,6,7-tetrahydrobenzoxazole, naphtha[1,2-d]oxazole, naphtha[2,3-d]oxazole, benzothiazole, 4,5,6,7-tetrahydrobenzothiazole, naphtha[1,2-d]thiazole, naphtha[2,3-d]thiazole, benzoselenazole and naphtha[1,2-d]selenazole. The group represented by $V^{31}$ and $V^{32}$ or the condensed ring formed by $V^{31}$ and $V^{32}$ may be substituted by a substituent group at any position thereof. Examples of the substituent group include a halogen atom (e.g., fluorine atom, chlorine atom, bromine atom, iodine atom9, trifluoromethyl, an alkoxy group (e.g., unsubstituted alkoxy such as methoxy, ethoxy and butoxy, and substituted alkoxy such as 2-methoxyethoxy and benzoyloxy), hydroxy, cyano, an aryloxy group (e.g., phenoxy, tolyloxy), an aryl group (e.g., phenyl, p-chlorophenyl, p-tolyl, p-methoxyphenyl), styryl group, a heterocyclic group (e.g., furyl, thienyl9, a carbamoyl group (e.g., carbamoyl, N-ethylcarbamoyl), a sulfamoyl group (e.g., sulfamoyl, N,N-dimethylsulfamoyl), an acylamino group (e.g., acetylamino, propionylamino, benzoylamino), an acyl group (e.g., acetyl, benzoyl), an alkoxycarbonyl group (e.g., ethoxycarbonyl), a sulfonamido group (e.g., methanesulfonamido, p-toluenesulfonamido), carboxy group, and an alkyl group (e.g., methyl, ethyl, isopropyl).

$L^{51}$ and $L^{52}$ represent an unsubstituted or substituted methine group. The substituent group thereof include, for example, an alky group (e.g., methyl, ethyl), a pahenyl group (e.g., phenyl, carboxyphenyl), an alkoxy group (e.g., methoxy), an aralkyl group (e.g., benzyl) and a fluorine atom.

$E^{51}$ and $E^{52}$ represent an electron-withdrawing group, which may combine with each other to form an oxo-group containing heterocyclic ring or an acidic heterocyclic ring.

The sensitizing dye of the invention, in which either $L^{51}$ or $L^{52}$ is a substituted methine group achieves higher spectral sensitivity and exhibits characteristics such that a dye is easily bleached in a processing solution, advantageously leading to reduced dye staining.

$W^{51}$ represents a oxygen atom, sulfur atom, or $=C<(E^{51})(E^{22})$, in which $E^{51}$ and $E^{52}$ each represent an electron-withdrawing group. The electron-withdrawing group represented by $E^{51}$ and $E^{52}$ is selected from the groups exhibiting a Hammett $\sigma_p$ value of 0.3 or more, and examples thereof include cyano group, a carbamoyl group (e.g., carbamoyl, morpholinocarbamoyl, N-methylcarbamoyl), an alkoxycarbonyl group (e.g., methoxycarbonyl, ethoxycarbonyl), a sulfamoyl group (e.g., sulfamoyl, morpholinosulfonyl, N,N-dimethylsulfamoyl), an acyl group (e.g., acetyl, benzoyl), and a sulfonyl group (e.g., methanesulfonyl, ethanesulfonyl, benzenesulfonyl, toluenesulfonyl). The oxo-group containing heterocyclic ring and an acidic heterocyclic ring formed by $E^{51}$ and $E^{52}$ are the same as defined in $E^{21}$ and $E^{22}$.

The heterocyclic group is the same as defined in $R^{51}$, $R^{52}$, $R^{53}$ and $R^{54}$.

$M^{51}$ represents a cation or an acid anion. Examples of the cation include proton, organic ammonium ion (e.g., triethylammonium, triethanolammonium), inorganic cations (e.g., lithium, sodium or calcium ion). Examples of the acid anion include a halide ion (e.g., chloride ion, bromide ion, iodide ion), p-toluenesulfonate ion, perchlorate ion, and 4-fluoroborate ion. n41 and n42 represent the number of ion(s) forming an intramolecular salt and counterbalancing the total intramolecular charge.

Examples of the spectral sensitizing dyes represented by formula (4) are shown below but are by no means limited to these compounds.

4-1

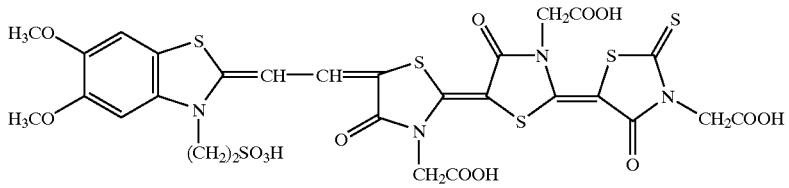

4-2

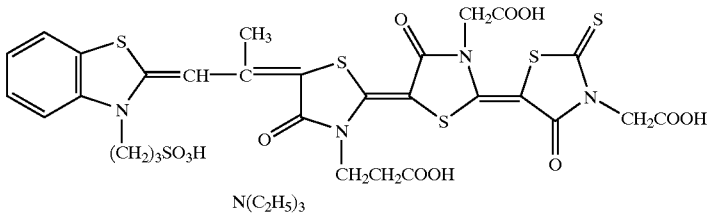

4-3

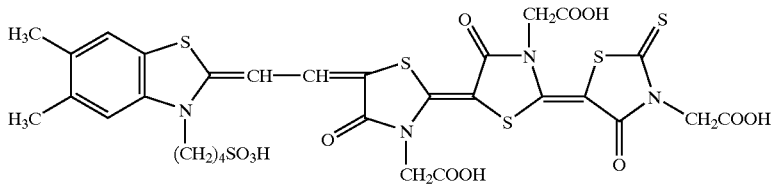

4-4

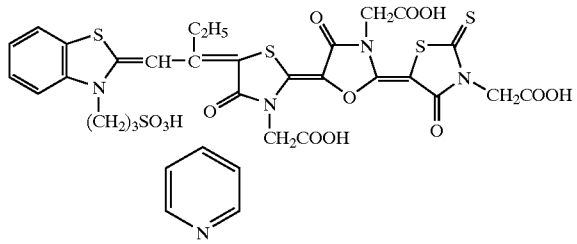

4-5

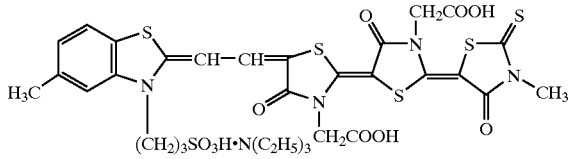

4-6

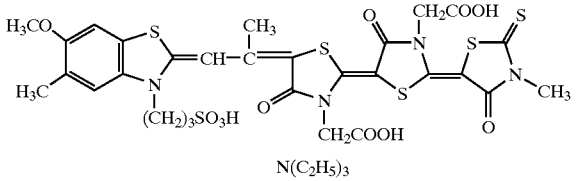

4-7

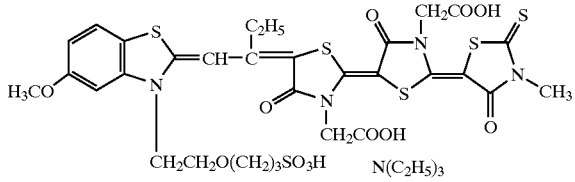

-continued
4-8
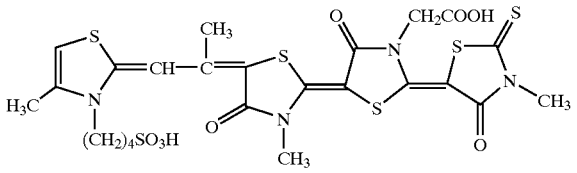
4-9
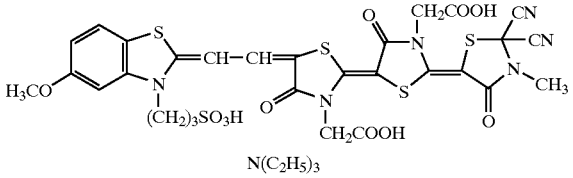
4-10
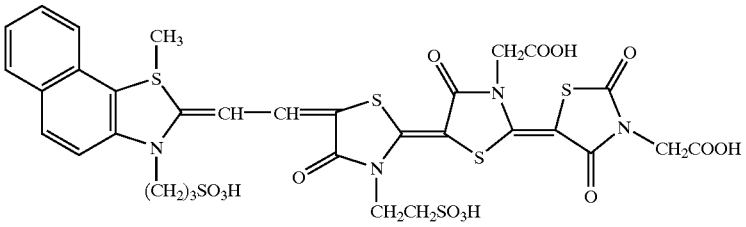
4-11
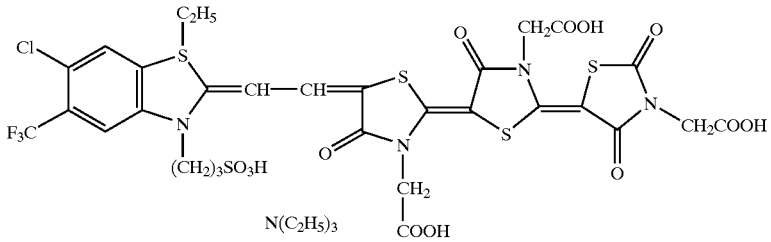
4-12
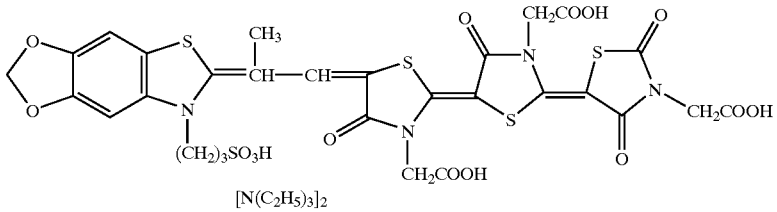
4-13
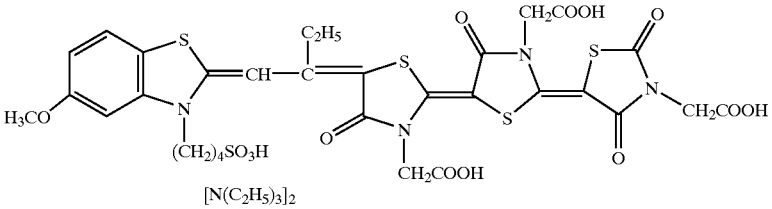
4-14
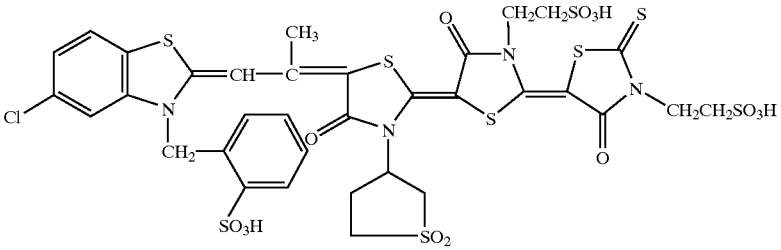

-continued
4-15
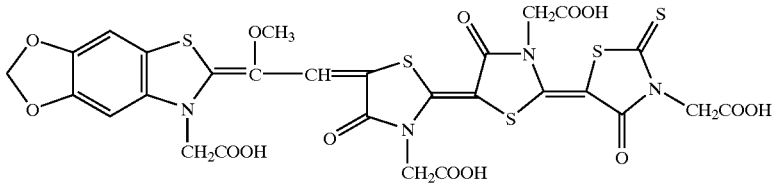
$[N(C_2H_5)_3]_2$
4-16
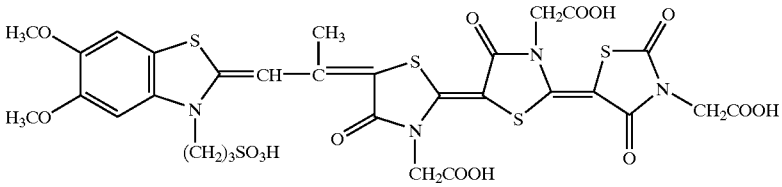
$2N(C_2H_5)_3$
4-17
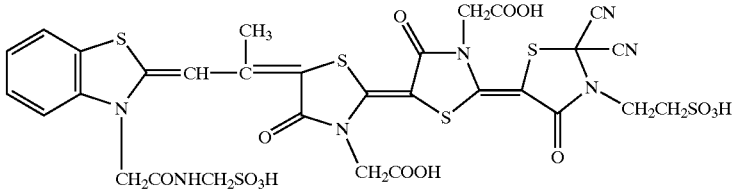
$2N(C_2H_5)_3$
4-18
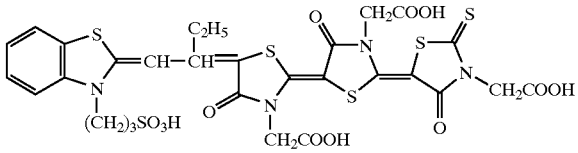
$2N(C_2H_5)_3$
4-19
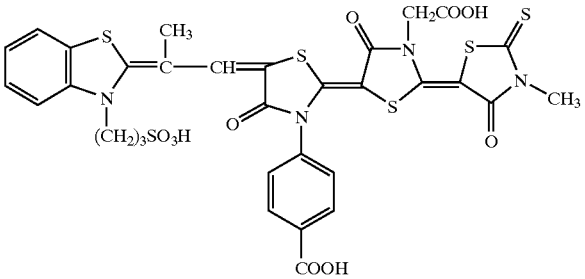
4-20
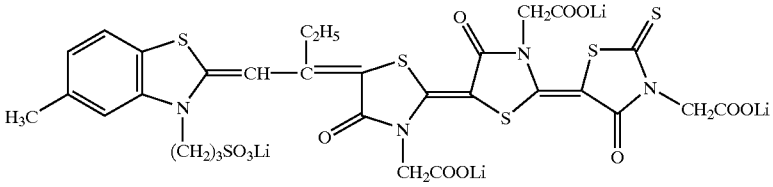
4-21
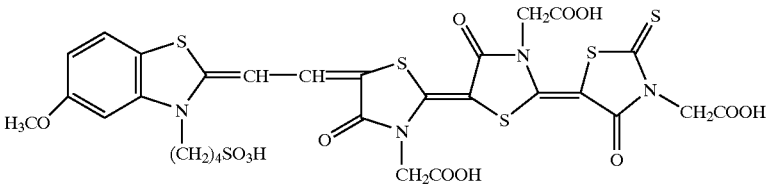
$[N(C_2H_5)_3]_2$ -continued
4-22
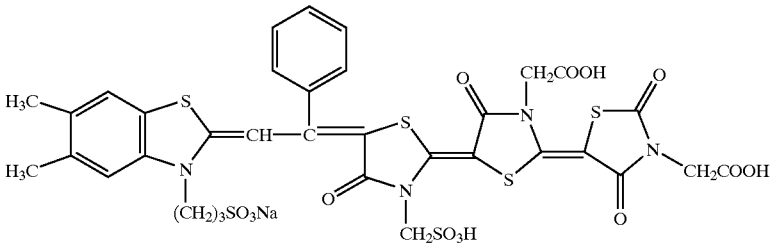
4-23
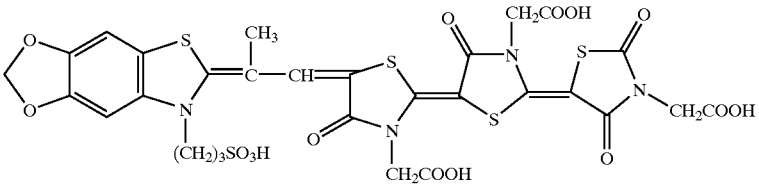
$[N(C_2H_5)_3]_2$
4-24
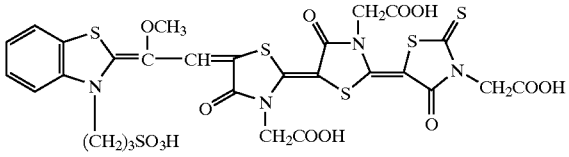
$N(C_2H_5)_3$
4-25
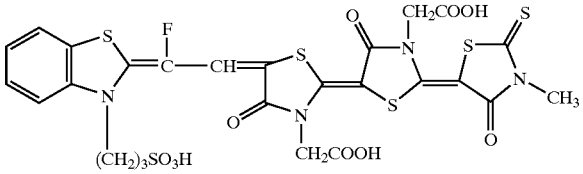
$[N(C_2H_5)_3]_2$
4-26
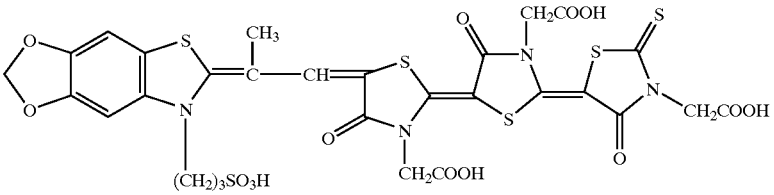
$[N(C_2H_5)_3]_2$
4-27
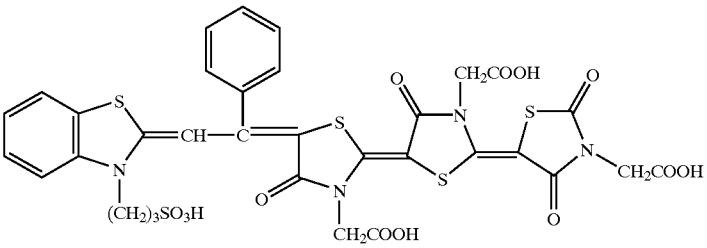
$[N(C_2H_5)_3]_2$
4-28
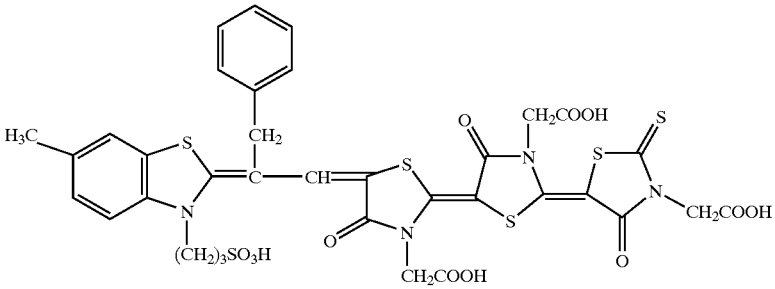
$[N(C_2H_5)_3]_2$ The foregoing compounds can be readily synthesized according the commonly known methods, as described in F. M. Hamer "Cyanine Dyes and Related Compounds" (Interscience Publishers, 1964), U.S. Pat. Nos. 2,454,629 and 2,493,748; British Patent No. 489,335 and European Patent No. 730,008.

The spectral sensitizing dyes represented by formula (5) will be described. $R^{61}$ and $R^{62}$ represent an alkyl group containing an aqueous solubility promoting group, which may be in a free form or a salt form. The solubility herewith means that the sensitizing dye represented by formula (5) dissolves in water at room temperature in an amount of 0.5 g or more per 1 lit. of water. Examples of $R^{61}$ and $R^{62}$ are as follows:

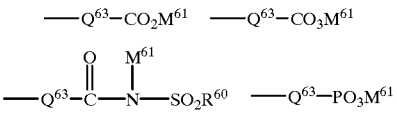

wherein $Q^{63}$ represents a bivalent linkage group including an alkylene group, an arylenes group and an alkenylene group. $M^{61}$ represents a hydrogen atom, ammonium, alkali metal (e.g., sodium, potassium), alkaline earth metal (e/.g., cakcium), or organic amines (e.g., triethylamine salt, 1,8-diazabicyclo[5,4,0]-7-undecene salt). $R^{60}$ represents an alkyl group or an aryl group. $Q^{63}$ is preferably an alkylene group having 1 to 20 carbon atoms (e.g., methylene, ethylene, propylene, butylenes, pentylene), an arylenes group having 6 to 20 carbon atoms (e/g/. phenylene), an alkenylene group having 2 to 20 carbon atoms (e.g., propenylene) or a bivalent group formed by combination of the foregoing groups. These bivalent linkage group may contain a group selected from the group of —NHCO—, —COO—, —$NHSO_2$—, —$SO_2O$—, —NHCONH—, —$SO_2$—, —SO—, —S—, —CO—, and —NH—. Exemplary examples of $Q^{63}$ are described below:

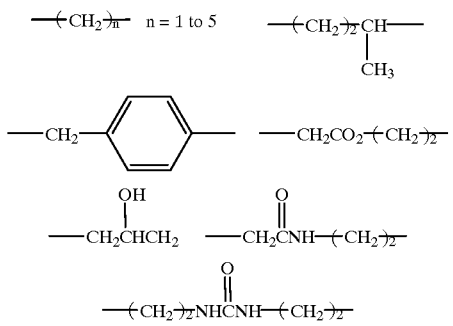

In addition, there can also be employed linkage groups described in European Patent No. 472,004, page 5 to 7. $Q^{63}$ is more preferanly an alkylene group having 1 to 10 carbon atoms, phenylene group or combination thereof, and still more preferably methylene, ethylene, propylene or butylenes.

$R^{60}$ is preferably an alkyl group having 1 to 10 carbon atoms (e.g., methyl, ethyl, hydroxyethyl) or an aryl group having 6 to 12 carbon atoms (e.g., phenyl, 4-chlorophenyl).

$V^{61}$, $V^{62}$, $V^{63}$ and $V^{64}$ represent a hydrogen atom or univalent group, and preferably a hydrogen atom, a unsubstituted alkyl group (preferably having 1 to 3 carbon atoms, such as methyl, ethyl, propyl), a substituted alkyl group (preferably having 1 to 2 carbon atoms, such as hydroxymethyl), an alkoxy group (preferably having 1 to 3 carbon atoms, such as methoxy, ethoxy), a fluorine atom, chlorine atom, hydroxy, an acetyl group, a carbamoyl group or cyano. $V^{61}$, $V^{62}$, $V^{63}$ and $V^{64}$ are more preferably a hydrogen atom, an alkyl group having 1 to 2 carbon atoms, an alkoxy group having 1 to 2 carbon atoms, hydroxymethyl, acetyl group, fluorine atom or chlorine atom, still more preferably a hydrogen atom, methyl or methoxy, and most preferably a hydrogen atom. The total of molecular weights of $V^{61}$, $V^{62}$, $V^{63}$ and $V^{64}$ is 4 to 50. The total of the molecular weights of $V^{61}$, $V^{62}$, V63 and $V^{64}$ refers to the total sum of each molecular weight of $V^{61}$, $V^{62}$, $V^{63}$ or $V^{64}$. In the case of $V^{61}=V^{62}=V^{63}=V^{64}$ hydrogen atom, for example, the total molecular weight id 4; and in the cases where $V^{61}=V^{62}=V^{63}$=hydrogen atom and $V^{64}$ is a phenyl group, the total molecular weight is 77. The total molecular weight is preferably 4 to 35, more preferably 4 to 21, and still more preferably 4.

$L^{61}$, $L^{62}$, $L^{63}$ and $L^{64}$ represent a methine group or a substituted methine group, in which examples of substituent group include substituted or unsubstituted alkyl group (preferably having 1 to 5 carbon atoms, e.g., methyl, ethyl, n-propyl, I-propyl, cyclopropyl, butyl, 2-carboxyethyl, etc.), substituted or unsubstituted aryl group (preferably having 6 to 12 carbon atoms, e.g., phenyl, naphthyl, anthryl, o-carboxyphenyl, etc.), a heterocyclic group (a heterocyclic ring of which is preferably a 3- to 7-membered heterocyclic ring comprising 2 to 12 carbon atoms and heteroatoms selected from S,, N, and Se, e.g., pyridine, thienyl, furan, barbituric acid), a halogen atom (e.g., chlorine, bromine, iodine atoms), an alkoxy group (preferably having 1 to 5 carbon atoms, e.g., methoxy, ethoxy), a substituted or unsubstituted amino group (preferably having 0 to 12 carbon atoms, e.g., N,N-diphenylamino, N-methyl-N-phenylamino, N-methylpyradino), and an alkylthio group (preferably 1 to 5 carbon atoms, e.g., methylthio, ethylthio). The methine group may combine with another methine group to form a ring (preferably 5- to 7-membered ring such as cyclohexene ring) or an auxochrome (e.g., benzoxazole ring). $L^{61}$, $L^{62}$ and $L^{64}$ are preferably a unsubstituted methine group. $L^{63}$ is preferably a methine group substituted with an unsubstituted alkyl group (e.g., methyl, ethyl).

$M^{61}$ is a cation or an anion necessary to counterbalance the total intramolecular charge, and n61 represents the number of ion(s) necessary to counterbalance the total intramolecular charge. Example of cations include hydrohen ion, inorganic ammonium ion, organic ammonium ion (e.g., tetraalkylammonium ion, pyridinium ion), alkali metl ion, (e.g., sodium ion, potassium ion), and alkaline earth metal ion (e.g., calcium ion). Examples of anions include inorganic anions (e.g., fluoride ion, chloride ion, bromide ion, iodide ion), substituted arysulfonate ions (e.g., p-toluenesulfonate ion, p-chlorobenzenesulfonate ion), an arysulfonate ion (e.g., 1,3-benzene-disulfonate ion, 2,6-naphthalene-disulfonate ion), alkylsulfate ions (e.g., methylsulfate ion, ethylsulfate ion), sulfate ion, thicyanate ion, perchlorate ion, tetrafluoroborate ion, picrinate ion, acetate ion and trifluoromethansulfonate ion. Further, as a charge-balamcing counterion, an ionic polymer a compound (spectral sensitizing dye) having a charge opposite to the charge of the compound of formula (5) may be used.metal complex ions such as bisbenzene-1,2-dithiolate nickel (III) are also usable. Of these, cations such as ammonium ion (e.g., triethylamine salt, 1,8-diazacyclo[5,4,0]-7-undecene), and alkali metal ions (e.g., sodium ion, potassium ion) is preferred; alkali metal ions (e.g., sodium ion, potassium ion) is more preferred; and sodium ion is still more preferred.

The sensitizing dye represented by formula (5) is preferably a sensitizing dye represented by the following formula (5-a):

formula (5-a)

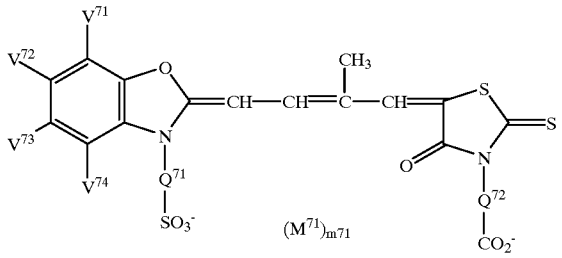

wherein $Q^{71}$ and $Q^{72}$ represent an alkylene group, $V^{71}$, $V^{72}$, $V^{73}$ and $V^{74}$ each represent a hydrogen atom, methyl, ethyl, hydroxy, an acetyl group, fluorine atom or chlorine atom. Total sum of molecular weights of $V^{71}$, $V^{72}$, $V^{73}$ and $V^{74}$ is 4 to 50; $M^{71}$ is a charge-balancing counter ion and m71 is an integer of 0 to 4. In formula (5-a), $V^{71}$, $V^{72}$, $V^{73}$ and $V^{74}$ are each preferably a hydrogen atom.

Specifically, $Q^{71}$ and $Q^{72}$ is preferably alkylene group (preferably having 1 to 8 carbon atom, and more preferably 1 to 4 carbon atoms, such as methylene, ethylene, propylene, n-butylene, I-butylene). $Q^{71}$ is more preferably an ethylene group and $Q^{72}$ is more preferably a methylene group. It is more preferred that $Q^{71}$ is an ethylene group and $Q^{72}$ is a methylene group, Examples of $M^{71}$ are the same as cited in $M^{61}$. Preferred $M^{61}$ is the the as cited in $M^{61}$, and sodium ion is more preferred.

Examples of spectral sensitizing dyes represented by formula (5) are shown below, but are by no means limited to these.

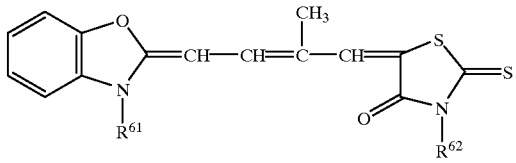

$(M^{61})_{n61}$

| Compound No. | $R^{61}$ | $R^{62}$ | $M^{61}$ | n61 |
|---|---|---|---|---|
| (1) | $(CH_2)_2SO_3^-$ | $CH_2CO_2^-$ | $Na^+$ | 2 |
| (2) | $(CH_2)_2SO_3^-$ | $CH_2CO_2^-$ | $K^+$ | 2 |
| (3) | $(CH_2)_2SO_3^-$ | $CH_2CO_2^-$ | $(C_2H_5)_3{}^+NH$ | 2 |
| (4) | $(CH_2)_4SO_3^-$ | $CH_2CO_2^-$ | $K^+$ | 2 |
| (5) | $(CH_2)_3SO_3^-$ | $CH_2CO_2^-$ | $K^+$ | 2 |
| (6) | $(CH_2)_2CH(CH_3)SO_3^-$ | $CH_2CO_2^-$ | $K^+$ | 2 |
| (7) | $(CH_2)_2SO_3^-$ | $(CH_2)_2CO_2^-$ | $Na^+$ | 2 |
| (8) | $(CH_2)_2SO_3^-$ | $(CH_2)_3CO_2^-$ | $Na^+$ | 2 |
| (9) | $(CH_2)_2SO_3^-$ | $(CH_2)_5CO_2^-$ | $Na^+$ | 2 |

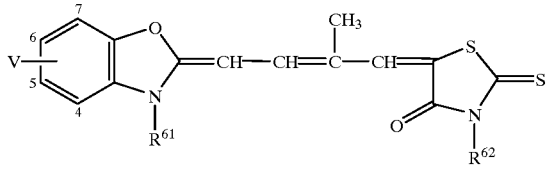

$(M^{61})_{n61}$

| Compound No. | $R^{61}$ | $R^{62}$ | V | $M^{61}$ | n61 |
|---|---|---|---|---|---|
| (10) | $CH_2CO_2^-$ | $(CH_2)_2SO_3^-$ | H | $K^+$ | 2 |
| (11) | $CH_2CO_2^-$ | $CH_2CO_2^-$ | H | $K^+$ | 2 |
| (12) | $(CH_2)_4SO_3^-$ | $(CH_2)_2SO_3^-$ | H | $K^+$ | 2 |
| (13) | $(CH_2)_4SO_3^-$ | $CH_2CO_2^-$ | 5-$OCH_3$ | $Na^+$ | 2 |
| (14) | $(CH_2)_4SO_3^-$ | $CH_2CO_2^-$ | 5-$CH_3$ | $Na^+$ | 2 |
| (15) | $(CH_2)_4SO_3^-$ | $CH_2CO_2^-$ | 5-$CH_3$ 6-$CH_3$ | $Na^+$ | 2 |
| (16) | $(CH_2)_4SO_3^-$ | $CH_2CO_2^-$ | 5-F | $Na^+$ | 2 |
| (17) | $(CH_2)_4SO_3^-$ | $CH_2CO_2^-$ | 5-Cl | $Na^+$ | 2 |
| (18) | $(CH_2)_4SO_3^-$ | $CH_2CO_2^-$ | 5-OH | $Na^+$ | 2 |
| (19) | $(CH_2)_4SO_3^-$ | $CH_2CO_2^-$ | 5-$COCH_3$ | $Na^+$ | 2 |

-continued (20)

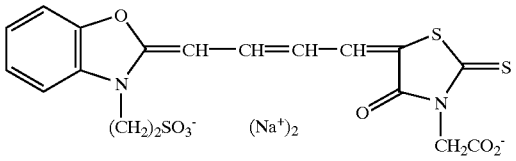

(21)

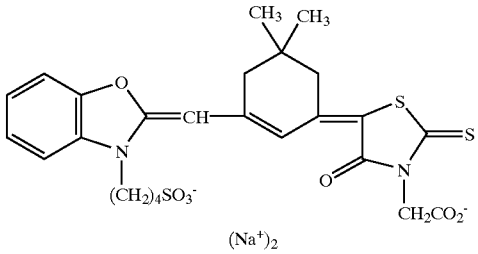

(22)

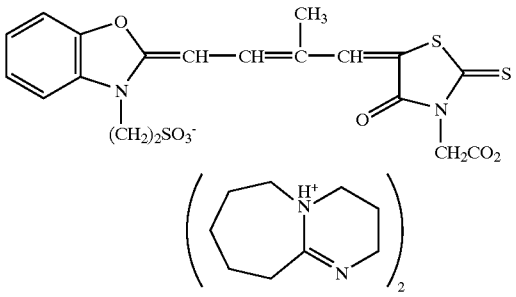

The foregoing sensitizing dyes represented by formula (5) can be readily synthesized according the commonly known methods, as described in F. M. Hamer "Cyanine Dyes and Related Compounds" (Interscience Publishers, 1964); D. S. Sturmer "Heterocyclic Compounds-Special Topics in Heterocyclic chemistry" chapt. 18, sect. 14, page 482–515 (John-Wirey & Sons, 1977); "Rodd7s Chemistry of Carbon Compound" ($2^{nd}$ Ed., vol. IV, part B. 1985) chapt. 15, page 369–422 and ($2^{nd}$ Ed., vol IV, part B) chapt. 15, page 267–296 (Elservier Science Publishing Company Inc.).

The adding amount of the sensitizing dye represented by formula (1-a), formula (1-b), formula (3-a), formula (3-b), formula (4) or formula (5), depending on the conditions to be used and the kind of emulsions, is preferably $1\times10^{-6}$ to $5\times10^{-3}$, and more preferably $2\times10^{-6}$ to $2\times10^{-3}$ mol per mol of silver halide. The sensitizing dye represented by formula (1-a), formula (1-b), formula (3-a), formula (3-b), formula (4) or formula (5) can be incorporated into silver halide emulsions by the commonly known methods. Examples thereof include incorporation through protonating dissolution described in JP-A Nos. 50-80826 and 50-80827; incorporation through dispersion with a surfactant described in U.S. Pat. No. 3,822,135 and JP-A No. 50-11419; incorporation through dispersion in a hydrophilic substrate described in U.S. Pat. Nos. 3,676,147, 3,469,987, 4,247,627 and JP-A Nos. 51-59942, 53-16624, 53-102732, 53-102733 and 53-137131; incorporation in the form of a solid solution described East German Patent No. 143,324; and incorporation by dissolving the dye in an aqueous soluble solvent (e.g., water, or low boiling solvent such as methanol, ethanol, propyl alcohol, acetone, or fluorinated alcohol, or a high boiling solvent such as dimethyl formamide, methyl cellosolve or phenyl cellosolve), as described in Research Disclosure No. 21802, JP-B No. 50-40659 and JP-A 59-148053. The sensitizing dye represented by formula (1-a), formula (1-b), formula (3-a), formula (3-b), formula (4) or formula (5) may added at any stage of the process of emulsion making, i.e., of physical ripening to chemical ripening and coating but it is preferred to add after starting physical ripening and before completing chemical ripening. It is specifically preferred to add the dye during physical ripening or prior to addition of a chemical sensitizer during chemical ripening, or immediately after adding a chemical sensitizer to enhance effects of this invention. The sensitizing dye represented by formula (1-a), formula (1-b), formula (3-a), formula (3-b), formula (4) or formula (5) may be used in combination with other sensitizing dye(s). In such a case, the sensitizing dyes may be added simultaneously or separately.

The sensitizing dye of the invention can achieve further enhanced spectral sensitivity by the use of a compound exhibiting a super-sensitizing effect, in combination. Examples of the compound exhibiting the super-sensitizing effectcompounds containing a pyrimidinylamino group or triazinylamino group, described in U.S. Pat. Nos. 2,933,390, 3,416,927, 3,511,664, 3,615,613, 3,615,632 and 3,635,721, JP-A 3-15042, 3-110545 and 4-255841; aromatic organic formaldehyde condensates described in British Patent No. 1,137,580 and JP-A 61-169833; carix-arene derivatives described in JP-A 4-184332; halogenated benzotriazole derivatives described in U.S. Pat. No. 4,030,927; bis-pyridinium compounds described in JP-A No. 59-142541 and 59-188641; aromatic heterocyclic quaternary salt compounds described in JP-A 59-191032; electron-donating compounds described in JP-A 60-79348; a polymer containing an aminoallylidene malononitrile unit described in U.S. Pat. No. 4,307,183; hydroxytetrazaindene derivatives described in JP-A 4-149937; 1,3-oxadiazole derivatives described in U.S. Pat. No. 3,615,633; and amino-1,2,3,4-thiatriazole derivatives described in U.S. Pat. No. 4,780,404. The time for adding these super-sensitizers is not specifically limited and the compound may be added at any time. The supersensitizer is incorporated in an amount of $1\times10^{-6}$ to $1\times10^{-1}$ mole per mole of silver halide. The ratio of supersensitizer to sensitizing dye is within the range of 1/10 to 10/1.

Photographic materials according to this invention are suitable for use in printing plate making, exhibiting high contrast and forming high contrast images. In the photographic material of the invention, hydrazine derivatives are preferably employed as a contrast-increasing agent. When the photographic material of this invention is exposed and processed, the slope (γ) on the characteristic curve within the density rage of 1 .0 to 3.0 of the formed images is preferably 10 to 100. To achieve the γ of 10 to 100, it is preferred to allow a contrast-increasing agent to be contained in the photographic material. Employed as a contrast-increasing agent are hydrazine derivatives and 5- or 6-membered nitrogen-containing heterocyclic derivative, tetrazolium compounds described in JP-A No. 10-10680.

The hydrazine derivative is preferably represented by the following formula (H):

formula (H)

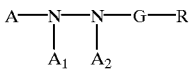

wherein A is an aryl group or a heterocyclic group containing an oxygen atom or a sulfur atom; G is —(CO)n—, sulfonyl group, sulfoxy group, —P(=O)$R_2$—, or iminomethylene group, and n is an integer of 1 or 2, in which $R_2$ is a substituted or unsubstituted alkyl, substituted or unsubstituted alkenyl, substituted or unsubstituted alkynyl, substituted or unsubstituted aryl, substituted or unsubstituted alkoxy, substituted or unsubstituted alkenyloxy, substituted or unsubstituted alkynyloxy, substituted or unsubstituted aryloxy or substituted or unsubstituted amino group; $A_1$ and $A_2$ are both hydrogen atoms, or either of them is a hydrogen atom and the other is a substituted or unsubstituted alkylsulfonyl group or a substituted or unsubstituted acyl group; R is a hydrogen atom or a substituted or unsubstituted alkyl, alkenyl, aryl, alkoxy, alkenyloxy, aryloxy, heterocyclic-oxy, amino or carbamoyl group or oxycarbonyl group.

Of the compounds represented by formula (H), a compound represented by the following formula (Ha) is preferred:

formula (Ha)

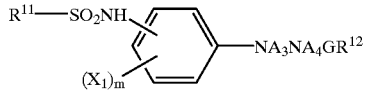

wherein $R^{11}$ is an aliphatic group (e.g., octyl, decyl), an aromatic group (e.g., phenyl, 2-hydroxyphenyl, chlorophenyl), or a heterocyclic group (e.g., pyridyl, thienyl, furyl), each of which may be substituted. Specifically, $R^{11}$ having a ballast group or a group promoting adsorption onto silver halide is preferred. The ballast group is preferably one which are commonly used in non-diffusible photographic additives such as couplers, and having 8 or less carbon atoms, such as alkyl, alkenyl, alkynyl, alkoxy, phenyl and alkylphenoxy. Examples of the group promoting adsorption onto silver halide include a thiourea group, a thiourethane group, mercapto group, a thioether group, a heterocyclic group, a thioamino-heterocyclic group, a mercapto-heterocyclic group and adsorbing groups described in JP-A 64-90439. In formula (Ha), $X_1$ is a group capable of being substituted on a phenyl group; m is an integer of 0 to 4, provided that when m is 2 or more, X may be the same or different. In formula (Ha), $A_3$ and $A_4$ are the same as defined in $A_1$ and $A_2$ of formula (H) and are preferably both hydrogen atoms. In formula (Ha), G is a carbonyl group, oxalyl group, sulfonyl group, sulfoxy group, phosphoryl or imonomethylene group; and is preferably a carbonyl group. In formula (Ha), $R^{12}$ is a hydrogen atom, or a substituted or unsubstituted alkyl, alkenyl, alkynyl, aryl or heterocyclic group, hydroxy, a substituted or unsubstituted amino, carbamoyl or oxycarbonyl group; specifically, $R^{12}$ is preferably a substituted alkyl group, in which the carbon atom attached to G is attached to an electron-withdrawing group, —$COOR^{13}$ or —$CON(R^{14})$ ($R^{15}$), in which $R^{13}$ is an alkynyl group or a saturated heterocyclic group, $R^{14}$ is a hydrogen atom, an alkyl group, an alkenyl group, alkynyl group, aryl group or a heterocyclic group; and $R^{15}$ is an alkenyl group, an alkynyl group, a saturated heterocyclic group, hydroxy, or an alkoxy group. $R^{12}$ is more preferably a substituted alkyl group, in which the carbon atom attached to G is attached to two electron-withdrawing groups (still more preferably three electron-withdrawing groups). The electron-withdrawing group attached to the carbon atom of $R^{12}$, which is attached to G, is preferably one which has a σp of 0.2 or more and σm of 0.3 or more (in which σp and σm are each a Hammett's substitution constant). Examples thereof include halogen, cyano, nitro, nitroso, polyhaloalkyl group, polyhaloaryl group, alkyl- or aryl-carbonyl group, formyl, alkyl- or aryl-oxycarbonyl group, alkylcarbonyloxy group, carbamoyl group, alkyl- or aryl-sulfinyl group, alkyl- or aryl-sulfonyl group, alkyl- or aryl-sulfonyloxy group, sulfamoyl group, phosphine group, phosphineoxide group, phosphone ester group, phosphoneamido group, arylazo group, amidino group, ammonoi group, sulfonoi group, and electron-deficient heterocyclic group. In formula (Ha), $R^{12}$ is specifically preferably a fluorine-substituted alkyl group, such as monofluoromethyl, difluoromethyl and trifluoromethyl.

Exemplary examples of the compounds represented by formula (H) are shown below, but are not limited to these.

H-1
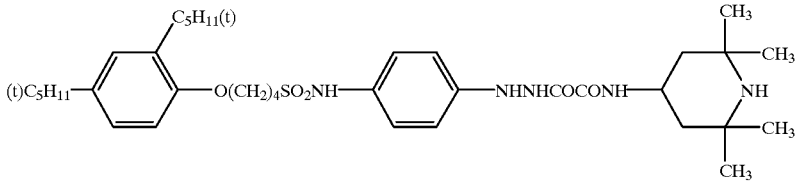
H-2
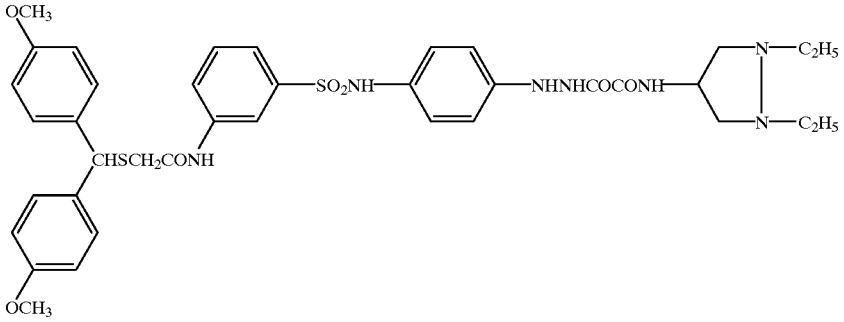
H-3
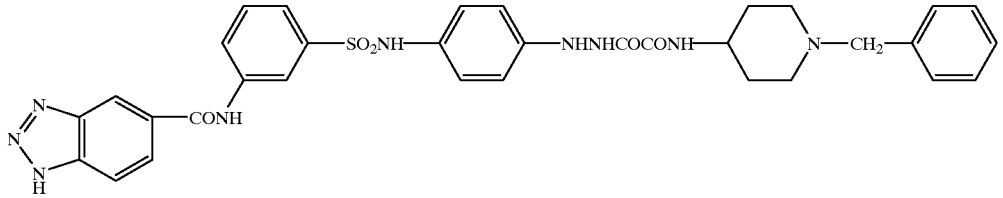
H-4
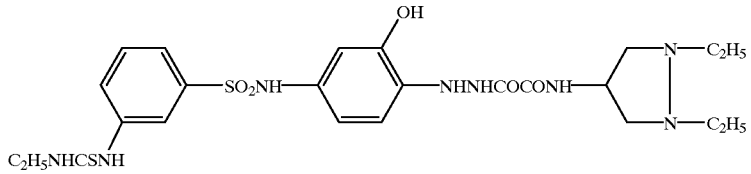
H-5
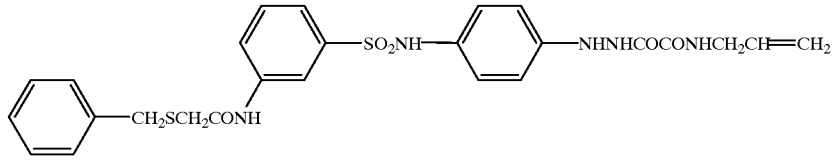
H-6
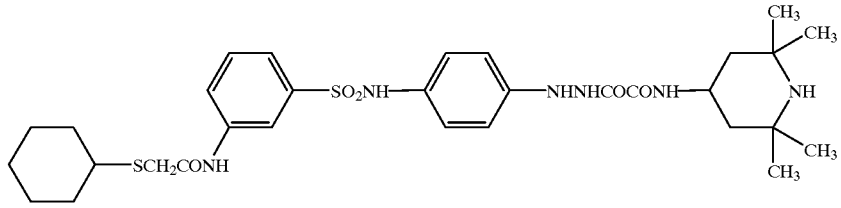

-continued
H-7
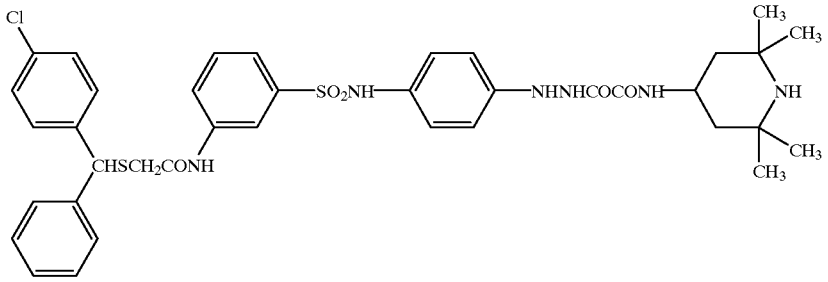
H-8
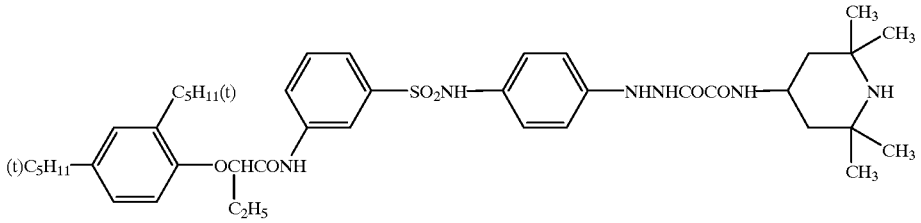
H-9
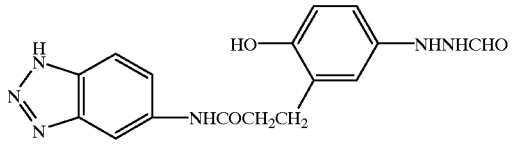
H-10
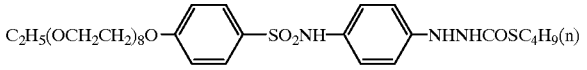
H-11
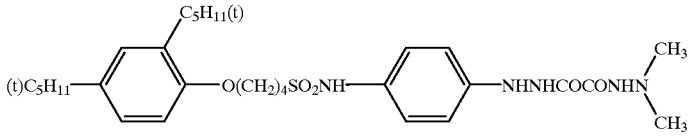
H-12
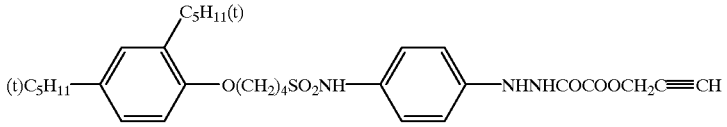
H-13
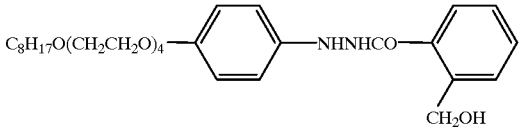
H-14
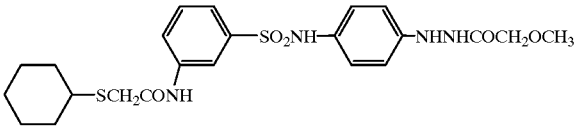
H-15
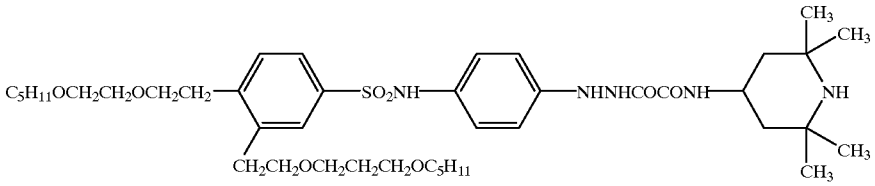
H-16
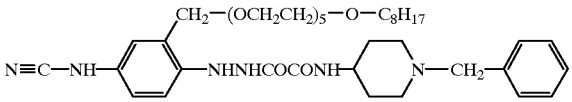
H-17
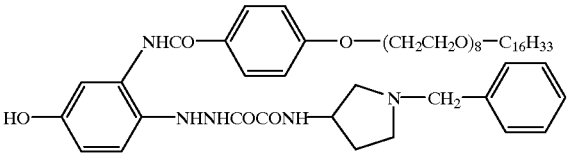

-continued
H-18
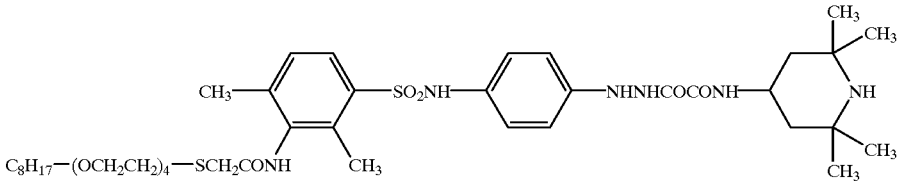
H-19
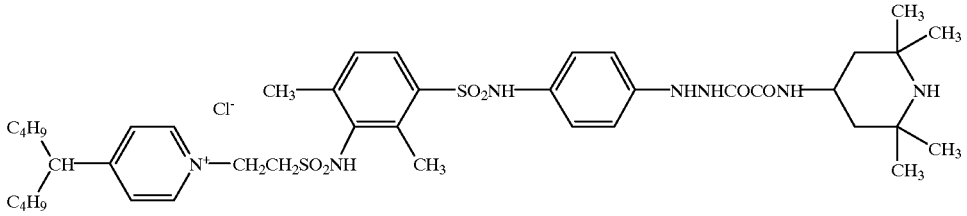
H-20
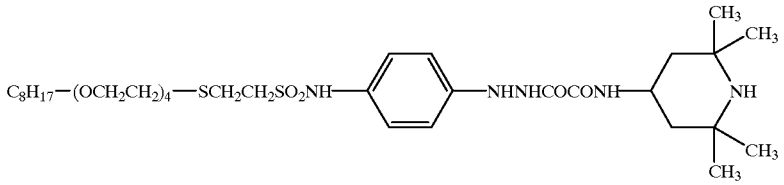
H-21
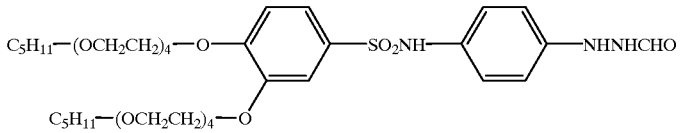
H-22
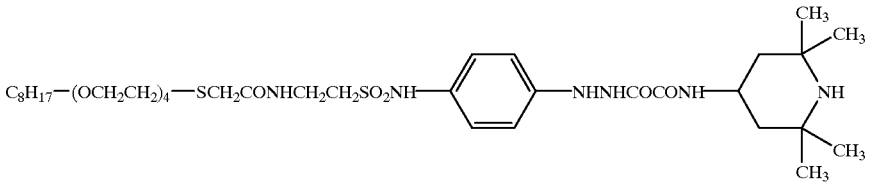
H-23
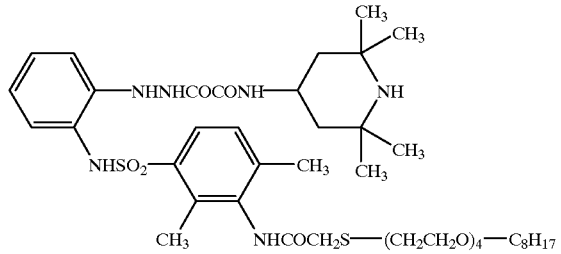
H-24
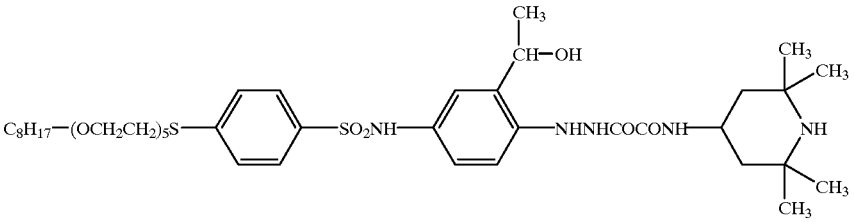

-continued
H-25
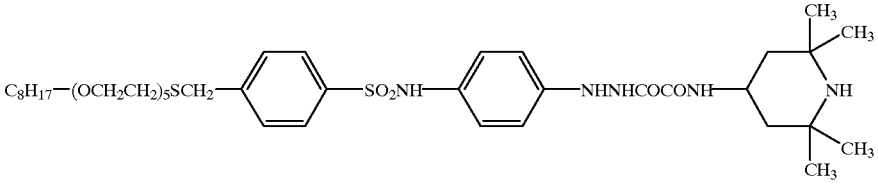
H-26
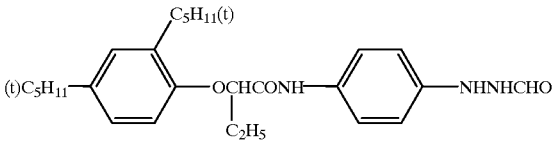
H-27
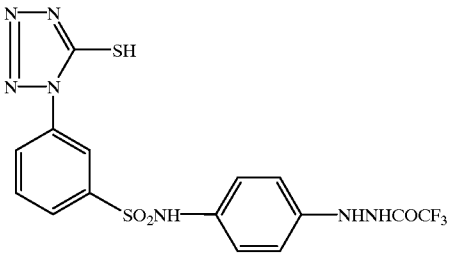
H-28
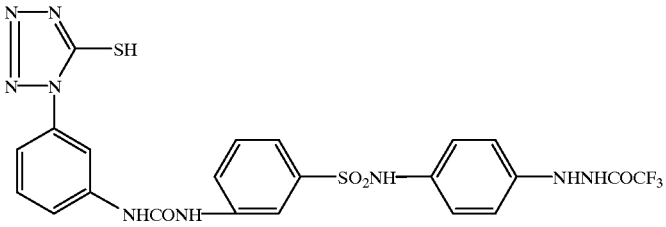
H-29
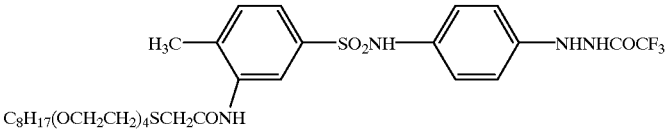
H-30
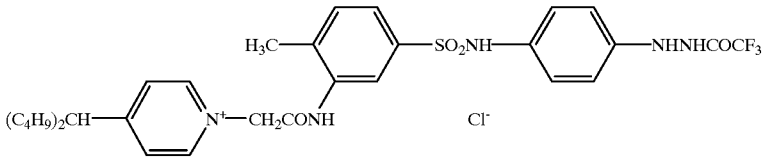
H-31
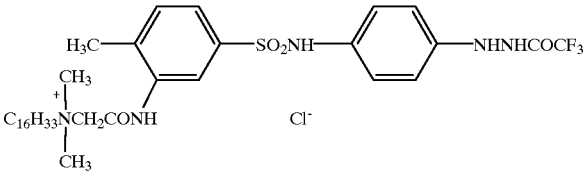
H-32
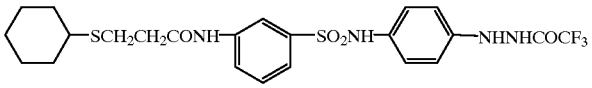
H-33
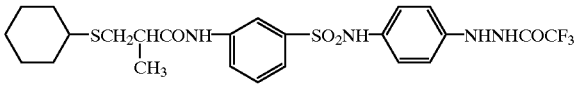
H-34
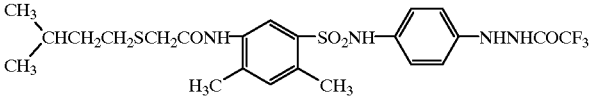

-continued
H-35
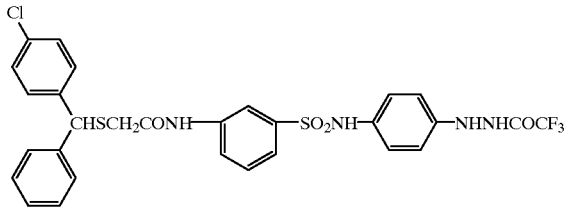
H-36
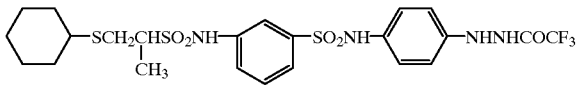
H-37
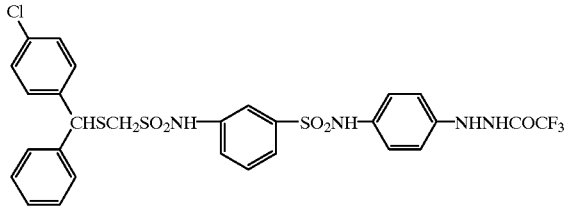
H-38
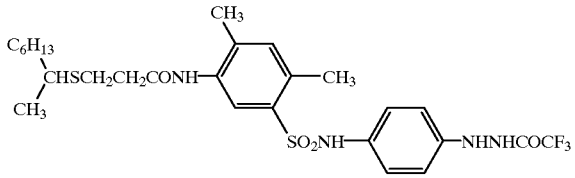
H-39
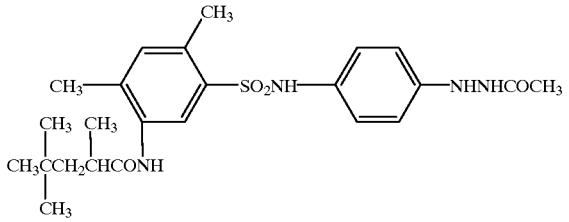
H-40
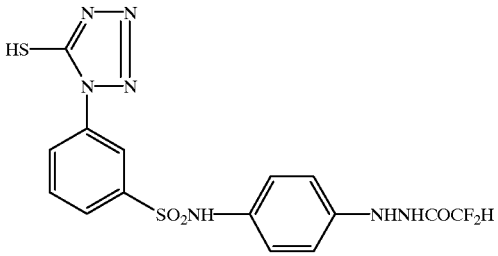
H-41
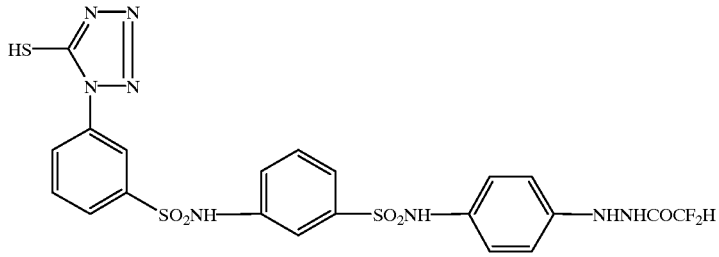
H-42
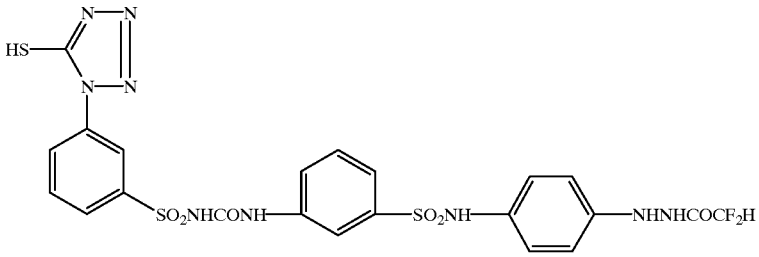
H-43
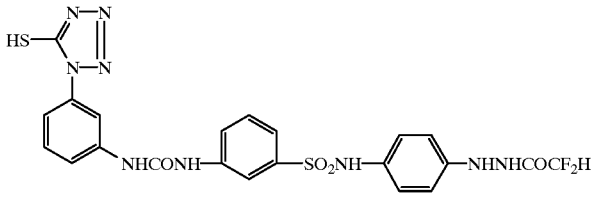
H-44
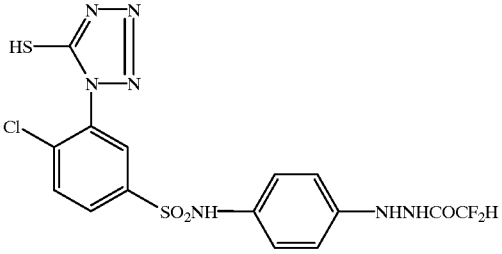

-continued
H-45
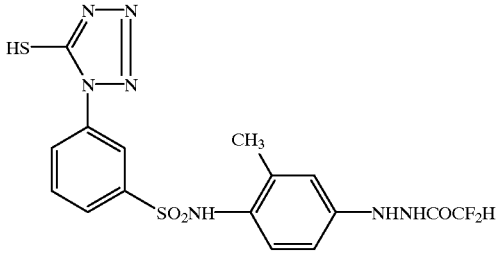
H-46
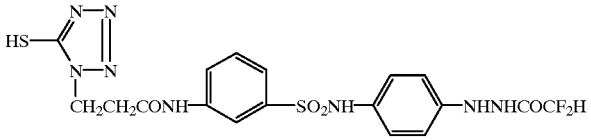
H-47
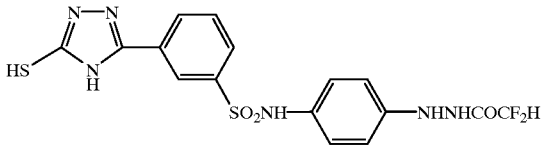
H-48
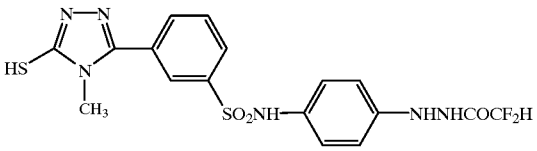
H-49
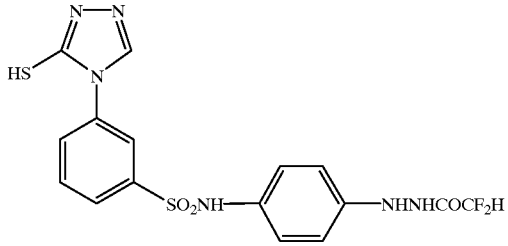
H-50
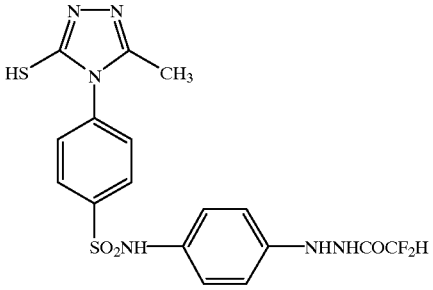
H-51
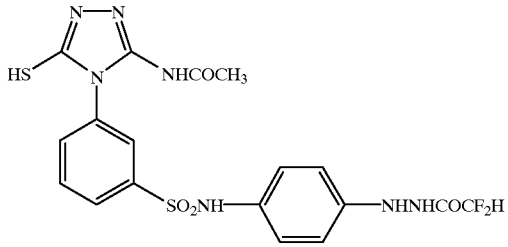
H-52
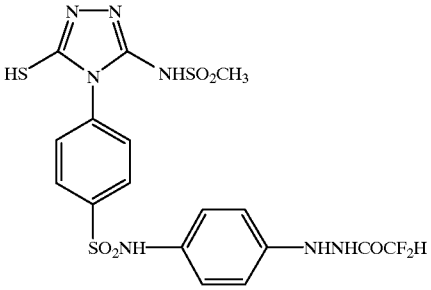
H-53
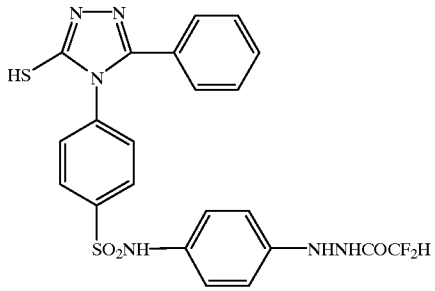
H-54
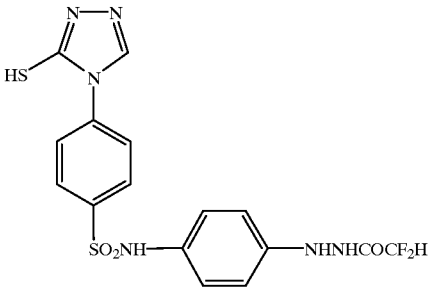
H-55
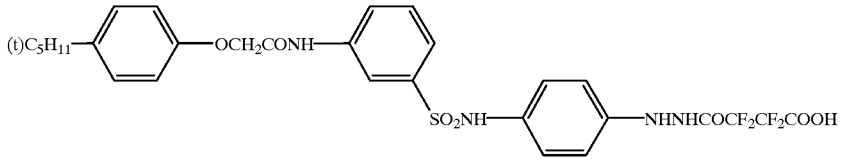

-continued

H-56

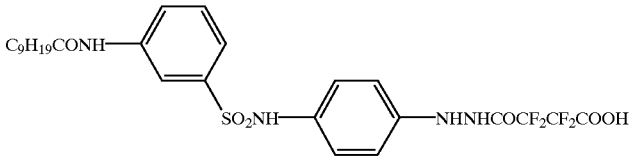

H-57

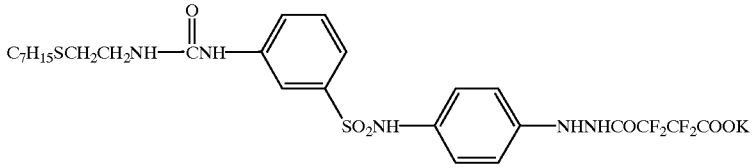

H-58

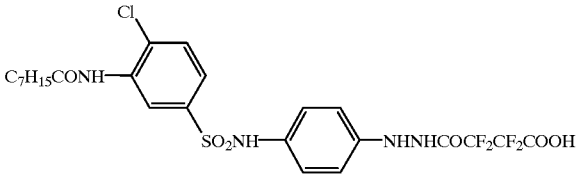

H-59

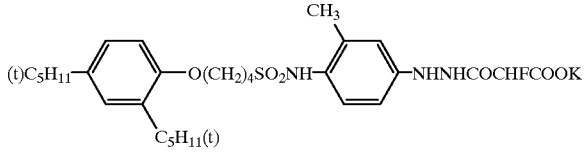

H-60

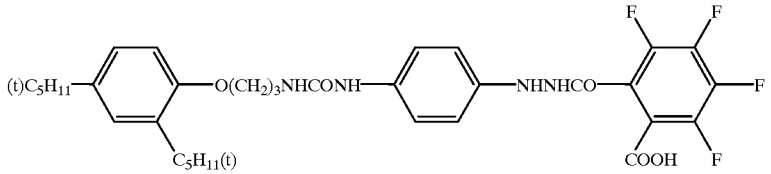

H-61

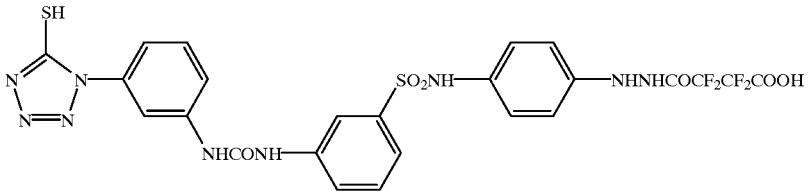

H-62

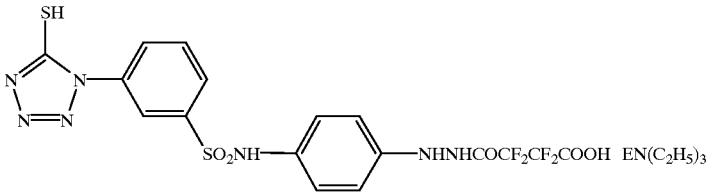

H-63

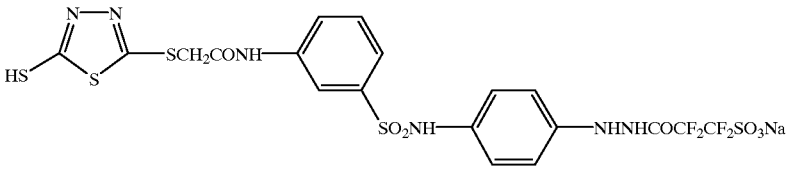

As other specific examples of hydrazine compounds, for example, those Exemplified Compounds (1) through (252) disclosed on columns 4 through 60 of U.S. Pat. No. 5,229,248 can be mentioned.

The hydrazine compounds according to the present invention can be synthesized according to the conventionally known methods in the art. For example, they may be synthesized according to the method disclosed on columns 59 through 80 in the U.S. Pat. No. 5,229,248.

An adding amount of the hydrazine derivative may be optional if it is one capable of hardening the light-sensitive photographic material according to the present invention, and the optimum amount of addition may be varied depending on the grain size of the silver halide particles, halide composition, degree of chemical ripening and kind of restraining agent, etc.; however, it is generally between $10^{-6}$ and $10^{-1}$ mol, and, more preferably, between $10^{-5}$ and $10^{-2}$ mol per one mol of silver halide. Hydrazine compounds are incorporated into at least a layer on emulsion-side, preferably a silver halide emulsion layer and/or its adjacent layer, and more preferably a silver halide emulsion layer. The hydrazine content in a layer closest to the support among hydrazine-containing layer(s) is preferably 0.2 to 0.8 mol equivalent, and more preferably 0.4 to 0.6 mol equivalent, based on the total hydrazine content in the whole photographic component layers. The hydrazine compounds are used alone or in combination.

In cases where the photographic material to be processed contains the nucleating agent described above, it is preferred to use a nucleation-promoting agent. Examples thereof include exemplary compounds (2-1) through (2-1) described in JP-A 6-258751, compounds (3-1) through (3–6) described in JP-A 6-258751, onium compounds described in JP-A 7-270957, compounds represented by general formula I described in JP-A 7-104420, and thiosulfonic acid compounds described in JP-A 2-103536, page 17, right lower column line 19 to page 18, right upper column, line 4, and page 18, lower right column line 1–5, and JP-A 1-237538. The nucleation-promoting agent may be incorporated into any layer of photographic component layers on emulsion-side, and preferably into a silver halide emulsion layer or its adjacent layer. The amount to be incorporated, depending of the grain size, halide composition, the extent of chemical sensitization of silver halide grains and the kind of a restraining agent, is preferably $10^{-6}$ to $10^{-1}$ mol, and more preferably $10^{-5}$ to $10^{-2}$ mol per mol of silver halide.

The compound represented by formula (A) will be described.

In formula (A), $R_1$ and $R_2$ are each a substituted or unsubstituted alkyl group, a substituted or unsubstituted amino group, a substituted or unsubstituted alkoxy group, or a substituted or unsubstituted alkylthio group, provided that $R_1$ and $R_2$ may combine together with each other to form a ring.

In formula (A), $R_1$ and $R_2$ combine together with each other to form a ring, and the resulting compound represented by the following formula (A-a) is specifically preferred:

formula (A-a)

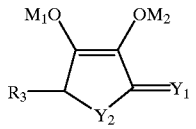

wherein $R_3$ is a hydrogen atom, substituted or unsubstituted alkyl group, substituted or unsubstituted aryl group, substituted or unsubstituted amino group, substituted or unsubstituted alkoxy group, sulfo group, carboxy group, amido group or sulfonamido group; $Y^1$ is O or S; $Y^2$ is O, S or $NR_4$, in which $R_4$ is substituted or unsubstituted alkyl group or substituted or unsubstituted aryl group; and $M_1$ and $M_2$ each are a hydrogen atom or alkali metal atom.

As the alkyl group of formula (A) and formula (A-a) is preferred a lower alkyl group, such as an alkyl group having 1 to 5 carbon atoms; the amino group is preferably unsubstituted amino group or amino group substituted by a lower alkoxy group; the alkoxy group is preferably a lower alkoxy group; the aryl group is preferably a phenyl group or naphthyl group. The foregoing groups may be substituted and examples of preferred substituent groups include a hydroxy group, halogen atom, alkoxy group, sulfo group, carboxy group, amido group, and sulfonamido group. $M_1$ and $M_2$ each are a hydrogen atom or alkali metal atom, preferably sodium or potassium atom.

Exemplary examples of the compound represented by formulas A) and (A-a) are shown below, but the compounds are not limited thereto.

Formula (A)

| Compound No. | X | $R_1$ | $R_2$ | $M_1$ | $M_2$ |
|---|---|---|---|---|---|
| A-1 | - (k=0) | $HOCH_2-CH(OH)-CH(OH)-$ | —OH | H | H |
| A-2 | - (k=0) | $CH_3-CH(OH)-CH(OH)-$ | —OH | H | H |
| A-3 | - (k=0) | $HOCH_2-CH(OH)-CH(OH)-$ | $-CH_3$ | H | H |
| A-4 | - (k=0) | $CH_3-CH(OH)-CH(OH)-$ | $-CH_3$ | H | H |
| A-5 | $-\overset{O}{\overset{\|\|}{C}}-$ (k=1) | $HOCH_2-CH(OH)-CH(OH)-$ | —OH | H | H |
| A-6 | $-\overset{O}{\overset{\|\|}{C}}-$ (k=1) | $CH_3-CH(OH)-CH(OH)-$ | —OH | H | H |

-continued

| | | | | | | |
|---|---|---|---|---|---|---|
| A-7 | $-\overset{\overset{S}{\|}}{C}-$ | (k=1) | $HOCH_2-\underset{\underset{OH}{\|}}{CH}-\underset{\underset{OH}{\|}}{CH}-$ | —OH | H | H |
| A-8 | $-\overset{\overset{S}{\|}}{C}-$ | (k=1) | $CH_3-\underset{\underset{OH}{\|}}{CH}-\underset{\underset{OH}{\|}}{CH}-$ | —OH | H | H |
| A-9 | $-\overset{\overset{O}{\|}}{C}-$ | (k=1) | $HO-CH_2-$ | —OH | Na | H |
| A-10 | $-\overset{\overset{O}{\|}}{C}-$ | (k=1) | $HO-CH_2-$ | $-CH_3$ | H | H |
| A-11 | $-\overset{\overset{O}{\|}}{C}-$ | (k=1) | $HO-CH_2-$ | $-C_2H_5$ | H | H |
| A-12 | $-\overset{\overset{O}{\|}}{C}-$ | (k=1) | $HO-CH_2-$ | $-C_2H_4OH$ | H | Na |

Formula (A-a)

| Compound No. | $Y_1$ | $Y_2$ | $R_3$ | $M_1$ | $M_2$ |
|---|---|---|---|---|---|
| A-13 | O | O | H | H | H |
| A-14 | O | O | $CH_3$ | H | H |
| A-15 | O | O | $\underset{\underset{OH}{\|}}{CH_2}$ | H | H |
| A-16 | O | O | $CH_3-\underset{\underset{OH}{\|}}{CH}-$ | H | H |
| A-17 | O | O | $HOCH_2-\underset{\underset{OH}{\|}}{CH}-$ | H | H |
| A-18 | O | O | $HOCH_2-\underset{\underset{OH}{\|}}{CH}-$ | Na | H |
| A-19 | O | O | $HOOCCH_2-\underset{\underset{OH}{\|}}{CH}-$ | H | Na |
| A-20 | S | O | H | Na | H |
| A-21 | S | O | $CH_3-\underset{\underset{OH}{\|}}{CH}-$ | H | H |
| A-22 | S | O | $HOCH_2-\underset{\underset{OH}{\|}}{CH}-$ | H | H |
| A-23 | O | $NCH_3$ | H | H | H |
| A-24 | O | NH | $HOCH_2-\underset{\underset{OH}{\|}}{CH}-$ | H | K |
| A-25 | O | S | H | H | H |

-continued

| | | | | | |
|---|---|---|---|---|---|
| A-26 | O | S | $HOCH_2—CH(OH)—$ | H | H |
| A-27 | O | S | $CH_3—CH(OH)—$ | H | H |
| A-28 | S | S | H | H | H |
| A-29 | S | S | $HOCH_2—CH(OH)—$ | H | H |
| A-30 | S | S | H | H | H |

The content of the compound represented by formula (A) or (A-a) in a developer solution is preferably 20 to 120 g/l.

Of these compounds, representative ones are ascorbic acid, erythorbic acid or salts thereof (e.g., sodium, potassium, lithium etc.), derivatives derived therefrom, which are commercially available and readily synthesized by well known methods.

The developing agent represented by formula (A) is used preferably in combination with a developing agent such as 3-pyrazolidones (e.g., 1-phenyl-3-pyrazolidne, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone), aminophenols (e.g., o-aminophenol, p-aminophenol, N-methyl-o-aminophenol, N-methylp-aminophenol, 2,4-diaminophenol) or hydrophilic group-substituted dihydroxybenzenes (e.g., hydroquinone monosulfonate, sodium hydroquinonemonosulfonate, potassium 2,5-hydroquinonedisulfonate). Specifically, a combination of ascorbic acid or its derivatives and 3-pyrazolidones, or a combination of ascorbic acid or its derivatives, 3-pyrazolidones and dihydroxybebzenes substituted with a hydrophilic group is preferred. In cases where used in combination, developing agents such as 3-pyrazolidones, aminophenols or hydrophilic group-substituted dihydroxybebzenes are used preferably in an amount of not less than 0.01 mole and less than 0.2 mole per lit. of developing solution.

Commonly known various types of light sources are employed in the processing method of silver halide photographic materials in this invention. For example, there are employed laser light sources such as He—Ne laser, LED, infrared semiconductor laser, red semiconductor laser and Ar laser. Specifically, extremely short period exposure resulted in marked effects of this invention.

Halide composition of silver halide grains contained in a silver halide emulsion of the photographic material is not specifically limited. In cases where subjected to processing at a low replenishing rate or subjected to rapid processing, a silver halide emulsion is preferred, comprising silver chloride, silver bromochloride containing 50 to 1000 mol % chloride or silver iodobromochloride containing 60 to 90 mol % chloride.

The average grain size of the silver halide is preferably 1.2 $\mu$m or less, and, more preferably 0.1 to 0.3 $\mu$m. The term "average grain size" has been used commonly in the art. The term "grain size" usually refers to a diameter of the grain, when the grain is of spherical shape or in the form close thereto. In the case when the grain is a cubic shape, it means a diameter of a sphere when the cube is converted into a sphere having the equivalent volume. With regard to the method of obtaining the average diameter, one can refer to the disclosure on pages 36–43, third edition of C. E. K. Mees and T. H. James "The theory of the Photographic Process", pages 36–43, Macmillan Co. (1966).

There is no limitation as to the shape of the silver halide grain, and any one of tabular, cubic, spherical, tetradecahedral or octahedral shape can optionally be used. Concerning grain size distribution, the narrower, the more preferable. Particularly, so-called mono-dispersed emulsion, in which not less than 90%, preferably, 95% of the total number of grains fall within the range of the average grain size +40%, is preferable.

The type of reaction of a soluble silver salt with soluble halide in the preparation of a silver halide emulsion may be normal precipitation, double jet precipitation or combination thereof. A method of forming grains in the presence of silver ions in excess (so-called, reversed precipitation) may be applicable. As one of the double jet precipitation, there is used a controlled double jet method in which the pAg of liquid phase is maintained at a given value during the course of grain formation. According to this method, there can be obtained a silver halide emulsion comprised of monodisperse grains with regular crystal form.

At the time of physical ripening or chemical ripening, metal salts of zinc, lead, thallium, iridium, rhodium, ruthenium, osmium, palladium, platinum, etc. can be coexisted. It is often commonly used to incorporate $10^{-8-10-3}$ of iridium per mol silver halide for the purpose of improving high intensity reciprocity law failure characteristics. In the present invention, in order to obtain an emulsion with high contrast, it is preferable for $10^{-9}$ to $10^{-3}$ mol of rhodium, ruthenium, osmium and/or rhenium per mol of silver halide to be incorporated in the silver halide emulsion.

A metal compound may be added in the form of a complex salt, in which the metal is coordinate with a halogen, carbonyl, nitrocyl, thionitrocyl, amine, cyan, thiocyan, ammonia, tellurocyl, selenocyan, dipyridyl, tripyridyl, phenanthroline or a combination thereof. The oxidation state of the metal may be optionally selected within the range of the minimum level to the maximum level. As preferred ligands are cited hexa-dentated ligands described in JP-A 2-2082, 2-20853, 2-20854 and 2-20855; alkali metal salts include a sodium salt, potassium salt and cesium salt and primary secondary and tertiary amines are also cited. A transition metal complex salt may be formed in the form of an aquo-complex. Examples thereof include $K_2[RuCl_6]$, $(NH_4)_2[RuCl_6]$, $K_2$ $Ru(NOCl_4(SCN))$, and $K_2[RuCl_5(H_2O)]$. Ru may be replaced by Rh, Os, Re, Ir, Pd or Pt. It is preferable that rhodium, ruthenium, osmium and/or rhenium compound is added during the time of forming silver halide grains. Addition thereof may be optional, including a method of distributing uniformly inside the grain and a method of localizing in the core or shell portion of core/shell-structure grains. Often, better results are obtained in the case when they are made present in the shell portion. Further, in the case when they are made present in a discrete layer structure, a method in which amount of presence is made greater depending on the distance from the center of the grain, may also be applied. Amount of addition may optionally be selected from the range between $10^{-9}$ and $10^{-3}$ mol per mol of silver halide.

Silver halide emulsions and preparation methods thereof are referred to Research Disclosure 17643 pages 22–23 (December 1973) and the references referred therein.

The silver halide emulsion used in the present invention may or may not be chemically sensitized. As method of chemical sensitization, sulfur sensitization, selenium sensitization, tellurium sensitization, reduction sensitization and noble metal sensitization have been well known in the art, and these methods may be used either singly or in combination. As a sulfur sensitizer, conventionally known sulfur sensitizers may be used. Preferable sulfur sensitizers include, besides sulfur compounds contained in gelatin, various sulfur compounds, for example, thiosulfates, thio ureas, rhodanines, polysulfide compounds, etc. can be used. As selenium sensitizers, known selenium sensitizers may be used. For example, those compounds disclosed in U.S. Pat. No. 1,623,499, JP-A 50-71325 and 60-150046 may preferably be used.

In the photographic material used in the invention can comprise a variety of compounds for the purpose of preventing fog during manufacture, storage or photographic processing of the light-sensitive material. Those compounds include compounds which are known as stabilizers or antifoggants in the art. For example, azoles such as benzthiazolium salts, nitroindazoles, chlorobenzimidazoles, bromobenzimidazoles, mercaptothiazoles, mercaptobenzthiazoles, mercaptobenzimidazoles, mercaptobenzthiadiazoles, aminotriazoles, benztriazoles, nitrobenztriazoles, mercaptotetrazoles, such as 1-phenyl-5-mercaptotetrazole, etc.; mercaptopyrimidines, mercaptotriazines, thioketo compounds such as oxazolinethione; azaindenes such as triazaindenes, tetrazaindenes including 4-hydroxy-substituted 1,3,3a,7-tetrazaindenes, pentazaindenes, etc., benzenethiosulfonic acid, benzenesulfinic acid, benzenesulfonic acid amide, etc. can be mentioned.

As binder or a protective colloid of the photographic emulsion used in the present invention, gelatin is advantageously used, however, other hydrophilic colloids may also be used. The hydrophilic colloids include, for example, gelatin derivatives, graft polymers comprised of gelatin and other polymers; proteins such as casein, albumin, etc.; cellulose derivatives such as hydroxyethyl cellulose, carboxymethyl cellulose, cellulose sulfates, etc.; sugar derivatives such as sodium alginate, starch derivatives, etc.; synthetic hydrophilic polymers such as polyvinyl alcohol and partial acetal thereof, poly-N-pyrrolidone, polyacrylic acid, polymethacrylic acid, polyacrylamide, polyvinyl imidazole, polyvinyl pyrazole, etc. These polymers may be either homopolymers or copolymers. As gelatin, there may be usable an acid process gelatin as well as lime-processed gelatin. Further, hydrolytic products or enzyme decomposition products of gelatin may also be used. Polysaccharides such as dextrans and dextrins described in JP-A 9-304855 may also be used to enhance rapid processablity.

In the photographic emulsion used in the present invention, for the purpose of improving dimensional stability, etc., synthetic polymers which are water-insoluble, or sparingly water-soluble can be incorporated. For example, alkyl(metha)acrylates, alkoxy(metha)acrylates, glycidyl(metha)acrylates, (metha)acrylamides, vinyl esters such as vinyl acetate, acrylonitrile, styrene, etc. may be used either singly or in combination. Further, these polymers may be used in the form of a copolymer together with other monomer constituents such as acrylic acid, methacrylic acid, α,β-unsaturated dicarboxylic acid, hydroxylalkyl(metha) acrylate, sulfoalkyl(metha)acrylate, styrene sulfonic acid, etc.

The swelling percentage of the light sensitive silver halide emulsion layer side is referred to as an increase in swelling layer thickness of the emulsion layer coating side of a photographic material after the photographic material is immersed into water at 25° C. and allowed to stand for 3 min. Thus, the swelling percentage is defined as follows:

$$[(\text{swelling thickness-coating thickness})/(\text{coating thickness})]\times 100\ (\%)$$

In the processing method of silver halide photographic materials of this invention, the swelling percentage of the emulsion layer side is preferably 10 to 100%, more preferably 20 to 70%, and still more preferably 20 to 50%.

There are employed various hardeners to adjust swelling of the photographic material used in this invention. Thus, an inorganic or organic hardeners are incorporated as a cross-linking agent for hydrophilic colloidal material such as gelatin into an emulsion or a light-insensitive hydrophilic colloid layer to adjust the swelling percentage of the emulsion layer side. Examples of preferred hardeners include chromium salts (chrome alum, chrome acetate etc.), aldehydes (formaldehyde, glutar aldehyde, glyoxal etc.), N-methylol compounds (dimethylol urea, dimethylol dimethylhydantoin etc.), dioxane derives (2,3-dihydroxydioxane), active vinyl compounds (1,3,5-triacryloyl-hexahydro-s-triazine, bis)vinylsulfonyl)methyl ether, N,N-methylenebis-[β-(vinylsulfonyl)propioneamide], etc.), active halogen compounds (2,4-dichloro-6-hydroxy-s-triazine, etc.), mucohalogenic acids (mucochloric acid, phenoxymucochloric acid, etc.)isooxazoles, dialdehyde starch, 2-chloro-6-hydroxytriazinyl gelatin, and carbonyl group-activating type hardeners, singly or in combination thereof. These hardeners are described in Research Disclosure Vol. 176, item 17643 (Dec., 1978), page 26, section A–C.

Various additives are further employed in the photographic material relating to the invention, including a desensitizer, plasticizer, lubricant, development accelerating agent and oil.

A support used in the present invention may be a transparent or nontransparent one, and a transparent plastic resin support is preferred for the purpose of the invention. As the plastic resin support may be employed a support comprising a polyethylene compound (e.g., polyethylene terephthalate, polyethylene naphthalate), a triacetate compound (e.g., triacetate cellulose), or polystyrene compound.

The thickness of the support is preferably 50 to 250 μm and more preferably 70 to 200 μm. To make improvements in roll set curl, it is preferred to subject to heat treatment after casting of base. The treatment is most preferably after casting of base and before emulsion coating, but it may be made after emulsion coating. The condition for the heat treatment at a temperature of not lower than 45° C. and not higher than a glass transition temperature and over a period of one second to ten days is preferred. From the point of productivity is preferred a period within one hour.

In this invention, the following compounds are preferably contained in a silver halide photographic light sensitive material.

(1) Dye in the form of a fine solid particle dispersion:

Compounds described in JP-A 7-5629 page 3, [0017] to page 16 [0042].

(2) Compound having an acidic group:

Compounds described in JP-A 62-237445 page 3, left lower column line 11 to page 25, right lower column line 3.

(3) Acidic polymer:

Compounds described in JP-A 6-186659 page 10, [0036] to page 17 [0062].

(4) Supersensitizer:

Compounds described in JP-A 6-347938 page 3, [0011] to page 16 [0066].

(5) Nucleation promoting agent:

Compounds described in JP-A 7-114126 page 32 [0158] to page 36 [0169].

(6) Tetrazolium compound:

Compounds described in JP-A 6-208188 page 8 [0059] to page 10 [0067].

(7) Pyridinium compound:

Compounds described in JP-A 7-110556 page 5 [0028] to page 29 [0068].

(8) Redox compound:

Compounds described in JP-A 4-245243 page 7 to page 22.

(9) SPS support:

Supports described in JP-A 3-54551.

The above described additives and other known additives are referred to Research Disclosure No. 17643 (December, 1978) pages 23 to 29; ibid No. 18716 (November, 1979) pages 648 to 651; ibid No. 308119 (December, 1989) pages 996 to 1009.

Photographic materials used in the invention are processed preferably with an automatic processor having at least four processes of developing, fixing, washing (or stabilizing) and drying.

One feature of this invention concerns the use of the compound of formula (A) earlier described, as a developing agent.

To the developing solution may optionally be added various additives including, for example, an alkali agents such as sodium hydroxide, potassium hydroxide, etc,; pH buffers such as carbonates, phosphates, borates, boric acid acetic acid, citric acid, alkanolamine, etc. A preferred pH buffer is a carbonate in an amount of 0.4 to 1.0 mol/l (and more preferably 0.4 to 0.8 mol/l).

In cases where the compound of formula (A) is used as a developing agent, sulfites are preferably used as a preservative in an amount of 0.02 to 0.9 mol/l (and more preferably 0.1 to 0.3 mol/l).

There are optionally employed solubilizing aids such as polyethylene glycols, esters thereof, alkanolamine, etc.; sensitizers such as nonionic surface active agents containing a polyoxyethylene, quarternary ammonium compounds, etc.; surface active agents, antifoaming agents, anti-foggants such as halide compounds such as potassium bromide, sodium bromide,etc.;nitrobenzindazole, nitrobenzimidazole, benztriazole, benzthiazole, tetrazole compounds, thiazole compounds, etc.; chelating agents such as ethylenediaminetetraacetic acid or alkali salts thereof, nitrilotriacetic acid, polyphosphonic acids, etc.; development accelerators such as those compounds disclosed in the U.S. Pat. No. 2,304,025, JP-B 47-45541(hereinafter, the term, JP-B means published Japanese Patent); hardening agents such as glutaraldehyde or metasulfite additives thereof, etc.; anti-foaming agents, etc. The pH of the developing solution is preferably adjusted not less than 7.5 and less than 10.5. More preferably the pH is adjusted not less than 8.5 and less than 10.4. The pH of a developer replenishing solution is preferably higher by 0 to 0.5 (more preferably 0.05 to 0.5, and more preferably 0.1 to 0.5) than that of a developer solution at the start of development. The use of a developer solution exhibiting a pH higher by 0 to 0.5 than that the starting developer solution.

As a fixing solution, any one which are popularly known in the art can be used. The fixing solution is an aqueous solution containing a fixing agent and other additives, and the pH of the fixing solution is usually between 3.8 and 5.8. As the fixing agent, for example, thiocyanates such as sodium thiosulfate, potassium thiosulfate, ammonium thiosulfate, sodium thiocyanate, potassium thiocyanate, ammonium thiocyanate and other organic sulfur compounds which are capable of producing a stable silver complex salts and are known in the art as a fixing agent can be used.

A compound which functions as a hardening agent, including, for example, water-soluble aluminum salts such as aluminum chloride, aluminum sulfate, potassium alum, aldehyde compounds (such as glutar aldehyde or its sulfite adduct, etc.) may be added into the fixing solution.

The fixing solution may contain, if necessary, preservatives such as sulfites or metasulfites; pH buffers such as acetic acid, citric acid, etc.; pH adjuster such as sulfuric acid, or chelating agents capable of softening hard water, etc. It is preferable that the concentration of ammonium ion in the fixing solution is 0.1 mol or less per liter of the fixing solution. Particularly preferable concentration of the ammonium ion in the fixing solution is between 0 and 0.5 mol per liter of fixing solution. As the fixing agent, sodium thiosulfate may be used instead of ammonium thiosulfate. They can also be used in combination. It is preferable that concentration of acetate ion is less than 0.33/liter. There may be applicable any compounds capable of releasing an acetate ion in the fixing solution. Acetic acid or a lithium, potassium, sodium or ammonium salt thereof are preferable. Particularly preferable are sodium salt and ammonium salt. The concentration of the acetate ion is preferably 0.22 mol or less, and more preferably, 0.13 mol or less per liter of the fixing solution.

Under this condition generation of acetic acid gas can be highly restrained. Most advantageously, the fixing solution does not substantially contain any acetate ion at all. The fixing agent contains a salt of citric acid, tartaric acid, malic acid, succinic acid or an optical isomer thereof. As the salt of the citric acid, tartaric acid, malic acid or succinic acid, lithium salt, potassium salt, sodium salt, ammonium salt, etc. can be mentioned. Further, lithium hydrogen salt, potassium hydrogen salt, sodium hydrogen salt, or ammonium hydrogen salt of the tartaric acid; ammonium potassium tartarate; or sodium potassium tartarate, etc. may also be used. Among these, are preferable citric acid, isocitric acid, malic acid and succinic acid and the salts thereof; and the most preferable compound id malic acid or salts thereof.

Photographic materials used in the invention is preferably subjected to washing with washing water containing a cleaning agent including an oxidant or fungicide. Examples of oxidants include metal or non-metal oxides, oxygen acids or their salts, peroxides, and organic acids. From the point of view of the discharge to a drain line are preferred oxygen acids such as sulfuric acid, nitrous acid, nitric acid or hypochlorous acid, and peroxides such as hydrogen peroxide or Fenton's acid. Hydrogen peroxide is specifically preferred. From the point of view of physical distribution, it is preferred to supply the oxidants in the form of a concentrated solution or solid composition. The form of a concentrated solution is specifically preferred and its oxidant content is preferably 0.1 to 10 mol/l, and more preferably 0.5 to 2.0 mol/l. A concentrated solution or solid composition containing an oxidant is mixed with washing water and then supplied. The concentrated solution or solid composition may be mixed immediately before being introduced into a washing bath or may be mixed directly with washing water in a washing bath. With regard to the timing of replenishing the concentrated solution or solid composition containing an oxidant or water may be a constant replenishment per unit time or replenishment in which the processing amount of photographic materials is detected and replenishing is made in accordance with the processing amount. The addition amount of an oxidant to a washing bath is preferably 0.5 to 10 mol, and more preferably 0.5 to 3 mol equivalent with respect to thiosulfate carried-in by the photographic material.

It is a preferred embodiment to allow a preservative or fungicide to be concurrently present with an oxidant. Fungicides usable in the invention may be any one having no adverse effect on photographic performance. Examples of various bactericides and fungicides include thiazolylbenzimidazole type compounds, isothiazolone type compounds, chlorophenol type compounds, bromophenol type compounds, thicyanic acid or isothiocyanic acid type compounds, acid azide type compounds, diazine or tiazine type compounds, thiourea type compounds, alkylguanidine compounds, quaternary ammonium salts, organic tin or organic zinc compounds, cyclohexylphenol compounds, imidazole or benzimidazole type compounds, sulfamide type compounds, active halogen type compounds such as sodium chloroisocyanurate, chelating agents, sulfite compounds, antibiotic substances such as penicillin. Further, there are usable compounds described in L. E. West, "Water Quality Criteria" Phot. Sci. and Eng., vol. 9 No. 6 (1965); bactericides described in JP-A 57-8542, 58-105145, 59126533, 55-111942 and 57-157244; and compounds described in H. Hamaguchi "Chemistry of Bactericide and fungicide" (published by Sankyo-shuppan, 1982) and "Antifungal and Antimold Technique Handbook" edited by Nihon Bokin-bobai Gakkai (published by Gihodo, 1986).

Examples thereof are shown below but are not limited to these:

1. 5-chloro-2-methyl-4-isothiazoline-3-one
2. 2-(4-thiazolyl)-benzimidazole
3. methyl isothianate
4. 3,5-dichloro-4'-fluoro-thiocarbanilide
5. 4-chloro-3,5-dimethylphenol
6. 2,4,6-trichlorophenol
7. sodium dehydroacetate
8. sulfanilamide
9. 3,4,5-tribromosalicylanilide
10. potassium sorbate
11. benzalconium chloride
12. 1-bromo-3-chloro-5,5-dimethylhydantoin
13. monochloroacetoamide
14. monobromoacetoamide
15. monoiodoacetoamide
16. benzimidazole
17. cyclohexylphenol
18. 2-octyl-isothiazoline-3-one
19. ethylenediaminetetraacetic acid
20. nitrilo-N,N,N-trimethinephosphonic acid
21. 1-hydroxyethane-1,1-diphosphonic acid
22. ethylenediamine-N,N,N',N'-tetramethylenephosphonic acid
23. sodium chlorinated isocyanurate
24. 2-methyl-4-isothiazoline-3-one
25. 10, 10'-oxybisphenoxyarsine
26. 1,2-benzisothiazoline-3-one
27. thiosalicylic acid These compounds are described in U.S. Pat. Nos. 2,767,72, 2,767,173, 2,767,174 and 2,870,015; British Patent No. 848,130; and French Patent No. 1,555,416, with respect to their synthesis and application to other fields. Commercially available products include, for example, PREDENTOL ON, PERMACHEM PD, TOP-SIDE 800, TOP-SIDE EG5, TOP-SIDE 600 (all of which are available from Permachem Asia Co.), FINE-SIDE J-700 (which is available from Tokyo Fine Chemical Co., ltd.) and Prozel GXL (which is available from I.C.I co.).

In cases where the fungicide is supplied to washing water, the content thereof is preferably 0.01 to 50 g/l, and more preferably 0.05 to 20 g/l. In cases where being contained in a cleaning agent, the content is 0.1 to 50 g/l, and more preferably 1 to 20 g/l, with respect to the cleaning agent.

Preferred as a preservative is a compound including a polyalkleneoxide chain, which is represented by the following formula (Po):

formula (Po)

$$HO\ (C_2H_4O)_a—(C_3H_6O)_b—(C_2H_4O)_cH$$

where a, b and c each are a positive integer. The compound represented by formula (Po) is a compound in which propylene glycol is added as a hydrophobic group to ethylenoxide. The average molecular weight (also denoted as Av. M.W.) and the molecular weight of polypropylene glycol (also denoted as PPG M.W.) are preferably 2000 to 8500 and 1400 to 2400, respectively; and the ethylene oxide content of the molecule is preferably 40 to 85% by weight. Specifically, it is preferred that in the formula, a+b is ca. 150 and c is ca. 30. Such compound are also commercially available, for example, as "Pluronic Series" nonionic surfactans (produced by ASAHI DENKA Co., Ltd.), as shown below.

TABLE 1

| Compound No. | Trade Name | Av. M.W. | PPG M.W. | Ethylene Oxide Content |
|---|---|---|---|---|
| 1 | Pluronic L44 | 2,200 | 1,200 | 40 |
| 2 | Pluronic L62 | 2,500 | 1,750 | 20 |
| 3 | Pluronic L64 | 2,900 | 1,750 | 40 |
| 4 | Pluronic F68 | 8,350 | 1,750 | 80 |
| 5 | Pluronic F68LF | 7,700 | 1,750 | 80 |

The foregoing compound containing a poly(alkylene oxide) chain is preferably incorporated to washing water in an amount of 1 to 1000 ppm, and more preferably 10 to 100 ppm; and in cases when contained as a cleaning agent, the amount is 0.01 to 10%, and 0.1 to 5%, based on an oxidizing agent.

Examples of preservatives usable in the invention further include phosphoric acid, barbituric acid, urea, acetoanilide, oxyquinoline, salicylic acid, quinolinic acid, and their derivatives and salts. Of these, salicylic acid and its derivatives are preferred.

Chelating agents usable in the invention preferably are those which exhibit a chelate stability constant with a calcium ion of 0.8 to 5.0. The chelate stability constant with a calcium ion is the logarithm of a formation constant of one chelating agent molecule with one calcium ion, which is measured under the condition at a temperature of 20° C. and an ionic strength of 0.2. Examples thereof include organic acids such as maleic acid, glycolic acid, gluconic acid, glucoheptanoic acid, tartaric acid, citric acid, succinic acid, salicylic acid, ascorbic acid and erythorbic acid; aminopolycarboxylic acids such as glycine, ethylenediaminetetraacetic acid, diethylenetriaminepentaacetic acid and nitrilitriacetic acid, and their derivatives and salts. Organic acids are preferably gluconic acid and citric acid, and preferred aminopolycarboxylic acids are ethylenediaminetetraacetic acid and diethylenetriaminopentaacetic acid. These compound are used preferably in an amount of 0.005 to 0.2 mol, and more preferably 0.005 to 0.1 mol per lit of washing water.

In the invention, there can be employed developer or fixer replenishing solution which is prepared from a solid processing (i.e., developer or fixer) composition. The solid processing composition is in the form of powder, a tablet or granule, which are optionally subjected to a moisture-proofing treatment. A processing composition in the form of a paste or slurry is a semi-liquid form and inferior in storage stability. Those which are accompanied with danger in transportation and is subject to limitation are not included in the solid processing composition used in the invention. Herein, the powder refers to an aggregate of microcrystalline particles, the granules refers to granular material obtained by subjecting the powder to a granulating treatment, having a grain size of 50 to 500 $\mu$m, and the tablet refers to one obtained by subjecting the powder to granules to compression treatment to make a given form. Of solid processing compositions described above, the composition in a tablet form is preferably used in terms of the accuracy of replenishment and simplicity in handling.

Next, solidification of the processing composition will be described. The processing composition can be solidified in such a manner that the processing composition in the form of a concentrated solution, fine powder or granules is mixed with a water soluble bonding agent and then the mixture is molded, or the water soluble bonding agent is sprayed on the surface of temporarily-molded processing composition to form a covering layer.

A preferred tablet-making process is to form a tablet by compression-molding after granulating powdery processing composition. As compared to a solid composition prepared simply by mixing the processing composition to form a table, there is an advantage that improvements in solubility and storage stability were achieved and as a result, the photographic performance becomes stable.

As for granulation process which is carried out prior to tablet-making process, any conventionally known method such as fluidized-bed granulation process, extrusion granulation process, compression granulation process, crush granulation process, fluid layer granulation process, and spray-dry granulation process can be employed. It is preferred that the average grain size of the granules is 100 to 800 $\mu$m and preferably 200 to 750 $\mu$m. In particular, 60% or more of the granules is with a deviation of ±100 to 150 $\mu$m. When the grain size smaller, it tends to cause localization of mixing elements and therefore, is undesirable. As hydraulic press machine, any conventional compression molding machine, such as a single-engined compression molding machine, rotary-type compression machine, briquetting machine, etc. may be employed to form a tablet. Compression-molded (compression-tableted) solid processing composition may take any form and is preferably in a cylindrical form from the point of productivity, handleability and problems of powder dust in cases when used in user-side. It is further preferred to granulate separately each component, such as an alkali agent, reducing agent and preservative in the above process.

The processing composition in the form of a tablet can be prepared according to methods, as described in JP-A 51–61837, 54-155038, 52-88025, and British Patent 1,213,808. The granular processing composition can also be prepared according to methods. as described in JP-A 2-109042, 2-109043, 3-39735 and 3-39739. The powdery processing composition can be prepared according to methods, as described in JP-A 54-133332, British Patent 725,892 and 729,862 and German Patent 3,733,861.

In cases where the solid processing composition of the invention, its bulk density is preferably 1.0 to 2.5 g/cm$^3$ from the viewpoint of solubility and the point of effects of the invention. When being not less than 1.0 g/cm$^3$, it is advantageous for strength of the solid composition; and when being not more than 2.5 g/cm$^3$, it is advantageous for solubility. In cases where the composition in the form of granules or powder, the bulk density is preferably 0.40 to 0.95 g/cm$^3$.

The solid processing composition is used at least for a developer or fixer but also usable for other photographic processing chemicals such as a rinsing agent. To overcome the hazardous liquid regulations, a developer or fixer is preferred. All of processing chemicals are most preferably solid composition, but at least developer and fixer preferably are solid compositions A processing chemical having at least a part solidified and a solid processing chemical each applicable to the invention are included in the scope of the invention. It is, however, preferable that the whole component of these processing chemicals are solidified. It is also preferable that the components thereof are each molded into a separate solid processing chemical and then individually packed in the same form. It is further preferable that the components are packed in series in the order of periodically and repeatedly adding them from the packages.

In cases where the developer is solidified, it is preferable to solidify all of an alkali agent, a developing agent and a reducer and when a developer is tableted, the numbers of the tablets may be not more than 3 tablets and, preferably, a single tablet. When the solid processing chemicals are solidified separately into not less than 2 tablets, it is preferable to pack these plural tablets or granules in the same package.

In cases where the fixer is solidified, it is preferable to solidify all of a fixing agent, a preservative and a hardener such as aluminum salts and when a fixer is tableted, the numbers of the tablets may be not more than 3 tablets and, preferably, a single tablet. When the solid processing chemicals are solidified separately into not less than 2 tablets, it is preferable to pack these plural tablets or granules in the same package. It is specifically preferable to solidify the aluminum salt in terms of its handling.

A moisture-proofed package for tablets or pills may be embodied of such a raw material as given below. As for a synthetic resin material, any one of the following materials may be used; namely, polyethylene (including any one prepared in either a high-pressure method or a low-pressure method), polypropylene (either non-stretched or stretched), polyvinyl chloride, polyvinyl acetate, Nylon (either stretched or non-stretched), polyvinylidene chloride, polystyrene, polycarbonate, Vinylon, Evarl, polyethylene terephthalate (PET), other polyesters, rubber hydrochloride, an acrylonitrile-butadiene copolymer and an epoxy-phosphoric acid type resin (a polymer described in JP-A Nos. 63-63037 and 57-32952), or pulp.

The films of the above-given materials are usually made adhered to each other so as to be laminated. However, these materials may also be formed into a coated layer.

It is further preferable to provide a gas-barrier layer thereto. For example, an aluminium foil or an aluminium vacuum-evaporated synthetic resin is sandwiched between the above-mentioned synthetic resin films.

A total oxygen permeability of the above-mentioned laminated layers is, preferably, not higher than 50 ml/m$^2$ 24 hr/atm (at 20° C. and 65% RH) and, more preferably, not higher than 30 ml/m$^2$ 24 hr/atm.

A total thickness of the above-mentioned laminated layers is within the range of, preferably 1 to 2000 $\mu$m, more preferably 10 to 1000 $\mu$m and, further preferably 50 to 1000 $\mu$m.

The above-mentioned synthetic resin films may be comprised of a single (macromolecular) resin layer or not less than 2 laminated (macromolecular) resin layers.

When packing, binding or covering a processing chemical by making use of a water-soluble film or a binder, the water-soluble film or a binder each preferably applicable thereto include, for example, those comprising a basic material of a polyvinyl alcohol type, methyl cellulose type, polyethylene oxide type, starch type, polyvinyl pyrrolidone type, hydroxypropyl cellulose type, pullulan type, dextran type, gum arabic type, polyvinyl acetate type, hydroxyethyl cellulose type, carboxyethyl cellulose type, sodium carboxymethyl hydroxyethyl cellulose type, poly(alkyl) oxazoline type and polyethylene glycol type. Among them, those of a polyvinyl alcohol type and a pullulan type can more preferably be used from the viewpoint of the covering or binding effect.

From the viewpoints of the preservability of a solid processing chemical, the dissolving time of a water-soluble film and the crystal deposition in an automatic processor, the layer thickness of the water-soluble film is to be within the range of, preferably 10 to 120$\mu$, more preferably 15 to 80$\mu$, and still more preferably 20 to 60$\mu$.

The water-soluble films are preferable to be thermoplastic, because a heat-sealing or supersonic fusing treatment can readily be performed and a covering effect can more excellently be displayed.

The tensile strength of a water-soluble film is to be within the range of, preferably $0.5\times10^6$ to $50\times10^6$ kg/m$^2$, more preferably $1\times10^6$ to $25\times10^6$ kg/m$^2$ and, particularly $1.5\times10^6$ to $10\times10^6$ kg/m$^2$. The tensile strength is measured in the method specified in JIS Z-1521.

A photographic processing chemical packed, bound or covered by a water-soluble film or a binder is preferable to be packed in a moisture-resistive packaging material so as to be protected from a high moisture, a moisture in the air such as rain and mist, and an accidental damage produced by bringing the package into contacting with water by scattering water or by wet hand in the course of storing, transporting or handling the package. The moisture-resistive packaging materials include preferably a film having a thickness within the range of 10 to 150$\mu$. The material thereof is preferably at least a material selected from the group consisting of a polyolefin film such as those of polyethylene terephthalate, polyethylene and polypropylene, a sheet of craft paper capable of having a moisture-resistive effect displayable with polyethylene, waxed sheet of paper, moisture-resistive cellophane, glassine, polyester, polystyrene, polyvinyl chloride, polyvinylidene chloride, polyamide, polycarbonate, acrylonitrile and a metal foil such as those of aluminium, and a metallo- polymer. They may also be a compounded material of the above-given material.

In an embodiment of the invention, it is also preferable that a moisture-resistive material is made of a decomposable plastic including particularly a biodegradable or photolyzable plastic.

The biodegradable plastics include, for example, (1) those comprising a natural macromolecule, (2) a microbial growing polymer, (3) a synthetic polymer having a good biodegradation property, and (4) a compound of a biodegradable natural macromolecule to a plastic. The photolyzable plastics include, for example, (5) those having a group made present in the principal chain so as to be excited by UV rays and then coupled to a scission. Besides the above-given macromolecules, those having the two functions of a photolyzing and biodegrading properties at the same time may also effectively be used.

The typical and concrete examples thereof may be given as follows:

(1) natural macromolecules, namely,

A polysaccharide, cellulose, polylactic acid, chitin, chitosan, polyamino acid, and the modified thereof;

(2) microbial growing polymers, namely,

"Biopol" comprising PHB-PHV (that is a copolymer of 3-hydroxybutylate and 3-hydroxybarrelate), and microbial growing cellulose;

(3) a synthetic polymer having a good biodegradation property, namely, polyvinyl alcohol, polycaprolactone and the copolymer or mixture thereof;

(4) a compound of a biodegradable natural macromolecule to a plastic, namely, a natural macromolecule having a good biodegradation property such as starch and cellulose, which is added to a plastic so that a configuration decaying property can be provided to the plastic.

(5) photolyzable plastics, namely, those introduced thereinto with a carbonyl group for providing a photodecaying property, and those added thereto with a UV absorbent for accelerating a decaying property.

As for such a decomposable plastics as mentioned above, those publicly described in, for example, "Chemistry and Industry", Vol. 64, No. 10, pp. 478–484, (1990); "The Kino Zairyo", July, 1990 Issue, pp. 23–34; may be used. Besides the above, it is also allowed to use the decomposable plastics available on the market, such as Biopol (manufactured by I.C.I.), Eco (manufactured by Union Carbide Corp.), Ecolite (manufactured by Eco Plastics, Inc.), Ecostar (manufactured by St. Lawrence Starch Co.) and Nackle P (manufactured by Japan-Unicar, Inc.).

The above-mentioned moisture-proofed packaging materials are to have a moisture permeability coefficient of not higher than 10 g·mm/m$^2$·24 hr and, preferably not higher than 5 g·mm/m$^2$·24 hr.

Next, there is described the replenishing method in which the replenishing rate of a processing solution is determined based on the proportion of an exposed area per unit are of the photographic material to be exposed.

In general, a developer solution and a fixer solution are stored in each replenishing apparatus and then replenished in accordance with the processing amount and run time of an automatic processor. In cases where a replenisher is liquid, solution which has been diluted inside or outside of the replenishing apparatus may be stored and replenished.

Alternatively, a concentrated processing solution may be stored and replenished. In cases where the replenisher is solid, a solid processing composition is dissolved in the replenishing apparatus and the resulting replenishing solution is stored therein and replenished.

In the processing method of this invention, a processing solution is replenished at a replenishing rate which is in proportion to an exposed area per unit area of the photographic material. Information of the proportion of an exposed area per unit area of the photographic material is obtained from an exposure output machine such as an image setter or plotter and the obtained information is fed back to a processing solution replenishing apparatus, then, the replenishing rate of a processing solution is adjusted in accordance with the proportion of the exposed area per unit area of the photographic material. Alternatively, the proportion of a developed area per unit area of a processed photographic material is read and information of the developed area proportion is fed back, as a proportion of an exposed area per unit area of the photographic mater, to the replenishing apparatus so that the replenishing rate of the processing solution is adjusted in accordance with the exposed area proportion per unit area of the photographic material.

The replenishing rate of a processing solution may be determined based on the exposed area proportion by any means. In the case of a developer solution in the processing method of this invention, if the exposed area proportion per unit area is the larger, the higher replenishing rate is preferred. In the case of a fixer solution, if the exposed area proportion per unit area is the larger, the lower replenishing rate is preferred. The developer replenishing rate is preferably 30 to 250 ml/m$^2$ and more preferably 30 to 200 ml/m$^2$. The fixer replenishing rate is preferably 40 to 300 ml/m$^2$, and more preferably 30 to 250 ml/m$^2$.

For example, in cases where the exposed area proportion is 5%, the developer replenishing rate is preferably 30 to 200 ml/m$^2$ and the fixer replenishing rate is preferably 120 to 300 ml/m$^2$; in cases where the exposed area proportion is 20%, the developer replenishing rate is preferably 60 to 250 ml/m$^2$ and the fixer replenishing rate is preferably 90 to 300 ml/m$^2$; in cases where the exposed area proportion is 50%, the developer replenishing rate is preferably 100 to 250 ml/m$^2$ and the fixer replenishing rate is preferably 60 to 250 ml/m$^2$; and in cases where the exposed area proportion is 80%, the developer replenishing rate is preferably 150 to 250 ml/m$^2$ and the fixer replenishing rate is preferably 30 to 200 ml/m$^2$.

The developer replenishing rate or the fixer replenishing rate refers to a rate of replenishing a developer or fixer solution which is identical to a developing or fixing bath solution. In cases where a concentrated developer or fixer solution is replenished along with water, the replenishing rate is the sum of the replenished concentrated developer or fixer solution and the replenished water. In cases where a solid developer or fixer composition is dissolved in water and replenished, the replenishing rate is the sum of the volume of the solid developer or fixer composition and the volume of water. In cases where a solid developer or fixer composition and water are replenished separately, the replenishing rate is the sum of the volume of the solid developer or fixer composition and the volume of water. Specifically, when replenished in the form of solid processing composition, it is preferred to represent the volume of a solid processing composition to be directly fed to the processing bath and the separately replenished water. The developer replenishing solution and the fixer replenishing solution may be the same as the developing tank solution and the fixing tank solution in the processor, or solutions obtained from different solutions or a solid processing composition.

The developing, fixing, or washing and/or stabilizing temperature is preferably 10° to 45° C. and each temperature may be separately adjusted.

In light of demand for shortening the overall processing time, it is preferable that the total processing time (Dry-to-Dry) from the time when the front end of a film is put into the automatic processing machine to the time when it comes out of the drying zone is between 10 to 70 seconds. The total processing time is referred to as the period of time including all processing steps necessary for processing a black-and-white photographic light sensitive material, such as developing, fixing, bleaching, washing, stabilizing and drying, namely, Dry to Dry time. In the case when the overall processing time is less than 10 seconds, satisfactory photographic performance cannot be achieved due to desensitization or contrast-decreasing. The overall processing time is more preferably 30 to 60 seconds. To stably process large amounts such as 100 m$^2$ or more of the photographic material, the washing time is preferably less than 20 seconds.

In the drying zone of the processor, there is employed a system of drying with hot air. A heat conductive member at 60° C. or higher (e.g., a heat roller heated at 60 to 130° C.) or a radiation body at 150° C. or higher (by directly applying electricity to a tungsten, carbon, nichrome, a mixture of zirconium oxide, yttrium oxide or thorium oxide to heat and emit radiation, or by conducting thermal energy from a resistance type heat generator to a radiation emissive substance such as copper, stainless steel, nickel and various types of ceramics to generate heat or infrared rays) can preferably be used to construct the heating zone.

In this invention, there are preferably used automatic processors provided with techniques or mechanism described below:

(1) Deodorization apparatus described in JP-A No. 64-37560, page 544 (2), left upper column to page 545 (3), left upper column;

(2) Effluent treatment method described in JP-A No. 2-646380, page 388 (2), left lower column to page 391 (5), left lower column;

(3) Rinse bath provided between developing and fixing baths, described in JP-A No. 4-313749, page (18) [0054] to page (21) [0065];

(4) Water replenishing method described in JP-A No. 1-281446, page 250 (2), left lower column to right lower column;

(5) Method for controlling hot air of a processor by detecting atmospheric temperature and humidity described in JP-A No. 1-315745, page 496 (2) right lower column to page 501 (7) right lower column, and JP-A 2-108051, page 588 (2) left lower column to page 589 (3) left lower column;

(6) Method of silver recovery from fixer effluent solution described in JP-A6-27623, page (4) [0012] to page (7) [0071].

EXAMPLES

The present invention will be further described based on examples but embodiments of the invention are by no means limited to these.

Example 1

Preparation of Silver Halide Emulsion A

To solution A were added an aqueous silver nitrate solution (B) and an aqueous halide solution comprised of NaCl and KBr (C) by the double jet addition at a constant flow rate for a period of 30 min. at a pH of 3.0 and a temperature of 40° C. to obtain cubic silver bromochloride grains containing 70 mol % chloride and having an average size of 0.2 $\mu$m. During addition, the silver potential (EAg) was 160 mV at the time of starting the addition and 100 mV at the time of completion the addition. Thereafter, soluble salts were removed by ultrafiltration and then, adding gelatin of 15 g per mol of silver and adjusting the pH to 5.7, the emulsion was redispersed over a period of 30 min. After dispersion, $4\times10^{-4}$ mol/mol Ag of chloramines T was added thereto. The resulting emulsion exhibited a silver potential of 190 mV (at 40° C.)

| | |
|---|---|
| **Solution A** | |
| Ossein gelatin | 25 g |
| Nitric acid (5%) | 6.5 ml |
| Deionized water | 700 ml |
| $Na[RhCl_5(H_2O)]$ | 0.02 mg |
| **Solution B** | |
| Silver nitrate | 170 g |
| Nitric acid (5%) | 4.5 ml |
| Deionized water | 200 ml |
| **Solution C** | |
| NaCl | 47.5 g |
| KBr | 51.3 g |
| Ossein gelatin | 6 g |
| $Na_3[IrCl_6]$ | 0.15 mg |
| Deionized water | 200 ml |

To the resulting emulsion were added $1.5\times10^{-3}$ mol/mol Ag of 4-hydroxy-6-methyl-1,3,3a,7-tetrazaindene and $8.5\times10^{-4}$ mol/mol Ag of potassium bromide, then, the pH and EAg were adjusted to 5.6 and 123 mV, respectively. Subsequently, adding $2\times10^{-5}$ mol/mol Ag of finely granular sublimed sulfur and $1.5\times10^{-5}$ mol/mol Ag of chloroauric acid, chemical ripening was carried out at a temperature of 50° C. for a period of 80 min. After completion of chemical ripening were added $2\times10^{-3}$ mol/mol Ag of 4-hydroxy-6-methyl-1,3,3a,7-tetrazaindene, $3\times10^{-4}$ mol/mol Ag of 1-phenyl-5-mercaptotetrazole and $1.5\times10^{-3}$ mol/mol Ag of potassium iodide. After lowering the temperature to 40° C., sensitizing dyes represented by formula (1-a) or (1-b) and Dyes A and B for comparison were each added thereto, as shown in Table 2.

Using the thus obtained emulsion, the following 1st, 2nd and 3rd layers were simultaneously coated on one side of a subbed support in this order from the support so that the coating weights per $m^2$ were as below, and subjected to setting with cooling. Thereafter, the following backing layer was coated on the other side of the support, having an antistatic layer and set at −10° C., then, both sides were simultaneously dried to obtain photographic material 1.

Support and Sublayer

After subjecting both sides of a biaxially stretched polyethylene terephthalate support (having 100 $\mu$m thick) to corona discharge of 30 W/($m^2$·min), the following sublayer composition was coated on both sides of the support and dried at 100° C. for 1 min.

| | |
|---|---|
| 2-Hydroxyethyl methacrylate (25)-butyl acrylate (30)-t-butyl acrylate (25)-styrene (20) copolymer (number: weight percentage) | 0.5 g/$m^2$ |
| Surfactant A | 3.6 mg/$m^2$ |
| hexamethylene-1,6-bis(ethyleneurea) | 10 mg/$m^2$ |

Antistatic Layer

After subjecting subbed polyethylene terephthalate support to corona discharge of 10 W/($m^2$·min), the following antistatic layer composition was coated on one side of the support at a coating speed of 70 m/min using roll fit coating pan and air-knife, dried at 90° C. for 2 min., and further subjected to a thermal treatment at 140° C. for 90 sec.

| | |
|---|---|
| Aqueous-soluble conductive polymer B | 0.6 g/$m^2$ |
| Hydrophobic polymer particle C | 0.4 g/$m^2$ |
| Polyethylene oxide compound (MW: 600) | 0.1 g/$m^2$ |
| Hardener E | 0.01 g/$m^2$ |

| 1st Layer | |
|---|---|
| Gelatin | 0.30 g |
| 1-Phenyl-4-methyl-4-hydroxymethyl-3-pyrazolidone | 0.005 g |
| Sodium isoamyl-n-decysulfosuccinate | 0.005 g |
| Sodium dodecylbenzenesukfonate | 0.02 g |
| 2-Methylhydroquinone | 0.10 g |
| Nucleation promoting agent AM | 0.05 g |
| Poly(styrenesufonic acid) (Mw: 500,000) | 0.02 g |

| 2nd Layer (Emulsion layer) | |
|---|---|
| Gelatin | 1.0 g |
| Silver halide emulsion A (in silver amount) | 3.3 g |
| Hydrazine derivative H-34 | 0.015 g |
| Hydrazine derivatives H-39 | 0.020 g |
| Nucleation promoting agent AM | 0.15 g |
| 5-Nitroindazole | 0.01 g |
| 2-Mercaptohypoxanthine | 0.02 g |
| Suspension mixture of 75 wt % colloidal silica, 12.5 wt % vinyl acetate and 12.5 wt % vinyl pivalynate | 1.4 g |
| Polymer latex L1 (particle size of 0.10 $\mu$m) | 0.5 g |
| Dextran (Av. MW. of 40,000) | 0.1 g |
| Surfactant (SU-1) | 0.09 g |
| 4-Mercapto-3,5,6-fluorophthalic acid | 0.05 g |
| Poly(sodium styrenesulfonate) (Av. MV. of 500,000) | 0.015 g |
| THe pH of coating solution was 5.2. | |

| 3rd Layer (protective layer) | |
|---|---|
| Gelatin | 0.50 g |
| Dextran (Av. Mw of 40,000) | 0.2 g |
| Colloidal silica | 0.10 g |
| Surfactant (SU-2) | 0.02 g |
| Sodium hexylsulfosuccinate | 0.010 g |
| Fungicide Z | 0.005 g |

-continued

| 3rd Layer (protective layer) | |
|---|---|
| Hardener (1) | 0.07 g |
| Polymethyl methacrylate latex (size: 3 μm) | 0.01 g |

| Backing Layer | |
|---|---|
| Gelatin | 2.0 g |
| Dye (F-1) | 23.2 mg |
| Dye (F-2) | 90.0 mg |
| Sodium hexylsulfosuccinate | 0.020 g |
| Suspension mixture of 75 wt % colloidal silica, 12.5 wt % vinyl acetate and 12.5 wt % vinyl pivalynate | 0.7 g |
| Poly(sodium styrenesulfonate) | 0.010 g |
| Matting agent, monodisperse polymethyl methacrylate | 0.045 g |
| Hardener (1) | 0.05 g |
| Hardener (2) | 0.07 g |

Polymer latex L1

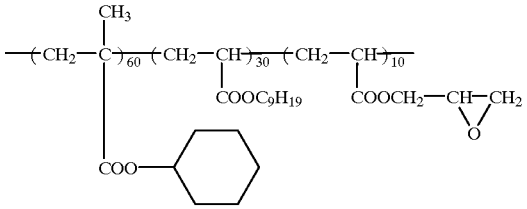

Surfactant SU-1

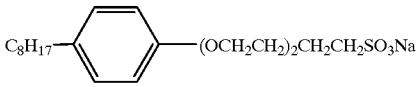

Surfactant SU-2

$C_7F_{15}CH_2(OCH_2CH_2)_{13}OH$

Nucleation promoting agent AM

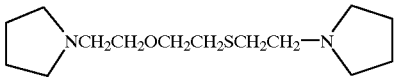

Hardener (1)

$(CH_2{=}CHSO_2CH_2CONHCH_2)_2{-}$

Hardener (2)

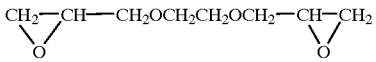

Fungicide Z

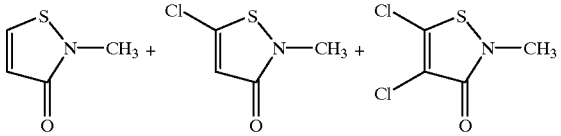

Aqueous soluble conductive polymer B

-continued
Backing Layer
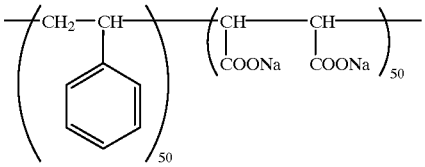
Hydrophobic polymer C
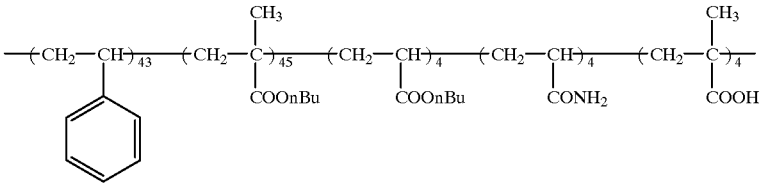
Hardener E
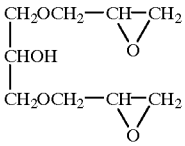
Surfactant A
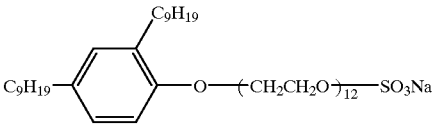
F-1
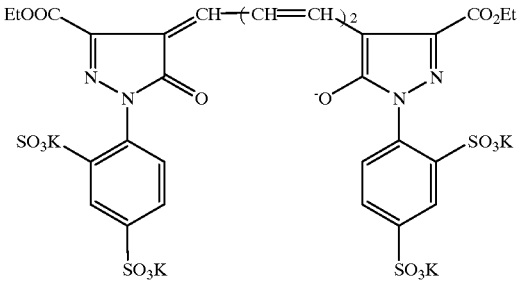
F-2
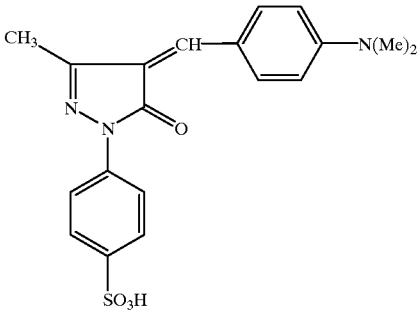

-continued

Backing Layer

Dye A

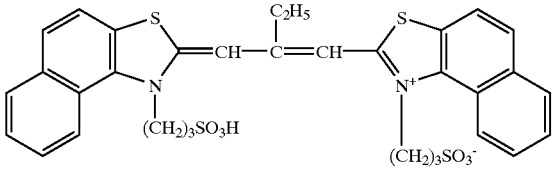

Dye B

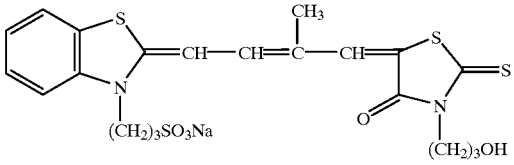

| Developer starting solution (per 1 liter of working solution) | |
|---|---|
| Pentasodium diethylenetriaminepentaacetate | 1 g |
| Sodium sulfite | 30 g |
| Potassium carbonate | 53 g |
| Potassium hydrogen carbonate | 17 g |
| 1-phenyl-4-methyl-4-hydroxymethyl-3-pyrazolidone | 1.5 g |
| Sodium erythorbate monohydrate | 40 g |
| 1-Phenyl-5-mercaptotetrazole | 0.025 g |
| Potassium bromide | 4 g |
| 5-methylbenztriazole | 0.21 g |
| Potassium hydroquinone monosulfonate | 5 g |
| 8-mercaptoadenine | 0.07 g |
| KOH was added to adjust the pH to 10.0 as a developer starting solution and the total volume was made to 1 lit. | |

| Developer replenishing solution (2 times concentrate) | |
|---|---|
| Diethylenetriaminepentaacetate | 1 g |
| Sodium sulfite | 30 g |
| Potassium carbonate | 82 g |
| 1-phenyl-4-methyl-4-hydroxymethyl-3-pyrazolidone | 1.5 g |
| Sodium erythorbate monohydrate | 40 g |
| 1-Phenyl-5-mercaptotetrazole | 0.03 g |
| Potassium bromide | 4 g |
| 5-methylbenztriazole | 0.30 g |
| Potassium hydroquinone monosulfonate | 5 g |
| 8-mercaptoadenine | 0.10 g |
| KOH was added to adjust the pH of a solution to 10.25 and the total volume was made to 0.5 lit. | |

| Fixer starting solution (per 1 liter of working solution) | |
|---|---|
| Sodium thiosufate | 200 g |
| Sodium sulfite | 22 g |
| Sodium gluconate | 5 g |
| Trisodium gluconate dihydrate | 12 g |
| Citric acid | 12 g |
| Sulfuric acid was used for adjusting the pH to 5.4 and the total volume was made to 1 lit. | |

| Fixer replenishing solution (two times concentrate) | |
|---|---|
| Sodium thiosuliate | 200 g |
| Sodium sulfite | 22 g |
| Sodium gulconate | 5 g |
| Trisodium citrate dihydrate | 12 g |
| Citric acid | 12 g |
| The pH was adjusted to 5.2 as a fixer replenishing solution with sulfuric acid and the volume was made to 0.5 lit. | |

| Tap Water | |
|---|---|
| To 1 lit. of tap water was added 8.8 ml of the following cleaner and the solution was added into a washing tank to use as washing water. | |
| Cleaner | |
| Water | 800 g |
| Salicylic acid | 0.1 g |
| Aqueous 35 wt % hydrogen peroxide | 171 g |
| Pluronic F-68 | 3.1 g |
| Hoxcite F-150 | 15 g |
| Pentasodium diethylenetriaminepentaacetate | 10 g |
| Water to make | 1 lit. |

| Processing conditions | | |
|---|---|---|
| | Temperature | Time |
| Developing | 38° C. | 15 sec. |
| Fixing | 37° C. | 15 sec. |
| Washing | 25° C. | 15 sec. |
| Drying | 50° C. | 15 sec. |

Replenishing Rate of Processing Solution

Photographic material samples, as shown in Table 2, were each exposed using image setter FT-R type 3050 (available from DAINIPPON SCREEN Co., Ltd.) and processed using the above-described processing solutions, while being replenished at a rate. Thus, the foregoing developer or fixer replenishing solution was replenished at a rate, together with an equivalent amount of tap water to a developing or fixing bath, wherein the replenishing rate of the developer or fixer solution was determined based on the proportion of an exposed area per 1 $m^2$ of the photographic material, outputted by the image setter (as shown in Table 2). Further, the cleaner and washing water were replenished to a washing bath at the rate shown below:

Developer replenishing rate:

Developer replenishing solution, as shown in Table 2

Diluent water of an amount equivalent to developer replenishing solution,

Fixer replenishing rate:

Fixer replenishing solution, as shown in Table 2

Diluent water of an amount equivalent to fixer replenishing solution,

| Washing water replenishing rate: | |
|---|---|
| Tap water | 2.3 lit./$m^2$ |
| Cleaner | 20 ml/$m^2$ |

Using automatic processor LDT1080 (for use in graphic arts, available from DAINIPPON SCREEN Co., Ltd.), photographic material samples were processed, while replenishing at the rate shown in Table 2. Processed samples were evaluated with respect to residual dye staining, based on five grades of 5 (superior) to 1 (poor). Grade 3 is the lowest level acceptable in practical use.

Running Process

Photographic material samples shown in Table 2 were continuously processed according to the conditions described above in an amount of 210 $m^2$ per day and then evaluated with respect to sensitivity, halftone dot quality, practical density and silver sludge, in the following manner.

Silver Sludge

Silver sludge was evaluated based on five grades of 5 (superior) to 1 (poor). Grade 3 is the lowest level acceptable in practical use.

Evaluation of Sensitivity and Halftone Dot Quality

Photographic material samples were exposed through an optical wedge to 660 nm semiconductor laser and processed to determine sensitivity, according the above-described processing condition using the foregoing developer and fixer starting solutions, processor LD-T1080, the foregoing developer and fixer replenishing solutions, the foregoing washing water and cleaner. Sensitivity (which is also denoted as S) was represented by a relative value of reciprocal of exposure necessary to obtain a density of 1.0 plus a fog density, based on the sensitivity of Sample No. 1 being 100.

Using 660 nm semiconductor laser, 50% equivalent halftone dots were outputted and visually evaluated with respect to halftone dot quality (also denoted as D.Q.), based on five grades of 5 (superior) to 1 (poor). Grade 2 or less are unacceptable levels in practical use.

Practical Density

Using 660 nm semiconductor laser, halftone dots were outputted on photographic material samples, and when exposed in an exposure amount necessary to reproduce 50% dots, the resulting solid density was defined as a practical density (also denoted as P.D.).

Results are shown in Tables 2 and 3.

TABLE 2

| Sample No. | Sensitizing Dye (mg/$m^2$) | Replenishment proportional to Exposed Area | Developer (concentrate) Replenishment Exposed Area/Replenishing Rate 5% (ml/$m^2$) | 30% (ml/$m^2$) | 50% (ml/$m^2$) | Fixer (concentrate) Replenishment Exposed Area/Replenishing Rate 5% (ml/$m^2$) | 30% (ml/$m^2$) | 50% (ml/$m^2$) | Residual Dye Staining |
|---|---|---|---|---|---|---|---|---|---|
| 1 | A (6) | No | 80 | 80 | 80 | 100 | 100 | 100 | 2 |
| 2 | B (6) | No | 80 | 80 | 80 | 100 | 100 | 100 | 1 |
| 3 | B (6) | Yes | 65 | 80 | 95 | 120 | 100 | 80 | 2 |
| 4 | 1-4 (6) | No | 80 | 80 | 80 | 100 | 100 | 100 | 4 |
| 5 | 1-4 (6) | Yes | 65 | 80 | 95 | 120 | 100 | 80 | 5 |
| 6 | 1-4 (6) | Yes | 50 | 60 | 75 | 90 | 75 | 60 | 5 |
| 7 | 1-7 (6) | No | 80 | 80 | 80 | 100 | 100 | 100 | 3 |
| 8 | 1-7 (6) | Yes | 65 | 80 | 95 | 120 | 100 | 80 | 4 |
| 9 | 1-7 (6) | Yes | 50 | 60 | 75 | 90 | 75 | 60 | 4 |
| 10 | 1-19 (6) | No | 80 | 80 | 80 | 100 | 100 | 100 | 4 |
| 11 | 1-19 (6) | Yes | 65 | 80 | 95 | 120 | 100 | 80 | 5 |
| 12 | 1-19 (6) | Yes | 50 | 60 | 75 | 90 | 75 | 60 | 5 |
| 13 | 1-26 (6) | No | 80 | 80 | 80 | 100 | 100 | 100 | 4 |
| 14 | 1-26 (6) | Yes | 65 | 80 | 95 | 120 | 100 | 80 | 5 |
| 15 | 1-26 (6) | Yes | 50 | 60 | 75 | 90 | 75 | 60 | 5 |

TABLE 3

| Sample | Processing Solution | | | | | | Silver | |
|---|---|---|---|---|---|---|---|---|
| | Fresh Solution | | | Running Solution | | | | |
| No. | S | D.Q. | P.D. | S | D.Q | P.D. | Sludge | Remark |
| 1 | 100 | 4 | 5.1 | 70 | 2 | 3.9 | 2 | Comp. |
| 2 | 95 | 5 | 5 | 65 | 2 | 4.0 | 1 | Comp. |
| 3 | 95 | 5 | 5 | 80 | 3 | 4.6 | 4 | Comp. |
| 4 | 108 | 5 | 5.2 | 82 | 3 | 4.2 | 2 | Comp. |
| 5 | 108 | 5 | 5.2 | 105 | 5 | 5.1 | 5 | Inv. |
| 6 | 108 | 5 | 5.2 | 105 | 5 | 5.0 | 4 | Inv. |
| 7 | 110 | 5 | 5.1 | 85 | 3 | 4.1 | 2 | Comp. |
| 8 | 110 | 5 | 5.1 | 109 | 5 | 5.0 | 5 | Inv. |
| 9 | 110 | 5 | 5.1 | 105 | 5 | 4.9 | 5 | Inv. |
| 10 | 107 | 5 | 5.2 | 82 | 3 | 4.2 | 3 | Comp. |
| 11 | 107 | 5 | 5.2 | 105 | 5 | 5.1 | 5 | Inv. |
| 12 | 107 | 5 | 5.2 | 102 | 5 | 5.0 | 4 | Inv. |
| 13 | 112 | 5 | 5.3 | 85 | 3 | 4.1 | 2 | Comp. |
| 14 | 112 | 5 | 5.3 | 110 | 5 | 5.2 | 5 | Inv. |
| 15 | 112 | 5 | 5.3 | 108 | 5 | 5.1 | 4 | Inv. |

In processing with a developer containing the compound of formula (A), as can be seen from Tables 2 and 3, it was proved that when processed with fresh or running processing solutions, inventive samples exhibited improved results in residual dye staining, were superior in sensitivity, dot quality and practical density in the wavelength region of red to infrared and exhibited improved results in silver sludge, as compared to comparative samples.

Example 2

Photographic material samples were prepared and evaluated similarly to Example 1, provided that sensitizing dues of formula (1-a) or (1-b) was replaced by sensitizing dyes of formula (2), and processing solutions and processing conditions were varied as described below. Results thereof are shown in Tables 4 and 5.

| Developer formula<br>Developer starting solution (per 1 liter of working solution) | |
|---|---|
| Pentasodium diethylenetriaminepentaacetate | 1 g |
| Sodium sulfite | 30 g |
| Potassium carbonate | 53 g |
| Potassium hydrogen carbonate | 17 g |
| 1-phenyl-4-methyl-4-hydroxymethyl-3-pyrazolidone | 1.5 g |
| Sodium erythorbate monohydrate | 40 g |
| 1-Phenyl-5-mercaptotetrazole | 0.025 g |
| Potassium bromide | 4 g |
| 5-methylbenztriazole | 0.21 g |
| Potassium hydroquinone monosulfonate | 5 g |
| 8-mercaptoadenine | 0.07 g |
| Water to make | 1 lit. |
| KOH was added to adjust the pH to 10.0 as a developer starting solution and the total volume was made to 1 lit. | |

Developer Replenishing Solution

Cutting an aluminum pillow of solid processing composition package D, as described below, the content was taken out and dissolved in 9 lit. tap water with stirring by a commercially available stirrer for 40 min. to obtain 10 lit. of developer replenishing solution DR. The pH of the developer replenishing solution was 10.25.

Preparation of solid developer kit (for 10 lit. working solution)

1) Preparation of developing agent granules DA

Pretreatment of Component

8-Mercaptoadenine was pulverized by MICRO PULVERIZER AP-B (available from HOSOKAWA MICRON Co. Ltd.) with 8 mm mesh, at a rotation speed of 50 Hz. KBr was dressed by 0.25 mm mesh, using a commercially available grain-dressing machine.

Mixing of Components

The following composition was mixed over a period of 15 min. using commercially available V-type mixer (200 lit. volume).

| | |
|---|---|
| Sodium erythorbate (product by Pfeizer Corp.) | 84.3 kg |
| 1-Phenyl-4-phenyl-hydroxymethyl-4-methyl-3-pyrazolidone (Dimezone S) | 2.31 kg |
| Potassium hydroquinone monosulfonate | 11.32 kg |
| 8-Mercaptoadenine (pulverized as above) | 0.20 kg |
| DTPA · 5H | 7.09 kg |
| KBr (dressed as above) | 3.55 kg |
| Berizotriazole | 0.51 kg |
| Sorbitol | 3.14 kg |

Sampling of 50 g was made from each of arbitrary points (5 points) of the obtained mixture. As a result of analysis thereof, the concentration of each component was within ±5% of the above-described formula value, proving that the components were homogeneously mixed.

Molding

The mixture was subjected to molding using compression granulating machine BRICKETTA BSS-IV type (available from Shinto Kogyo Co. Ltd.) at a pocket form of 5.00 mmϕ×1.2 mm (depth), a roller rotation speed of 15 rpm and a feeder rotation number of 24 rpm. The obtained planar molding was crushed by a classifier and granules of 2.4 to 7.0 mm was separated from powdery granules of less than 2.4 mm (and granules of more than 7.0 mm were crushed). This powdery granules of less than 2.4 mm were again mixed with the mixture described above and molded in the compression molding machine. Granules DA of 90 kg were thus obtained.

2) Preparation of alkali granules DB

The following components were subjected to a pretreatment. Thus, 56.6 g of 1-phenyl-5-mercaptotetrazole was dissolved in 400 ml ethyl alcohol. The obtained solution was dropwise added to 20 kg of sodium carbonate anhydride in a mixer, while rotating. Rotation was continued until completely dried. Sampling of 10 g was made from each of arbitrary points (5 points) of the obtained mixture. As a result of analysis thereof, it was proved that 1-phenyl-5-mercaptotetrazole was sufficiently homogeneous. The obtained mixture was denoted as M-1

Mixing of potassium carbonate/M-1/lithium oxide·$H_2O$

The following composition was mixed over a period of 10 min. using commercially available V-type mixer (200 lit. volume).

| | |
|---|---|
| Potassium carbonate | 34.95 kg |
| M-1 | 11.44 kg |
| Sodium sulfite anhydride | 17.85 kg |
| D-mannitol | 4.63 kg |
| D-sorbitol | 1.86 kg |

After mixing was further added thereto 1.37 kg of sodium 1-octanesulfonate which had been pulverized by MICRO PULVERIZER AP-B (available from HOSOKAWA MICRON Co. Ltd.) with 4 mm mesh, at a rotation speed of 60 Hz.

Molding

The mixture was subjected to molding using compression granulating machine BRICKETTA BSS-IV type (available from Shinto Kogyo Co. Ltd.) at a pocket form of 5.00 mmϕ×1.2 mm (depth), a roller rotation speed of 15 rpm and a feeder rotation number of 44 rpm. The obtained planar molding was crushed by a classifier and granules of 2.4 to 7.0 mm was separated from powdery granules of less than 2.4 mm (and granules of more than 7.0 mm were crushed). This powdery granules of less than 2.4 mm were again mixed with the mixture described above and molded in the compression molding machine. Granules DB of 71 kg was thus obtained.

Developer package (Working solution 10 lit. kit)

Molded granules DA and DB were successively filled in the order described below and after 2.0 lit. of nitrogen gas was blown inside, the upper aperture was sealed with aluminum pillow, using a heat-sealer to obtain solid developer composition package D.

| | |
|---|---|
| 1) Granule DB | 1174.9 g |
| 2) Granula DA | 355.2 g |

| Fixer starting solution (per 1 liter of working solution) | |
|---|---|
| Sodium thiosufate | 200 g |
| Sodium sulfite | 22 g |
| Sodium gluconate | 5 g |
| Trisodium gluconate dihydrate | 12 g |
| citric acid | 12 g |
| Sulfuric acid was used for adjusting the pH to 5.4 and the total volume was made to 1 lit. | |

Fixer Replenishing Solution

Cutting an aluminum pillow of solid processing composition package E, as described below, the content was taken out and dissolved in 9 lit. tap water with stirring by a commercially available stirrer for 40 min. to obtain 10 lit. of fixer replenishing solution ER. The pH of the developer replenishing solution was 5.6.

Preparation of solid fixer kit (for 10 l working solution)

1) Preparation of fixing agent granules FA

Pretreatment of Component

Sodium 1-octanesulfonate was pulverized by MICRO PULVERIZER AP-B (available from HOSOKAWA MICRON Co. Ltd.) with 8 mm mesh, at a rotation speed of 60 Hz.

Mixing of Components

The following composition was mixed over a period of 10 min., using commercially available V-type mixer (200 lit. volume).

| | |
|---|---|
| Sodium thiosulfate | 15 kg |
| Sodium sulfite | 2.2 kg |
| Compound (1) | 50 kg |

To the obtained mixture, 1 kg of sodium 1-octanesulfonate (pulverized as above) was added and further mixed for 5 min.

Molding

The mixture was subjected to molding using compression granulating machine BRICKETTA BSS-IV type (available from Shinto Kogyo Co. Ltd.) at a pocket form of 5.00 mmϕ×1.2 mm (depth), a roller rotation speed of 25 rpm and a feeder rotation number of 36 rpm. The obtained planar molding was crushed by a classifier and granules of 2.4 to 7.0 mm was separated from powdery granules of less than 2.4 mm (and granules of more than 7.0 mm were crushed) . This powdery granules of less than 2.4 mm were again mixed with the mixture described above and molded in the compression molding machine. Granules FA were thus obtained.

Mixing of Component B

The following composition was mixed over a period of 10 min., using commercially available V-type mixer (200 lit. volume).

| | |
|---|---|
| Trisodium gluconate dihydrate | 2.9 kg |
| Sodium gluconate | 0.5 kg |
| citric acid | 1.2 kg |

The mixture was subjected to molding using compression granulating machine BRICKETTA BSS-IV type (available from Shinto Kogyo Co. Ltd.) at a pocket form of 5.00 mmϕ×1.2 mm (depth), a roller rotation speed of 15 rpm and a feeder rotation number was adjusted so that the roll load voltage was 16 to 19 amp. The obtained planar molding was crushed by a classifier and granules of 2.4 to 7.0 mm was separated from powdery granules of less than 2.4 mm (and granules of more than 7.0 mm were crushed). This powdery granules of less than 2.4 mm were again mixed with the mixture described above and molded in the compression molding machine. Granules FB was thus obtained.

Fixer package (Working solution 10 lit. kit)

Molded granules for 10 lit. working solution were separated and packaged as a 10 lit.

Granule FB (lower layer)

Granula FZ (upper layer)

When dissolved in water to make 10 lit., the pH was 5.60.

| Rinsing solution | |
|---|---|
| Water | 900 g |
| DTPA-5Na (diethylenetriaminepentaacetic acid pentasodium salt) | 0.5 g |
| Salycilic acid | 0.1 g |
| Benzoisothiazoline | 0.05 g |
| Sodium sulfite | 1.0 g |
| Sodium chloride | 2.9 g |
| Propylene glycol | 0.6 g |

The pH was adjusted to 5.0 and the total volume was made to 1 lit.

The proportion of exposes area was shown in Table 4.

| Processing conditions | | |
|---|---|---|
| | Temperature | Time |
| Developing | 38° C. | 15 sec. |
| Fixing | 37° C. | 15 sec. |
| Washing | 25° C. | 20 sec. |
| Drying | 50° C. | 10 sec. |

Replenishing Rate of Processing Solution

The foregoing developer replenishing solution, fixer replenishing solution, and cleaner and tap water used for dilution were each directly replenished to the developing bathe, fixing bathe and washing bath according to the following condition:

developer replenishing rate, as shown in Table 4, fixer replenishing rate, as shown in Table 4, and Washing water rinsing water of 150 ml/m$^2$

TABLE 4

| Sample No. | Sensitizing Dye (mg/m$^2$) | Replenishment proportional to Exposed Area | Developer (concentrate) Replenishment Exposed Area/Replenishing Rate 5% (ml/m$^2$) | 30% (ml/m$^2$) | 50% (ml/m$^2$) | Fixer (concentrate) Replenishment Exposed Area/Replenishing Rate 5% (ml/m$^2$) | 30% (ml/m$^2$) | 50% (ml/m$^2$) | Residual Dye Staining |
|---|---|---|---|---|---|---|---|---|---|
| 1 | A (6) | No | 160 | 160 | 160 | 200 | 200 | 200 | 2 |
| 2 | B (6) | No | 160 | 160 | 160 | 200 | 200 | 200 | 1 |
| 3 | B (6) | Yes | 130 | 160 | 190 | 240 | 200 | 160 | 2 |
| 4 | 2-8 (6) | No | 160 | 160 | 160 | 200 | 200 | 200 | 4 |
| 5 | 2-8 (6) | Yes | 130 | 160 | 190 | 240 | 200 | 160 | 5 |
| 6 | 2-8 (6) | Yes | 100 | 120 | 150 | 180 | 150 | 120 | 5 |
| 7 | 2-9 (6) | No | 160 | 160 | 160 | 200 | 200 | 200 | 3 |
| 8 | 2-9 (6) | Yes | 130 | 160 | 190 | 240 | 200 | 160 | 4 |
| 9 | 2-9 (6) | Yes | 100 | 120 | 150 | 180 | 150 | 120 | 4 |
| 10 | 2-14 (6) | No | 160 | 160 | 160 | 200 | 200 | 200 | 4 |
| 11 | 2-14 (6) | Yes | 130 | 160 | 190 | 240 | 200 | 160 | 5 |
| 12 | 2-14 (6) | Yes | 100 | 120 | 150 | 180 | 150 | 120 | 5 |
| 13 | 2-22 (6) | No | 160 | 160 | 160 | 200 | 200 | 200 | 4 |
| 14 | 2-22 (6) | Yes | 130 | 160 | 190 | 240 | 200 | 160 | 5 |
| 15 | 2-22 (6) | Yes | 100 | 120 | 150 | 180 | 150 | 120 | 5 |

TABLE 5

| Sample No. | Processing Solution: Fresh Solution S | D.Q. | P.D. | Running Solution S | D.Q | P.D. | Silver Sludge | Remark |
|---|---|---|---|---|---|---|---|---|
| 1 | 100 | 4 | 5.1 | 70 | 2 | 3.9 | 2 | Comp. |
| 2 | 95 | 5 | 5 | 65 | 2 | 4.0 | 1 | Comp. |
| 3 | 95 | 5 | 5 | 80 | 3 | 4.6 | 4 | Comp. |
| 4 | 120 | 5 | 5.3 | 95 | 3 | 4.3 | 3 | Comp. |
| 5 | 120 | 5 | 5.3 | 118 | 5 | 5.3 | 5 | Inv. |
| 6 | 120 | 5 | 5.3 | 116 | 5 | 5.2 | 5 | Inv. |
| 7 | 110 | 5 | 5.1 | 85 | 3 | 4.0 | 2 | Comp. |
| 8 | 110 | 5 | 5.1 | 107 | 5 | 5.0 | 5 | Inv. |
| 9 | 110 | 5 | 5.1 | 105 | 5 | 4.9 | 4 | Inv. |
| 10 | 115 | 5 | 5.2 | 86 | 2 | 4.2 | 3 | Comp. |

TABLE 5-continued

| Sample No. | Processing Solution: Fresh Solution S | D.Q. | P.D. | Running Solution S | D.Q | P.D. | Silver Sludge | Remark |
|---|---|---|---|---|---|---|---|---|
| 11 | 115 | 5 | 5.2 | 112 | 5 | 5.1 | 5 | Inv. |
| 12 | 115 | 5 | 5.2 | 110 | 5 | 5.0 | 4 | Inv. |
| 13 | 115 | 5 | 5.2 | 85 | 3 | 4.2 | 2 | Comp. |
| 14 | 115 | 5 | 5.2 | 112 | 5 | 5.1 | 5 | Inv. |
| 15 | 115 | 5 | 5.2 | 109 | 5 | 5.0 | 4 | Inv. |

Example 3

Photographic material sample were prepared and evaluated similarly to Example 2, provided that sensitizing dyes of formula (2) was replaced by sensitizing dyes of formula (3-a) or (3-b), as shown in Table 6. Results are shown in Tables 6 and 7.

TABLE 6

| Sample No. | Sensitizing Dye (mg/m$^2$) | Replenishment proportional to Exposed Area | Developer (concentrate) Replenishment Exposed Area/Replenishing Rate 5% (ml/m$^2$) | 30% (ml/m$^2$) | 50% (ml/m$^2$) | Fixer (concentrate) Replenishment Exposed Area/Replenishing Rate 5% (ml/m$^2$) | 30% (ml/m$^2$) | 50% (ml/m$^2$) | Residual Dye Staining |
|---|---|---|---|---|---|---|---|---|---|
| 1 | A (6) | No | 160 | 160 | 160 | 200 | 200 | 200 | 2 |
| 2 | B (6) | No | 160 | 160 | 160 | 200 | 200 | 200 | 1 |
| 3 | B (6) | Yes | 130 | 160 | 190 | 240 | 200 | 160 | 2 |

TABLE 6-continued

| Sample No. | Sensitizing Dye (mg/m²) | Replenishment proportional to Exposed Area | Developer (concentrate) Replenishment Exposed Area/Replenishing Rate 5% (ml/m²) | 30% (ml/m²) | 50% (ml/m²) | Fixer (concentrate) Replenishment Exposed Area/Replenishing Rate 5% (ml/m²) | 30% (ml/m²) | 50% (ml/m²) | Residual Dye Staining |
|---|---|---|---|---|---|---|---|---|---|
| 4 | 3-2 (6) | No | 160 | 160 | 160 | 200 | 200 | 200 | 4 |
| 5 | 3-2 (6) | Yes | 130 | 160 | 190 | 240 | 200 | 160 | 5 |
| 6 | 3-2 (6) | Yes | 100 | 120 | 150 | 180 | 150 | 120 | 5 |
| 7 | 3-9 (6) | No | 160 | 160 | 160 | 200 | 200 | 200 | 3 |
| 8 | 3-9 (6) | Yes | 130 | 160 | 190 | 240 | 200 | 160 | 4 |
| 9 | 3-9 (6) | Yes | 100 | 120 | 150 | 180 | 150 | 120 | 4 |
| 10 | 3-12 (6) | No | 160 | 160 | 160 | 200 | 200 | 200 | 4 |
| 11 | 3-12 (6) | Yes | 130 | 160 | 190 | 240 | 200 | 160 | 5 |
| 12 | 3-12 (6) | Yes | 100 | 120 | 150 | 180 | 150 | 120 | 5 |
| 13 | 3-20 (6) | No | 160 | 160 | 160 | 200 | 200 | 200 | 4 |
| 14 | 3-20 (6) | Yes | 130 | 160 | 190 | 240 | 200 | 160 | 5 |
| 15 | 3-20 (6) | Yes | 100 | 120 | 150 | 180 | 150 | 120 | 5 |

TABLE 7

| Sample No. | Processing Solution: Fresh Solution S | D.Q. | P.D. | Running Solution S | D.Q | P.D. | Silver Sludge | Remark |
|---|---|---|---|---|---|---|---|---|
| 1 | 100 | 4 | 5.1 | 70 | 2 | 3.9 | 2 | Comp. |
| 2 | 95 | 5 | 5 | 65 | 2 | 4.0 | 1 | Comp. |
| 3 | 95 | 5 | 5 | 80 | 3 | 4.6 | 4 | Comp. |
| 4 | 105 | 5 | 5.2 | 76 | 3 | 4.2 | 2 | Comp. |
| 5 | 105 | 5 | 5.2 | 103 | 5 | 5.1 | 5 | Inv. |
| 6 | 105 | 5 | 5.2 | 101 | 5 | 5.0 | 4 | Inv. |
| 7 | 110 | 5 | 5.1 | 80 | 2 | 4.1 | 2 | Comp. |
| 8 | 110 | 5 | 5.1 | 107 | 5 | 5.0 | 5 | Inv. |
| 9 | 110 | 5 | 5.1 | 105 | 4 | 4.9 | 5 | Inv. |
| 10 | 105 | 5 | 5.2 | 75 | 3 | 4.2 | 3 | Comp. |
| 11 | 105 | 5 | 5.2 | 101 | 5 | 5.1 | 5 | Inv. |
| 12 | 105 | 5 | 5.2 | 100 | 5 | 5.0 | 4 | Inv. |
| 13 | 110 | 5 | 5.3 | 80 | 2 | 4.1 | 2 | Comp. |

TABLE 7-continued

| Sample No. | Processing Solution: Fresh Solution S | D.Q. | P.D. | Running Solution S | D.Q | P.D. | Silver Sludge | Remark |
|---|---|---|---|---|---|---|---|---|
| 14 | 110 | 5 | 5.3 | 107 | 5 | 5.2 | 5 | Inv. |
| 15 | 110 | 5 | 5.3 | 104 | 4 | 5.1 | 4 | Inv. |

Example 4

Photographic material sample were prepared and evaluated similarly to Example 2, provided that sensitizing dyes of formula (2) was replaced by sensitizing dyes of formula (4), as shown in Table 8. Results are shown in Tables 6 and 7.

TABLE 8

| Sample No. | Sensitizing Dye (mg/m²) | Replenishment proportional to Exposed Area | Developer (concentrate) Replenishment Exposed Area/Replenishing Rate 5% (ml/m²) | 30% (ml/m²) | 50% (ml/m²) | Fixer (concentrate) Replenishment Exposed Area/Replenishing Rate 5% (ml/m²) | 30% (ml/m²) | 50% (ml/m²) | Residual Dye Staining |
|---|---|---|---|---|---|---|---|---|---|
| 1 | A (6) | No | 160 | 160 | 160 | 200 | 200 | 200 | 2 |
| 2 | B (6) | No | 160 | 160 | 160 | 200 | 200 | 200 | 1 |
| 3 | B (6) | Yes | 130 | 160 | 190 | 240 | 200 | 160 | 2 |
| 4 | 4-3 (6) | No | 160 | 160 | 160 | 200 | 200 | 200 | 4 |
| 5 | 4-3 (6) | Yes | 130 | 160 | 190 | 240 | 200 | 160 | 5 |
| 6 | 4-3 (6) | Yes | 100 | 120 | 150 | 180 | 150 | 120 | 5 |
| 7 | 4-11 (6) | No | 160 | 160 | 160 | 200 | 200 | 200 | 3 |
| 8 | 4-11 (6) | Yes | 130 | 160 | 190 | 240 | 200 | 160 | 4 |
| 9 | 4-11 (6) | Yes | 100 | 120 | 150 | 180 | 150 | 120 | 4 |
| 10 | 4-19 (6) | No | 160 | 160 | 160 | 200 | 200 | 200 | 4 |
| 11 | 4-19 (6) | Yes | 130 | 160 | 190 | 240 | 200 | 160 | 5 |
| 12 | 4-19 (6) | Yes | 100 | 120 | 150 | 180 | 150 | 120 | 5 |
| 13 | 4-26 (6) | No | 160 | 160 | 160 | 200 | 200 | 200 | 4 |
| 14 | 4-26 (6) | Yes | 130 | 160 | 190 | 240 | 200 | 160 | 5 |
| 15 | 4-26 (6) | Yes | 100 | 120 | 150 | 180 | 150 | 120 | 5 |

TABLE 9

| Sample | Processing Solution | | | | | | Silver | |
|---|---|---|---|---|---|---|---|---|
| | Fresh Solution | | | Running Solution | | | | |
| No. | S | D.Q. | P.D. | S | D.Q | P.D. | Sludge | Remark |
| 1 | 100 | 4 | 5.1 | 70 | 2 | 3.9 | 2 | Comp. |
| 2 | 95 | 5 | 5 | 65 | 2 | 4.0 | 1 | Comp. |
| 3 | 95 | 5 | 5 | 80 | 3 | 4.6 | 4 | Comp. |
| 4 | 110 | 5 | 5 | 79 | 3 | 4.0 | 3 | Comp. |
| 5 | 110 | 5 | 5 | 108 | 5 | 5.0 | 5 | Inv. |
| 6 | 110 | 5 | 5 | 106 | 5 | 4.9 | 5 | Inv. |
| 7 | 105 | 5 | 5.1 | 77 | 3 | 4.1 | 2 | Comp. |
| 8 | 105 | 5 | 5.1 | 103 | 5 | 5.0 | 5 | Inv. |
| 9 | 105 | 5 | 5.1 | 101 | 5 | 4.9 | 4 | Inv. |
| 10 | 115 | 5 | 5.1 | 82 | 2 | 4.9 | 4 | Comp. |
| 11 | 115 | 5 | 5.1 | 113 | 5 | 5.0 | 5 | Inv. |
| 12 | 115 | 5 | 5.1 | 111 | 5 | 5.0 | 4 | Inv. |
| 13 | 110 | 5 | 5 | 80 | 3 | 3.9 | 2 | Comp. |
| 14 | 110 | 5 | 5 | 107 | 5 | 4.9 | 5 | Inv. |
| 15 | 110 | 5 | 5 | 106 | 5 | 4.8 | 4 | Inv. |

Example 5

Photographic material sample were prepared and evaluated similarly to Example 2, provided that sensitizing dyes of formula (2) was replaced by sensitizing dyes of formula (5), as shown in Table 10. Results are shown in Tables 10 and 11.

TABLE 11-continued

| Sample | Processing Solution | | | | | | Silver | |
|---|---|---|---|---|---|---|---|---|
| | Fresh Solution | | | Running Solution | | | | |
| No. | S | D.Q. | P.D. | S | D.Q | P.D. | Sludge | Remark |
| 6 | 120 | 5 | 5.3 | 116 | 5 | 5.2 | 5 | Inv. |
| 7 | 110 | 5 | 5.1 | 85 | 3 | 4.0 | 2 | Comp. |
| 8 | 110 | 5 | 5.1 | 107 | 5 | 5.0 | 5 | Inv. |
| 9 | 110 | 5 | 5.1 | 105 | 5 | 4.9 | 4 | Inv. |
| 10 | 115 | 5 | 5.1 | 86 | 2 | 4.2 | 3 | Comp. |
| 11 | 115 | 5 | 5.1 | 112 | 5 | 5.0 | 5 | Inv. |
| 12 | 115 | 5 | 5.1 | 110 | 5 | 4.9 | 4 | Inv. |
| 13 | 115 | 5 | 5.2 | 85 | 3 | 4.2 | 2 | Comp. |
| 14 | 115 | 5 | 5.2 | 112 | 5 | 5.1 | 5 | Inv. |
| 15 | 115 | 5 | 5.2 | 109 | 5 | 5.0 | 4 | Inv. |

In processing with a developer containing the compound of formula (A), as can be seen from Tables 4 through 11, it was proved that when processed with fresh or running processing solutions, inventive samples exhibited improved results in residual dye staining, were superior in sensitivity, dot quality and practical density in the wavelength region of red to infrared and exhibited improved results in silver sludge, as compared to comparative samples.

Example 6

Photographic material samples were prepared similarly to Example 2, provided that 6 mg/m$^2$ of sensitizing dye 2–14

TABLE 10

| Sample No. | Sensitizing Dye (mg/m$^2$) | Replenishment proportional to Exposed Area | Developer (concentrate) Replenishment Exposed Area/Replenishing Rate | | | Fixer (concentrate) Replenishment Exposed Area/Replenishing Rate | | | Residual Dye Staining |
|---|---|---|---|---|---|---|---|---|---|
| | | | 5% (ml/m$^2$) | 30% (ml/m$^2$) | 50% (ml/m$^2$) | 5% (ml/m$^2$) | 30% (ml/m$^2$) | 50% (ml/m$^2$) | |
| 1 | A (6) | No | 160 | 160 | 160 | 200 | 200 | 200 | 2 |
| 2 | B (6) | No | 160 | 160 | 160 | 200 | 200 | 200 | 1 |
| 3 | B (6) | Yes | 130 | 160 | 190 | 240 | 200 | 160 | 2 |
| 4 | 5-1 (6) | No | 160 | 160 | 160 | 200 | 200 | 200 | 4 |
| 5 | 5-1 (6) | Yes | 130 | 160 | 190 | 240 | 200 | 160 | 5 |
| 6 | 5-1 (6) | Yes | 100 | 120 | 150 | 180 | 150 | 120 | 5 |
| 7 | 5-5 (6) | No | 160 | 160 | 160 | 200 | 200 | 200 | 3 |
| 8 | 5-5 (6) | Yes | 130 | 160 | 190 | 240 | 200 | 160 | 4 |
| 9 | 5-5 (6) | Yes | 100 | 120 | 150 | 180 | 150 | 120 | 4 |
| 10 | 5-12 (6) | No | 160 | 160 | 160 | 200 | 200 | 200 | 4 |
| 11 | 5-12 (6) | Yes | 130 | 160 | 190 | 240 | 200 | 160 | 5 |
| 12 | 5-12 (6) | Yes | 100 | 120 | 150 | 180 | 150 | 120 | 5 |
| 13 | 5-20 (6) | No | 160 | 160 | 160 | 200 | 200 | 200 | 4 |
| 14 | 5-20 (6) | Yes | 130 | 160 | 190 | 240 | 200 | 160 | 5 |
| 15 | 5-20 (6) | Yes | 100 | 120 | 150 | 180 | 150 | 120 | 5 |

TABLE 11

| Sample | Processing Solution | | | | | | Silver | |
|---|---|---|---|---|---|---|---|---|
| | Fresh Solution | | | Running Solution | | | | |
| No. | S | D.Q. | P.D. | S | D.Q | P.D. | Sludge | Remark |
| 1 | 100 | 4 | 5.1 | 70 | 2 | 3.9 | 2 | Comp. |
| 2 | 95 | 5 | 5 | 65 | 2 | 4.0 | 1 | Comp. |
| 3 | 95 | 5 | 5 | 80 | 3 | 4.6 | 4 | Comp. |
| 4 | 120 | 5 | 5.3 | 95 | 3 | 4.3 | 3 | Comp. |
| 5 | 120 | 5 | 5.3 | 118 | 5 | 5.3 | 5 | Inv. |

was incorporated in the preparation of a silver halide emulsion in Example 2, the gelatin content of the 1st, 2nd and 3rd layers of the emulsion layer side and the amount of the added hardener were varied, as shown in Table 12 so as to exhibit the swelling percentage as shown in Table 12. Gradation (γ), as defined below, was determined and photographic material samples were also evaluated similarly to Example 2. Results are shown in Tables 12 and 13.

Determination of γ

When a slope of a straight line connecting densities of 1.0 and 2.0 on the characteristic curve is represented by θ, the value of tan θ is defined as gradation (γ). The more value is the higher contrast.

TABLE 12

| Sample No. | Gelatin Content 1st Layer (g/m2) | 2nd Layer (g/m$^2$) | 3rd Layer (g/m$^2$) | Hardener (1) (g/m$^2$) | Swelling Percentage (%) | Developer (concentrate) Replenishment Exposed Area/Replenishing Rate 5% (ml/m$^2$) | 30% (ml/m$^2$) | 50% (ml/m$^2$) | Fixer (concentrate) Replenishment Exposed Area/Replenishing Rate 5% (ml/m$^2$) | 30% (ml/m$^2$) | 50% (ml/m$^2$) | Residual Dye Staining |
|---|---|---|---|---|---|---|---|---|---|---|---|---|
| 1 | 0.3 | 1.0 | 0.5 | 0.07 | 70 | 160 | 160 | 160 | 200 | 200 | 200 | 4 |
| 2 | 0.3 | 1.0 | 0.5 | 0.07 | 70 | 130 | 160 | 190 | 240 | 200 | 160 | 5 |
| 3 | 0.3 | 0.7 | 0.4 | 0.07 | 50 | 160 | 160 | 160 | 200 | 200 | 200 | 5 |
| 4 | 0.3 | 0.7 | 0.4 | 0.07 | 50 | 130 | 160 | 190 | 240 | 200 | 160 | 5 |
| 5 | 0.5 | 1.0 | 0.5 | 0.10 | 40 | 160 | 160 | 160 | 200 | 200 | 200 | 5 |
| 6 | 0.5 | 1.0 | 0.5 | 0.10 | 40 | 130 | 160 | 190 | 240 | 200 | 160 | 5 |
| 7 | 0.8 | 2.0 | 1.0 | 0.03 | 170 | 160 | 160 | 160 | 200 | 200 | 200 | 5 |

TABLE 13

| Sample No. | Processing Solution: Fresh Solution S | gamma (γ) | P.D. | Running Solution S | gamma (γ) | P.D. | Silver Sludge | Remark |
|---|---|---|---|---|---|---|---|---|
| 1 | 115 | 5 | 5.2 | 86 | 2 | 4.2 | 3 | Comp. |
| 2 | 115 | 5 | 5.2 | 112 | 5 | 5.1 | 5 | Inv. |
| 3 | 115 | 5 | 5.1 | 90 | 3 | 4.3 | 3 | Comp. |
| 4 | 115 | 5 | 5.1 | 114 | 5 | 5.1 | 5 | Inv. |
| 5 | 115 | 5 | 5.1 | 92 | 3 | 4.3 | 4 | Comp. |
| 6 | 115 | 5 | 5.1 | 115 | 5 | 5.1 | 5 | Inv. |
| 7 | 115 | 5 | 5.3 | 90 | 3 | 4.3 | 2 | Comp. |

In processing by using a solid developer composition containing the compound of formula (A), as can be seen from Tables 12 and 13, it was proved that when processed with fresh or running processing solutions, inventive samples exhibited improved results in residual dye staining, were superior in sensitivity, dot quality and practical density in the wavelength region of red to infrared and exhibited improved results in silver sludge, as compared to comparative samples.

EFFECT OF THE INVENTION

A processing method of silver halide photographic light sensitive materials according to the invention results in a decrease in residual dye staining after processing, leading to enhanced sensitivity and contrast, and also superior halftone dot quality and practical density within the red to infrared wavelength region, and producing little sludge.

Disclosed embodiments can be varied by a skilled person without departing from the spirit and scope of the invention.

What is claimed is:

1. A processing method of a photographic material comprising the steps of:

imagewise exposing the photographic material;

developing the exposed photographic material with a developer solution, fixing the developed photographic material with a fixer solution, washing the fixed photographic material with a washing water, replenishing at least one of the developer solution and the fixer soulution at a replenshing rate, determining a proportion of exposed area per unit of photographic material being processed, and adjusting the replenishing rate of at least one of the developer solution and the fixer solution based on the proportion of exposed area per unit of photographic material, wherein the photographic material comprises a support and a light sensitive silver halide emulsion layer containing a spectral-sensitizing dye represented by the following formula (1-a), (1-b), (2), (3-a), (3-b), (4) or (5), and wherein the developer solution contains a developing agent represented by formula (A):

formula (1-a)

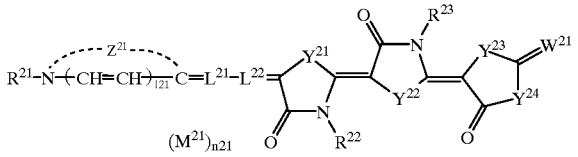

wherein $Y^{21}$, $Y^{22}$, $Y^{23}$ and $Y^{24}$ each represent —N($R^{24}$)—, —O—, —S—, —Se— or —Te—, provided that one of $Y^{23}$ and $Y^{24}$ is —N($R^{24}$)—, and $Y^{21}$, $Y^{22}$ and $Y^{23}$ or $Y^{21}$, $Y^{22}$ and $Y^{24}$ are not —S— at the same time; $R^{21}$ represents an aliphatic group having 8 or less carbon atoms and containing an aqueous solubility promoting group; $R^{22}$, $R^{23}$ and $R^{24}$ each represent a substituted or unsubstituted aliphatic group, a substituted or unsubstituted aryl group or a substituted or unsubstituted heterocyclic group, provided that at least two of $R^{22}$, $R^{23}$ and $R^{24}$ contain an aqueous solubility promoting group; $Z^{21}$ represent a non-metallic atom group necessary to form a 5- or 6-membered nitrogen-containing heterocyclic ring, which may be condensed; $W^{21}$ represents an oxygen atom, sulfur atom, =N(Ar) or =C<($E^{21}$) ($E^{22}$), in which Ar represents an aromatic ring group or a heterocyclic group, $E^{21}$ and $E^{22}$ represent an electron-withdrawing group or combine with each other to form a heterocyclic ring containing an oxo group or an acidic heterocyclic ring; $L^{21}$ and $L^{22}$ represent a substituted or unsubstituted methine group; 121 is 0 or 1; $M^{21}$ represent an ion necessary to counterbalance a total intramolecular charge; and n21 represents a number of ion necessary to counterbalance a total intramolecular charge;

formula (1-b)

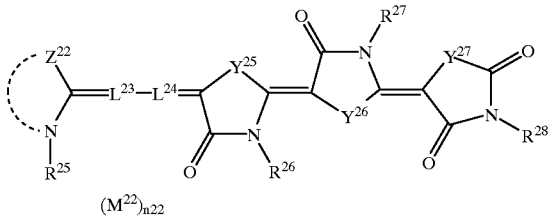

wherein $Y^{25}$, $Y^{26}$ and $Y^{27}$ each represent —N($R^{29}$)—, —O—, —S—, —Se—; $R^{25}$ represents an aliphatic group having 8 or less carbon atoms and containing an aqueous solubility promoting group; $R^{26}$, $R^{27}$, $R^{28}$ and $R^{29}$ represent a substituted or unsubstituted aliphatic group, a substituted or unsubstituted aryl group or a substituted or unsubstituted heterocyclic group, provided that at least three of $R^{26}$, $R^{27}$, $R^{28}$ and $R^{29}$ contain an aqueous solubility promoting group; $Z^{22}$ represent a non-metallic atom group necessary to form a 5- or 6-membered nitrogen-containing heterocyclic ring, which may be condensed; $L^{23}$ and $L^{24}$ represent a substituted or unsubstituted methine group; $M^{22}$ represent an ion necessary to counterbalance a total intramolecular charge; and $n^{22}$ represents a number of ion necessary to counterbalance a total intramolecular charge;

formula (2)

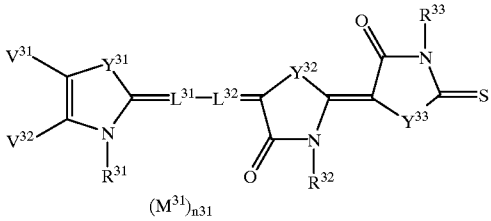

wherein $Y^{31}$, $Y^{32}$ and $Y^{33}$ each represent —N($R^{34}$)—, —O—, —S—, —Se—; $R^{31}$ represents an aliphatic group having 10 or less carbon atoms and containing an aqueous solubility promoting group; $R^{32}$, $R^{33}$ and $R^{34}$ each represent a substituted or unsubstituted aliphatic group, a substituted or unsubstituted aryl group or a substituted or unsubstituted heterocyclic group, provided that at least two of $R^{32}$, $R^{33}$ and $R^{34}$ contain an aqueous solubility promoting group; $V^{31}$ and $V^{32}$ each represent a hydrogen atom, a substituted or unsubstituted alkyl group, a substituted or unsubstituted alkoxy group, or a substituted or unsubstituted aryl group, or $V^{31}$ and $V^{32}$ combine with each other to form a ring condensed with a substituted or unsubstituted azole ring; $L^{31}$ and $L^{32}$ represent a substituted or unsubstituted methine group; $M^{31}$ represents an ion necessary to counterbalance a total intramolecular charge; and n21 represents a number of ion necessary to counterbalance a total intramolecular charge;

formula (3-a)

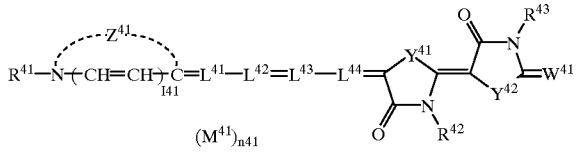

wherein $Z^{41}$ represent a non-metallic atom group necessary to form a 5- or 6-membered nitrogen-containing heterocyclic ring, which may be be condensed; $Y^{41}$ and $Y^{42}$ each represent —N($R^{44}$)—, —O—, —S—, —Se—or —Te—; $R^{41}$ represents an aliphatic group having 8 or less carbon atoms and containing an aqueous solubility promoting group; $R^{42}$, $R^{43}$ and $R^{44}$ each represent a substituted or unsubstituted aliphatic group, a substituted or unsubstituted aryl group or a substituted or unsubstituted heterocyclic group, provided that at least two of $R^{42}$, $R^{43}$ and $R^{44}$ contain an aqueous solubility promoting group; $W^{41}$ represents an oxygen atom, sulfur atom, =N(Ar) or =C<($E^{41}$) ($E^{42}$), in which Ar represents an aromatic ring group or a heterocyclic group, $E^{41}$ and $E^{42}$ combine with each other to form a heterocyclic ring; $L^{41}$, $L^{42}$, $L^{43}$ and $L^{44}$ represent a substituted or unsubstituted methine group; 141 is 0 or 1; $M^{41}$ represent an ion necessary to counterbalance a total intramolecular charge; and n41 represents a number of ion necessary to counterbalance a total intramolecular charge;

formula (3-b)

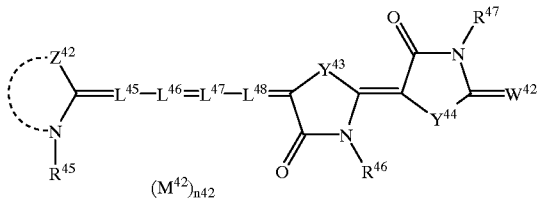

wherein $Y^{43}$ and $Y^{44}$ each represent —N($R^{48}$)—, —O—, —S—, —Se—or —Te—; $R^{46}$, $R^{47}$ and $R^{48}$ represent a substituted or unsubstituted aliphatic group, a substituted or unsubstituted aryl group or a substituted or unsubstituted heterocyclic group, provided that at least two or $R^{46}$, $R^{47}$ and $r^{48}$ contain an aqueous solubility promoting group; $Z^{42}$ represent a non-metallic atom group necessary to form a 5- or 6-membered nitrogen-containing heterocyclic ring, which may be condensed; $W^{42}$ represents an oxygen atom or a sulfur atom; $L^{45}$, $L^{46}$, $L^{47}$ and $L^{48}$ represent a substituted or unsubstituted methine group, provided that at least one of $L^{45}$, $L^{46}$, $L^{47}$ and $L^{48}$ is a substituted methine group; $M^{42}$ represent an ion necessary to counterbalance a total intramolecular charge; and n42 represents a number of ion necessary to counterbalance a total intramolecular charge;

formula (4)

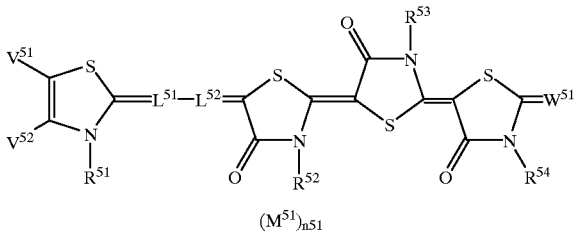

wherein $R^{51}$ represents an aliphatic group having 10 or less carbon atoms and containing an aqueous solubility promoting group; $R^{52}$, $R^{53}$ and $R^{54}$ represent a substituted or unsubstituted aliphatic group, a substituted or unsubstituted aryl group or a substituted or unsubstituted heterocyclic group, provided that at least two of $R^{52}$, $R^{53}$ and $R^{54}$ contain an aqueous solubility promoting group; $V^{51}$ and $V^{52}$ each represent a hydrogen atom, a substituted or unsubstituted alkyl group, a substituted or unsubstituted alkoxy group, or a substituted or unsubstituted aryl group, or $V^{51}$ and $V^{52}$ combine with each other to form a ring condensed with a substituted or unsubstituted azole ring; $W^{51}$ represents an oxygen atom, sulfur atom, =N(Ar) or =C<($E^{51}$) ($E^{52}$), in which Ar represents an aromatic ring group or a heterocyclic group, $E^{51}$ and $E^{52}$ represent an electron-withdrawing group or combine with each other to form a heterocyclic ring containing an oxo group or an acidic heterocyclic ring; $L^{51}$ and $L^{52}$ represent a substituted or unsubstituted methine group; $M^{51}$ represent an ion necessary to counterbalance a total intramolecular charge; and n51 represents a number of ion necessary to counterbalance a total intramolecular charge;

formula (5)

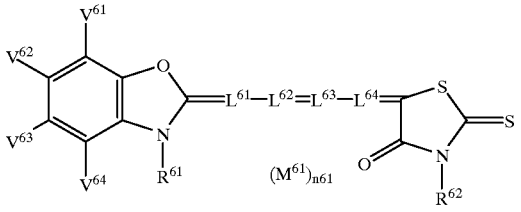

wherein $R^{61}$ and $R^{62}$ represent a substituted or unsubstituted alkyl group, provided that at least one of $R^{61}$ and $R^{62}$ contains an aqueous solubility promoting group; $V^{61}$, $V^{62}$, $V^{63}$ and $V^{64}$ represent a hydrogen atom or a univalent substituent group, provided that $V^{61}$, $V^{62}$, $V^{63}$ and $V^{64}$ do not combine with each other to form a ring and the sum of molecular weights of $V^{61}$, $V^{62}$, $V^{63}$ and $V^{64}$ is 4 to 50; $L^{61}$, $L^{62}$, $L^{63}$ and $L^{64}$ represent a substituted or unsubstituted methine group; $M^{61}$ represents an ion necessary to counterbalance a total intramolecular charge; and n61 represents a number of ion necessary to counterbalance a total intramolecular charge; and formula (A)

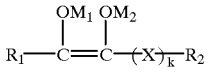

wherein $R_1$ and $R_2$ represent a substituted or unsubstituted alkyl group, a substituted or unsubstituted amino group, a substituted or unsubstituted alkoxy group or a substituted or unsubstituted alkythio group, or $R_1$ and $R_2$ combine with each other to form a ring; k is 0 or 1; when k is 1, X represents —CO— or —CS—; $M_1$ and $M_2$ represent a hydrogen atom or an alkali metal atom.

2. The processing method of claim 1, wherein a swelling percentage of the photographic material of the light sensitive silver halide emulsion layer side is 10 to 100%.

3. The processing method of claim 1, wherein the light sensitive silver halide emulsion layer contains a hydrazine derivative.

4. The processing method of claim 1, wherein the photographic material comprises a hydrophilic colloidal layer which is adjacent to the light sensitive silver halide emulsion layer, the hydrophilic colloidal layer containing a hydrazine derivative.

5. The processing method of claim 1, wherein the developer solution is replenished at a replenishing rate which is determined based on the proportion of an exposed area per unit area of the photographic material, the replenishing rate being 30 to 250 ml per $m^2$ of the photographic material.

6. The processing method of claim 1, wherein the developer solution is replenished at a replenishing rate which is determined based on the proportion of an exposed area per unit area of the photographic material, a developer replenishing solution exhibiting a pH higher by 0 to 0.5 than that of the developer solution at the start of development.

7. The processing method of claim 1, wherein the fixer solution is replenished at a replenishing rate which is determined based on the proportion of an exposed area per unit area of the photographic material, the replenishing rate being 30 to 300 ml per $m^2$ of the photographic material.

* * * * *